US010340609B2

(12) United States Patent
Kosaka et al.

(10) Patent No.: US 10,340,609 B2
(45) Date of Patent: Jul. 2, 2019

(54) MULTIBAND ANTENNA, MULTIBAND ANTENNA ARRAY, AND WIRELESS COMMUNICATIONS DEVICE

(71) Applicant: NEC Corporation, Tokyo (JP)

(72) Inventors: Keishi Kosaka, Tokyo (JP); Hiroshi Toyao, Tokyo (JP)

(73) Assignee: NEC CORPORATION, Tokyo (JP)

( * ) Notice: Subject to any disclaimer, the term of this patent is extended or adjusted under 35 U.S.C. 154(b) by 16 days.

(21) Appl. No.: 15/544,699

(22) PCT Filed: Feb. 10, 2016

(86) PCT No.: PCT/JP2016/000694
§ 371 (c)(1),
(2) Date: Jul. 19, 2017

(87) PCT Pub. No.: WO2016/132712
PCT Pub. Date: Aug. 25, 2016

(65) Prior Publication Data

US 2018/0287268 A1 Oct. 4, 2018

(30) Foreign Application Priority Data

Feb. 16, 2015 (JP) ..... 2015-027372

(51) Int. Cl.
*H01Q 21/30* (2006.01)
*H01Q 13/10* (2006.01)
(Continued)

(52) U.S. Cl.
CPC ..... *H01Q 21/30* (2013.01); *H01Q 5/42* (2015.01); *H01Q 13/10* (2013.01); *H01Q 15/14* (2013.01);
(Continued)

(58) Field of Classification Search
CPC ..... H01Q 21/30; H01Q 15/14; H01Q 21/06
See application file for complete search history.

(56) References Cited

U.S. PATENT DOCUMENTS 6,025,812 A 2/2000 Gabriel et al.
2007/0008236 A1* 1/2007 Tillery ..... H01Q 21/30 343/797
(Continued)

FOREIGN PATENT DOCUMENTS

JP 2012085262 A * 4/2012 ..... H01Q 13/16
JP 2015-046689 A 3/2015
(Continued)

OTHER PUBLICATIONS

International Search Report of PCT/JP2016/000694 filed Apr. 26, 2016.

*Primary Examiner* — Daniel Munoz
*Assistant Examiner* — Bamidele A Jegede
(74) *Attorney, Agent, or Firm* — Sughrue Mion, PLLC

(57) ABSTRACT

An object of the present invention is to provide a multiband antenna, an antenna array, and a wireless communications device that can achieve miniaturization while preventing deterioration in radiation efficiency. To this end, an antenna according to the present invention includes: a conductor reflection plate; a first antenna that includes a first antenna element and is provided on the conductor reflection plate; and a second antenna that includes a second antenna element having an electromagnetic resonance frequency that is a frequency different from an electromagnetic resonance frequency of the first antenna element included in the first antenna, and that is provided on the conductor reflection plate, wherein each of the first antenna element and the second antenna element includes: a C-shaped conductor that is a substantially C-shaped conductor having a split section formed in such a way that an annular conductor becomes
(Continued)

partially discontinuous; and a conductor feed line that is electrically connected with one part out of both parts of the C-shaped conductor facing each other across the split section, and that constitutes an electric circuit for feeding power to the C-shaped conductor.

10 Claims, 53 Drawing Sheets

(51) Int. Cl.

| | |
|---|---|
| ***H01Q 21/06*** | (2006.01) |
| ***H01Q 21/24*** | (2006.01) |
| ***H01Q 15/14*** | (2006.01) |
| ***H01Q 21/26*** | (2006.01) |
| ***H01Q 25/00*** | (2006.01) |
| ***H01Q 5/42*** | (2015.01) |
| *H01Q 13/18* | (2006.01) |
| *H01Q 5/371* | (2015.01) |

(52) U.S. Cl.
CPC ..... *H01Q 21/06* (2013.01); *H01Q 21/061* (2013.01); *H01Q 21/24* (2013.01); *H01Q 21/26* (2013.01); *H01Q 25/001* (2013.01); *H01Q 5/371* (2015.01); *H01Q 13/18* (2013.01)

(56) References Cited

U.S. PATENT DOCUMENTS

| | | | | |
|---|---|---|---|---|
| 2007/0236400 | A1* | 10/2007 | Rentz | H01Q 9/42 343/753 |
| 2010/0238079 | A1* | 9/2010 | Ayatollahi | H01Q 1/243 343/729 |
| 2012/0169552 | A1* | 7/2012 | Lee | H01Q 9/285 343/727 |
| 2013/0135164 | A1* | 5/2013 | Asanuma | H01Q 7/00 343/749 |
| 2013/0271333 | A1* | 10/2013 | Taura | H01Q 13/10 343/767 |
| 2013/0342425 | A1* | 12/2013 | Wong | H01Q 1/2266 343/893 |
| 2014/0203993 | A1* | 7/2014 | Toyao | H01Q 13/10 343/867 |
| 2015/0288071 | A1* | 10/2015 | Toyao | H01Q 1/48 343/700 MS |

FOREIGN PATENT DOCUMENTS

| | | | | |
|---|---|---|---|---|
| WO | WO 2011076582 | * | 6/2011 | H01Q 1/243 |
| WO | 2013/027824 | A1 | 2/2013 | |
| WO | 2014/059946 | A1 | 4/2014 | |
| WO | 2014/073703 | A1 | 5/2014 | |

* cited by examiner

20

30

MULTIBAND ANTENNA, MULTIBAND ANTENNA ARRAY, AND WIRELESS COMMUNICATIONS DEVICE

CROSS REFERENCE TO RELATED APPLICATIONS

This application is a National Stage of International Application No. PCT/JP2016/000694 filed Feb. 10, 2016, claiming priority based on Japanese Patent Application No. 2015-027372 filed Feb. 16, 2015, the contents of all of which are incorporated herein by reference in their entirety.

TECHNICAL FIELD

The present invention relates to an antenna, an antenna array, and a wireless communications device, and particularly, relates to a multiband antenna, a multiband antenna array, and a wireless communications device.

BACKGROUND ART

In recent years, a multiband antenna that enables communication over a plurality of frequency bands for ensuring communication capacity has been put to practical use, for example, as a base station for mobile communication and an antenna device for Wi-Fi (registered trademark) communication equipment.

A multiband antenna is disclosed as a multiband antenna array in, for example, FIGS. 11, 12, and 13 of PTL 1. This antenna array includes an antenna reflector, and an array of high-band and low-band crossed-dipole antenna elements alternately aligned on the antenna reflector. Further, central conductive fences 1340 are provided between the alignments to reduce mutual coupling. In addition, in PTL 2, in FIGS. 2a, 2b, and 2c, a decoupling element (decoupling structural element 17) is arranged between individual antenna elements (radiation element module 1) of a single-frequency antenna array.

CITATION LIST

Patent Literature

[PTL 1] International Publication WO 2014/059946
[PTL 2] U.S. Pat. No. 6,025,812 Description

SUMMARY OF INVENTION

Technical Problem

However, when a dipole antenna is used as described in PTLs 1 and 2 described above, a size of ½ wavelength is required for maintaining radiation efficiency. Thus, the multiband antenna in PTL 1 that uses a plurality of dipole antennas corresponding to respective frequency bands is difficult to be made more compact as a whole.

An object of the present invention is to provide a multiband antenna, an antenna array, and a wireless communications device that can achieve miniaturization, which has been made in order to solve the problem described above.

Solution to Problem

An antenna according to the present invention includes:

a first antenna that includes a first antenna element having a resonance frequency within a first frequency band;

a second antenna that includes a second antenna element having a resonance frequency within a second frequency band that is a frequency band higher than the first frequency band; and a conductor reflection plate, wherein each of the first antenna element and the second antenna element includes: a C-shaped conductor that is a substantially C-shaped conductor having a split section formed in such a way that an annular conductor becomes partially discontinuous; and a conductor feed line that is electrically connected with one part out of both parts of the C-shaped conductor, facing each other across the split section, and that constitutes an electric circuit for feeding power to the C-shaped conductor.

Advantageous Effects of Invention

The present invention is able to provide a multiband antenna, a multiband antenna array, and a wireless communications device that can achieve miniaturization.

DESCRIPTION OF EMBODIMENTS

Example embodiments of the present invention will be described below with reference to the drawings. However, the example embodiments described below include technically preferable limitations to carry out the present invention, but the scope of the invention is not limited to the following. In addition, in the following description, a position of each configuration may be described using an expression such as top, bottom, left, and right, based on each drawing. However, this expression is for illustrative purpose, but is not for limiting a direction when the present invention is carried out.

(First Example Embodiment)

An antenna 10 according to a first example embodiment of the present invention will be described below.

Figure 1:
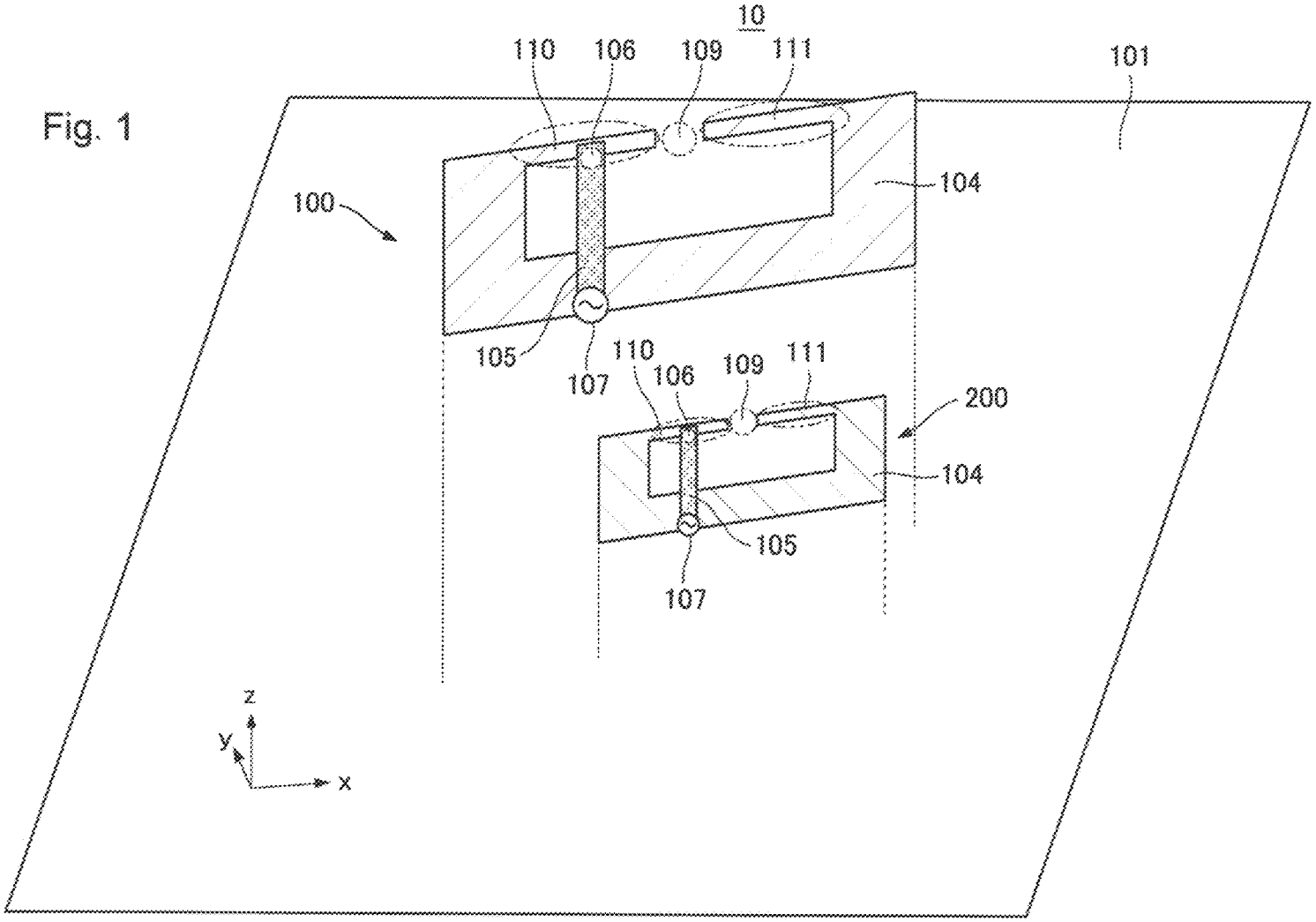
FIG. 1 is a perspective view of an antenna according to a first example embodiment of the present invention.
Figure 2:
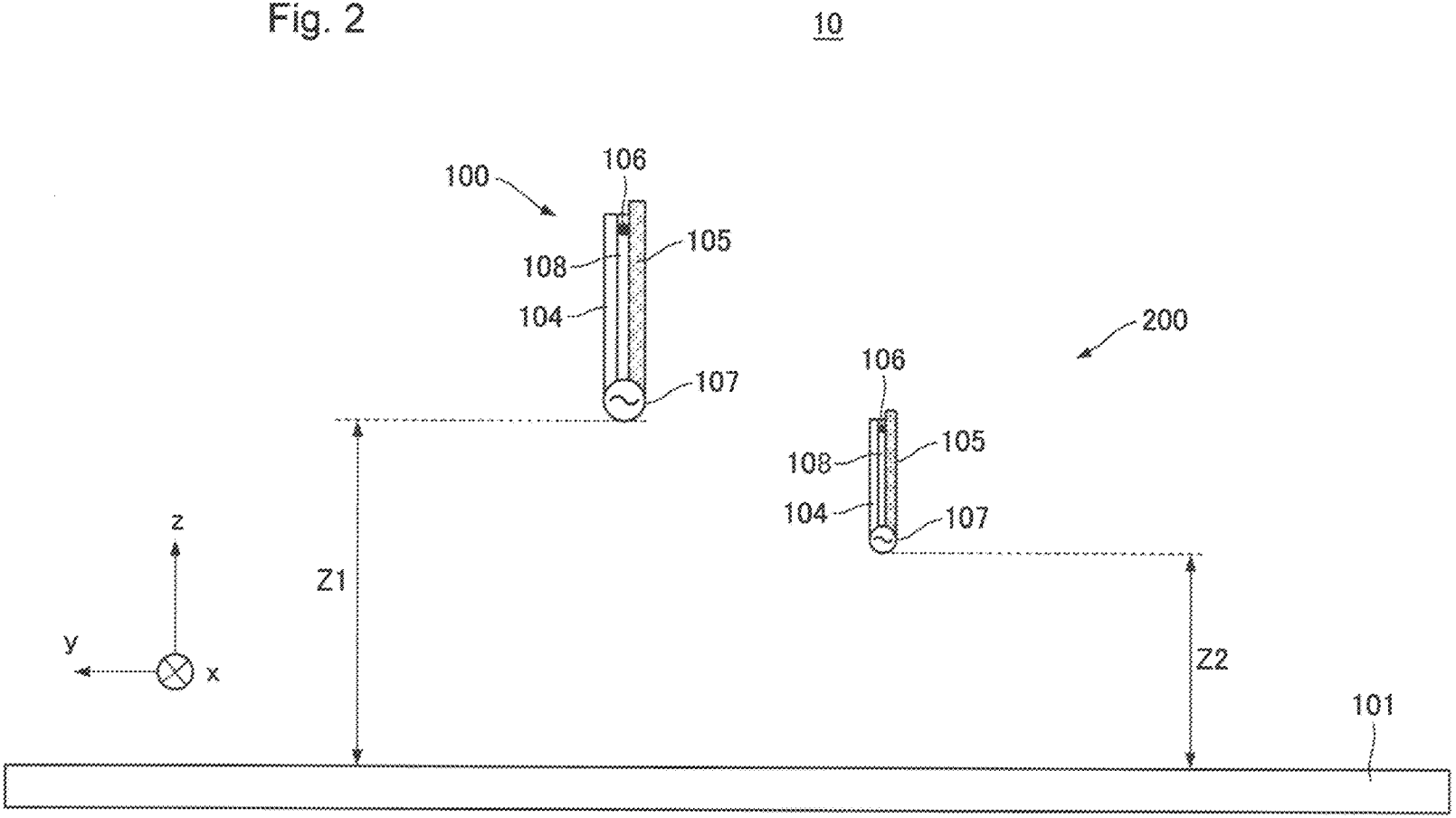
FIG. 2 is a front elevational view of the antenna according to the first example embodiment of the present invention.

FIG. 1 is a perspective view of the antenna 10, and FIG. 2 is a side view of the antenna 10. In FIGS. 1 and 2, for illustrative purpose, an x-axis and a y-axis are defined on a plane formed by a conductor reflection plate 101 to be described later, and a z-axis is defined in a perpendicular direction with respect to the plane formed by the conductor reflection plate 101. Note that x-, y-, and z-axes indicated in other drawings to be described later are also defined similarly.

The antenna 10 includes an antenna element 100 as a first antenna element, an antenna element 200 as a second antenna element, and the conductor reflection plate 101. The first antenna element has a resonance frequency in a first frequency band, and the second antenna element has a resonance frequency in a second frequency band that is a frequency higher than the first frequency band. As illustrated in FIG. 2, the antenna element 100 is provided above the conductor reflection plate 101 at a distance of z1. Likewise, the antenna element 200 is provided above the conductor reflection plate 101 at a distance of z2.

Herein, a configuration of the antenna elements 100 and 200 will be described. As illustrated in FIGS. 1 and 2, each of the antenna elements 100 and 200 includes, for example, a C-shaped conductor 104, a conductor feed line 105, a conductor via 106, a feed point 107, and a dielectric layer 108. Note that illustration of the dielectric layer 108 is omitted in FIG. 1, for ease of understanding arrangement of other configurations. In addition, illustration of the dielectric layer 108 is also omitted as appropriate in the drawings to be described later.

The C-shaped conductor 104 is a conductor that functions as a split ring resonator, and is a substantially C-shaped conductor that has a split section 109 formed in such a way that an annular conductor becomes partially discontinuous. In addition, as illustrated in FIG. 2, the antenna elements 100 and 200 are provided perpendicularly with respect to the conductor reflection plate 101, in other words, in parallel with an x-z plane. In the example illustrated in FIGS. 1 and 2, the C-shaped conductor 104 has a substantially rectangular outer shape, on a long side of which the split section 109 is formed. The split section 109 is a separated part of an annular conductor. In other words, the split section 109 is a gap formed in such a way that one end and another end of the C-shaped conductor 104 face each other. Herein, the C-shaped conductor 104 has a length in a lengthwise direction (x-axis direction in FIGS. 1 and 2) of, for example, approximately ¼ of λ1 in the antenna element 100, and approximately ¼ of λ2 in the antenna element 200. Note that each of λ1 and λ2 indicates a wavelength of an electromagnetic wave whose frequency is a resonance frequency of the first antenna element or the second antenna element when traveling through a substance filling a region.

The conductor feed line 105 is a conductor that feeds power from the feed point 107 to the C-shaped conductor 104. Hence, the conductor feed line 105 constitutes an electric circuit for feeding power to the C-shaped conductor 104. As illustrated in FIGS. 1 and 2, the conductor feed line 105 is, for example, a conductor having a length substantially equal to a length of the C-shaped conductor 104 in a z-axis direction.

In addition, the dielectric layer 108 is a plate-shaped dielectric. The dielectric layer 108 is, for example, a dielectric layer constituting a substrate. The dielectric layer 108 is a layer in between a layer on which the C-shaped conductor 104 is present and a layer on which the conductor feed line 105 is present.

The C-shaped conductor 104 is provided on one face side of the dielectric layer 108. In addition, the conductor feed line 105 is provided on another face side of the dielectric layer 108, and faces the C-shaped conductor 104 with spacing across the dielectric layer 108.

The conductor via 106 is a via that electrically connects between one conductor part out of both conductor parts 110 and 111 of the C-shaped conductor 104 facing each other in a circumferential direction across the split section 109 and one end of the conductor feed line 105. In the example illustrated in FIGS. 1 and 2, the conductor via 106 is a via that electrically connects the conductor part 110 with one end of the conductor feed line 105.

The feed point 107 is a point that is supplied with high-frequency power from a not-illustrated power source. More specifically, the feed point 107 is a feed point capable of electrically exciting between another end (on a side not connected with the conductor via 106) of the conductor feed line 105 and a part of the C-shaped conductor 104 in a vicinity of the another end. In the example illustrated in FIGS. 1 and 2, the feed point 107 is capable of electrically exciting between a part of the C-shaped conductor 104 at a position facing the conductor part 110 in a z-axis direction and another end of the conductor feed line 105. In this way, each of the antenna elements 100 and 200 is configured in such a way that high-frequency power is supplied to the conductor part 110 or the conductor part 111 of the C-shaped conductor 104, and to a conductor part on the C-shaped conductor 104 facing the conductor part 110 or 111 with spacing in an inward direction of the C-shaped conductor 104. The feed point 107 is connected with, for example, a not-illustrated radio communication circuit or a transmission line transmitting a radio signal from a radio communication circuit, and the radio communication circuit and the antenna 10 can exchange a radio communication signal via the feed point 107.

In addition, in the present example embodiment, the antenna elements 100 and 200 are respectively arranged apart from the conductor reflection plate 101 by predetermined spaces (distances Z1 and Z2 illustrated in FIG. 2) in a z-axis direction. Herein, since the conductor reflection plate 101 is a short-circuiting face, it is more desirable that the distance Z1 be substantially ¼ of λ1 and the distance Z2 be substantially ¼ of λ2, in order to reduce influence of an antenna element on a resonance characteristic.

Note that the conductor reflection plate 101, the C-shaped conductor 104, the conductor feed line 105, the conductor via 106, and further, a component described as a conductor in the following description are composed of, for example, metals such as copper, silver, aluminum, and nickel, or other well-conductive materials. The conductor reflection plate 101 is formed on, for example, a ceramics substrate such as a glass epoxy substrate, and an alumina substrate.

In addition, the C-shaped conductor 104, the conductor feed line 105, the conductor via 106, and the dielectric layer 108, which are generally fabricated by an ordinary substrate fabrication process such as a printed substrate, and a semiconductor substrate, may be fabricated by another method.

In addition, the conductor via 106, which is generally formed by plating a through-hole formed through the dielectric layer 108 with a drill, may be any conductor via as long as being capable of electrically interconnecting layers. For example, the conductor via 106 may be constituted of a laser via formed with a laser, or may be constituted by using a copper wire or the like.

In addition, the dielectric layer 108 may be omitted. In addition, the dielectric layer 108 may be constituted of only a partially-dielectric supporting member, at least a part of which may be hollow.

In addition, the conductor reflection plate 101, which is generally formed of a sheet metal or a copper foil bonded to a dielectric substrate, may be formed of another material as long as being conductive.

Next, an action and an advantageous effect of the present example embodiment will be described. According to the antenna elements 100 and 200 of the present example embodiment, the C-shaped conductor 104 functions as an LC series resonator in which an inductance caused by current flowing along a ring, and a capacitance occurring between conductors facing each other at the split section 109, are connected in series. In other words, the C-shaped conductor 104 functions as a split ring resonator. Large current flows through the C-shaped conductor 104 at around a resonance frequency of the split ring resonator, and the C-shaped conductor 104 operates as an antenna, since a part of current components contributes to radiation.

At this time, a current component of current flowing through the C-shaped conductor 104 that mainly contributes to radiation is a current component in a lengthwise direction (x-axis direction in FIGS. 1 and 2) of the antenna elements 100 and 200. Thus, elongating a length of the C-shaped conductor 104 in a lengthwise direction makes it possible to achieve satisfactory radiation efficiency. Herein, the length of the C-shaped conductor 104 in a lengthwise direction (x-axis direction in FIGS. 1 and 2) is, for example, approximately ¼ of $\lambda 1$ in the antenna element 100, and approximately ¼ of $\lambda 2$ in the antenna element 200. Consequently, the antenna elements 100 and 200 are more compact than dipole antenna elements corresponding to respective frequencies. Therefore, by using the antenna elements 100 and 200 corresponding to respective frequencies, a multiband antenna can be made more compact in comparison with a case of using a plurality of dipole antennas. In addition, by making each of the antenna elements 100 and 200 more compact, it becomes possible to bring the antenna elements 100 and 200 closer to each other.

However, the C-shaped conductor 104 of the antenna element 100 illustrated in FIGS. 1 and 2 is substantially rectangular, but even the antenna element 100 of another shape does not affect an essential advantageous effect of the present invention. For example, the antenna element 100 may have a shape such as a square shape, a circular shape, a triangle shape, and a bow tie shape.

In addition, the resonance frequency of the split ring resonator described above can be lowered when the inductance is increased by narrowing the space between the conductors facing each other at the split section 109, or by elongating a current path by increasing a ring size of the split ring (the C-shaped conductor 104). In addition, the resonance frequency can be also lowered by increasing the capacitance by narrowing the space between the conductors facing each other at the split section 109. In particular, a method of narrowing the space between the conductors facing each other at the split section 109 can lower an operating frequency without increasing an overall size, and thus, is suitable for miniaturization.

As described above, when two C-shaped conductors 104 achieving miniaturization and satisfactory radiation efficiency are arranged for different frequencies above the conductor reflection plate 101, a multiband antenna that is more compact than using a plurality of dipole antennas can be provided while maintaining radiation efficiency.

The antenna 10 according to the present example embodiment may be incorporated as, for example, a wireless communications device such as a Wi-Fi, and an antenna unit in a mobile communication base station as appropriate.

Figure 3:
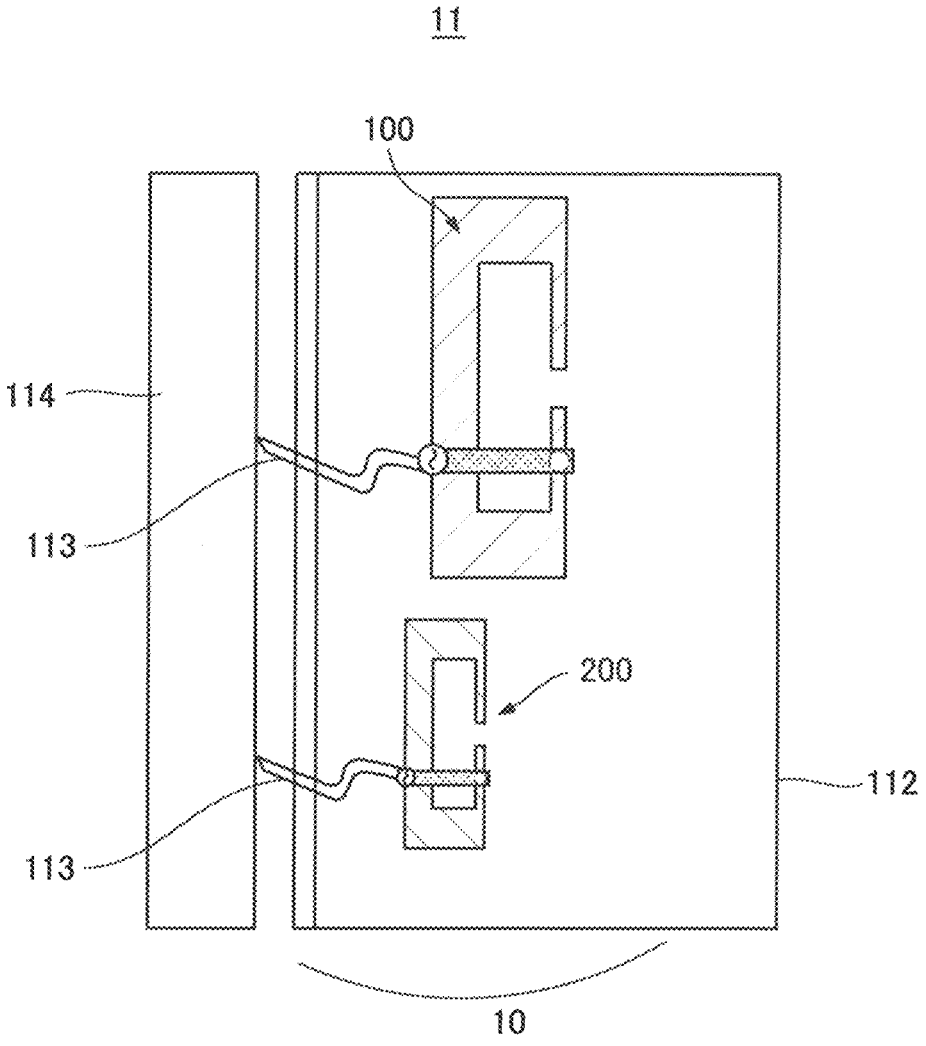
FIG. 3 is a wireless communications device as an example of a wireless communications device including the antenna according to the first example embodiment of the present invention.

FIG. 3 illustrates a wireless communications device 11 as an example of a wireless communications device including the antenna 10. The wireless communications device 11 illustrated in FIG. 3 includes the antenna 10, a dielectric radome 112 that mechanically protects the antenna 10, a radio communication circuit section 114, and a transmission line 113 that transmits a radio signal between the antenna element 100 or 200 in the antenna 10 and the radio communication circuit section 114. Note that, in FIG. 3, the dielectric radome 112 is illustrated as being transparent, for simplification of illustration. With such a configuration, a wireless communications device using a multiband antenna can be made compact while maintaining radiation efficiency.

Figure 4:
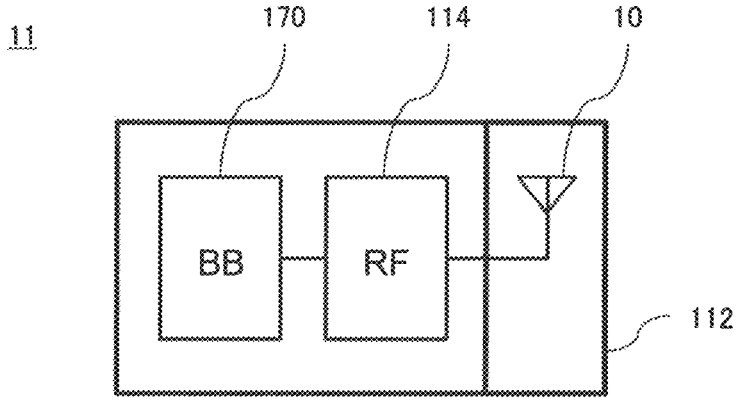
FIG. 4 is a block diagram illustrating a configuration of a wireless communications device as an example of the wireless communications device including the antenna according to the first example embodiment of the present invention.

The wireless communications device 11 may be used as, for example, a wireless communications device, a mobile communication base station, and a radar. Besides the above, the wireless communications device 11 may include a baseband processing section 170 that performs baseband processing, and the like, as illustrated in FIG. 4, for example.

Further, various modification examples of the present example embodiment will be described below. In addition, the various modification examples described below may be combined as appropriate.

The antenna 10 in FIGS. 1 and 2 includes the conductor reflection plate 101, and the conductor reflection plate 101 is used mainly for the purpose of enhancing radiation intensity of an electromagnetic wave in an upward direction (z-axis positive direction in FIGS. 1 and 2) where the antenna elements 100 and 200 are present when viewed from the conductor reflection plate 101. Thus, the antenna 10 even without the conductor reflection plate 101 functions as a compact multiband antenna. In addition, the antenna 10 in FIGS. 1 and 2 is a dualband antenna in which the antenna elements 100 and 200 respectively correspond to two frequencies. However, the antenna 10 may be a multiband antenna that includes a larger number of multiple antenna elements having resonance frequencies in respective frequency bands and corresponding to three or more frequency bands.

Figure 5:
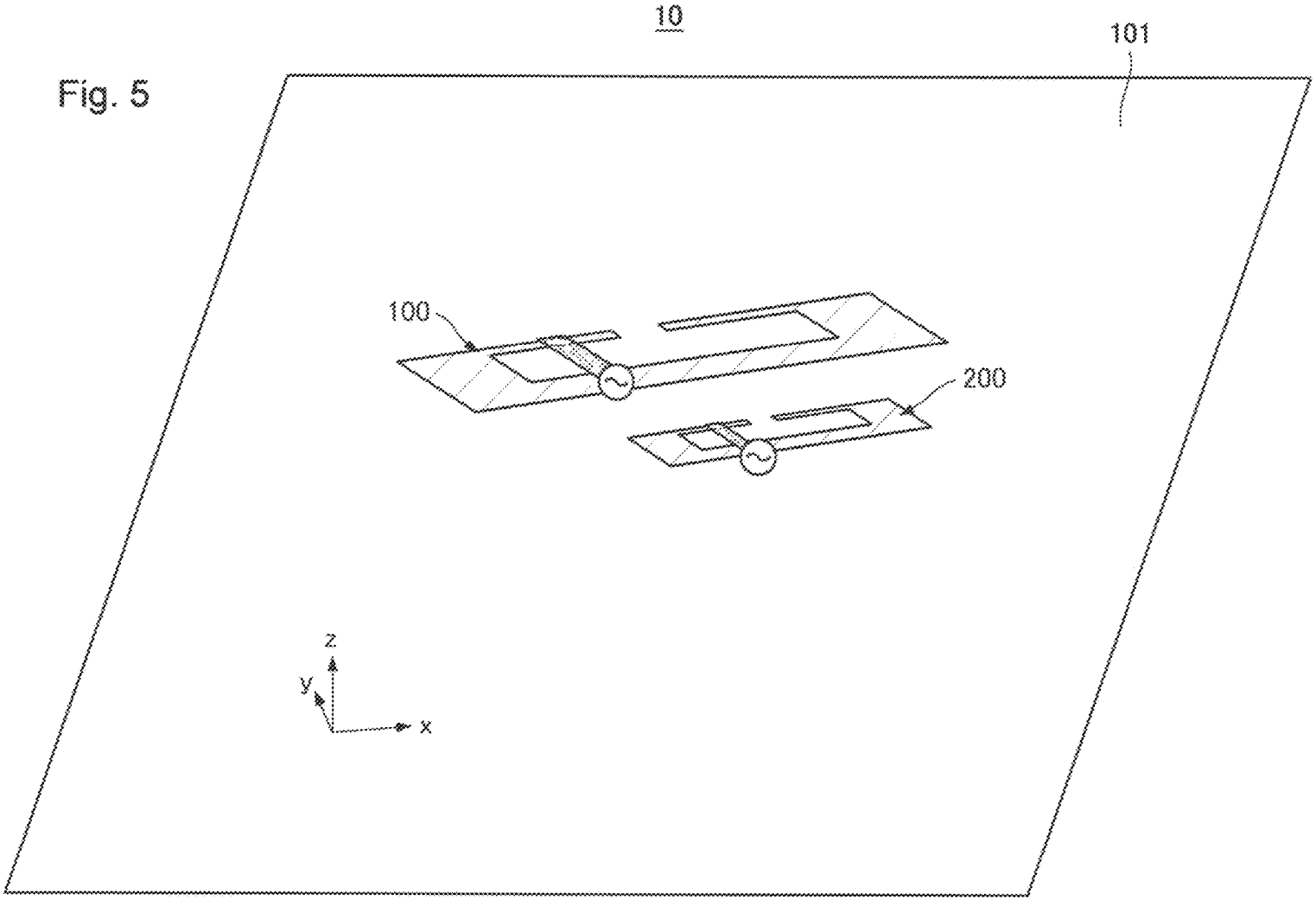
FIG. 5 is a perspective view illustrating a modification example of the antenna according to the first example embodiment of the present invention.
Figure 6:
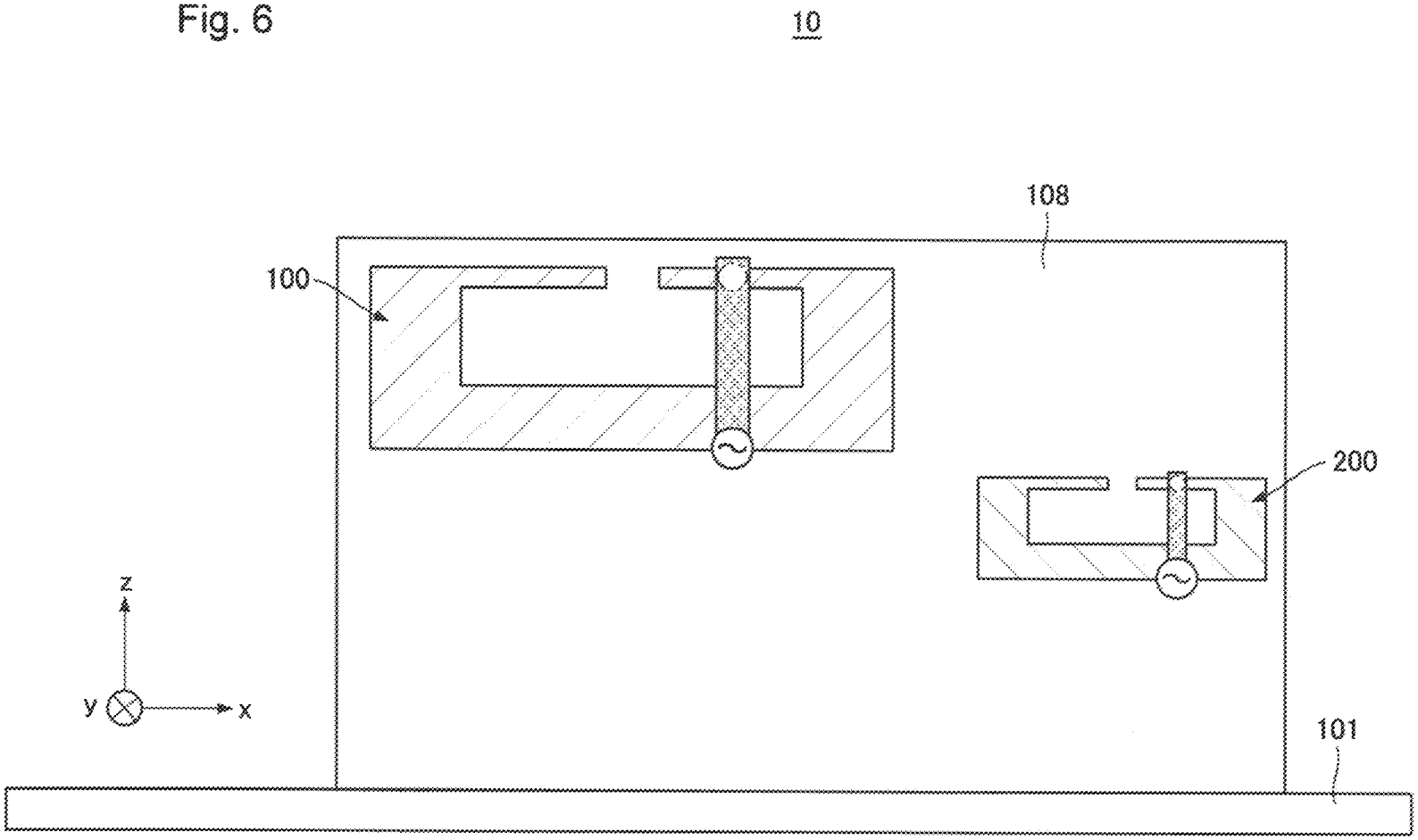
FIG. 6 is a front elevational view illustrating a modification example of the antenna according to the first example embodiment of the present invention.

In addition, in the antenna 10 in FIGS. 1 and 2, the antenna elements 100 and 200 are arranged substantially in parallel, but may not necessarily be arranged in parallel. In addition, the antenna element 200 may be positioned immediately below the antenna element 100. In addition, in the antenna 10 in FIGS. 1 and 2, the antenna elements 100 and 200 are arranged in an upright attitude with respect to the conductor reflection plate 101, but are not limited thereto. For example, as in FIG. 5, the antenna elements 100 and 200 may be arranged in a parallel attitude (parallel to an x-y plane) with respect to the conductor reflection plate 101. Note that illustration of the dielectric layer 108 is omitted in FIG. 5, for simplification of illustration. In addition, in this case, the antenna elements 100 and 200 may become an integrated substrate by being formed on respective layers of an identical substrate In addition, in the antenna 10 in FIGS. 1 and 2, the antenna elements 100 and 200 are not arranged on an identical plane. However, as illustrated in FIG. 6, the antenna element 100 and the antenna element 200 may be arranged on an identical plane while sharing the dielectric layer 108, and the antenna elements 100 and 200 may be created on an identical layer or respective layers within an identical substrate.

Figure 7:
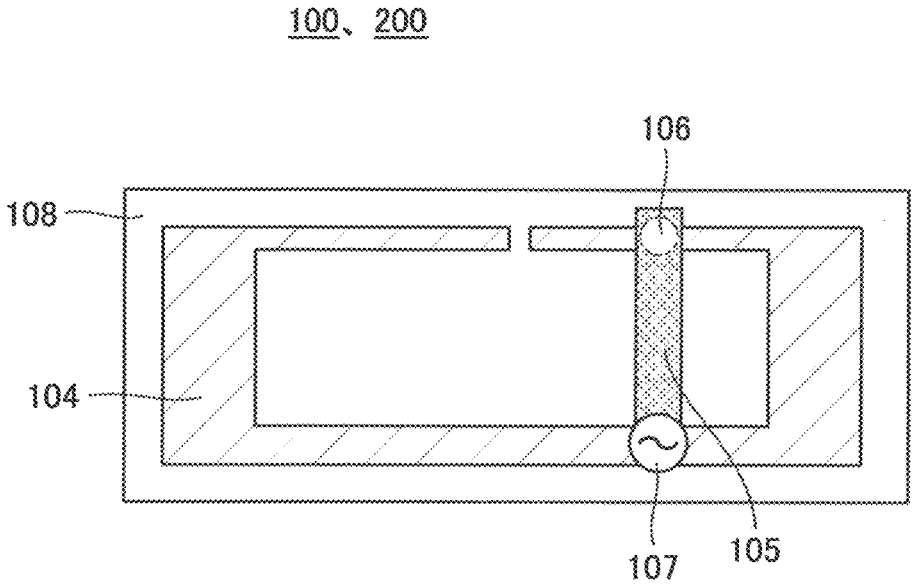
FIG. 7 is a front elevational view illustrating a modification example of the antenna according to the first example embodiment of the present invention.

In addition, the antenna element 100 and the antenna element 200 may not necessarily be structures illustrated in FIGS. 1 and 2, and further structural devisal may be made. FIGS. 7 to 11 are diagrams illustrating various modification examples of a configuration of the antenna element 100. For example, as illustrated in FIG. 7, the dielectric layer 108 may be made in a larger size than the C-shaped conductor 104. When the dielectric layer 108 is allowed to be larger than the C-shaped conductor 104 as described above, it is possible to prevent deterioration in dimensional accuracy of the C-shaped conductor 104, caused by cutting an end section of the dielectric layer 108 involved in formation of the dielectric layer 108.

Figure 8:
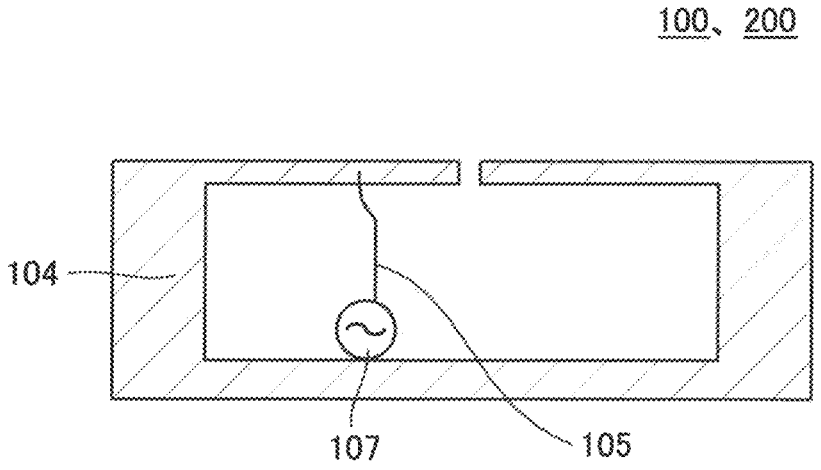
FIG. 8 is a front elevational view illustrating a modification example of the antenna according to the first example embodiment of the present invention.

In addition, one end of the conductor feed line 105 may be directly coupled in electrical continuity with a part (the conductor part 110 or 111) on a long side of the C-shaped conductor 104 on a far side from the conductor reflection plate 101, and the conductor via 106 may be omitted. In addition, for example, as illustrated in FIG. 8, the conductor feed line 105 may be a linear conductor such as a copper wire.

Figure 9:
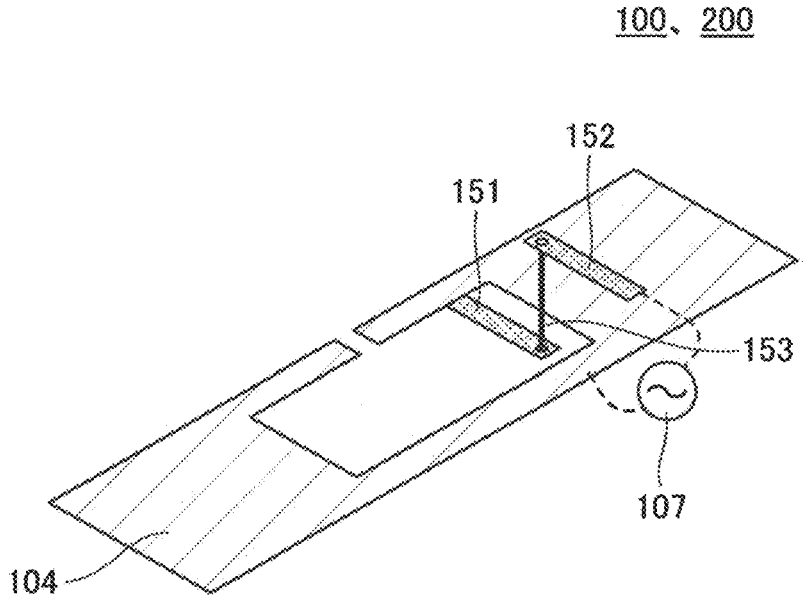
FIG. 9 is a perspective view illustrating a modification example of the antenna according to the first example embodiment of the present invention.

In addition, the antenna elements 100 and 200 may be configured by using a plurality of conductor feed lines in order to avoid contact between another end of the conductor feed line 105 and the C-shaped conductor 104. For example, as illustrated in FIG. 9, conductor feed lines 151 and 152 and a conductor via 153 may be provided. Herein, the conductor feed line 151 is on the same layer as that of the C-shaped conductor 104, and the conductor feed line 152 is on a different layer from that of the C-shaped conductor 104. In addition, one end of the conductor feed line 151 is electrically connected with the conductor part 110 or 111 of the C-shaped conductor 104. In addition, one end of the conductor feed line 152 is electrically connected with the feed point 107. Further, another end of the conductor feed line 151 is electrically connected with another end of the conductor feed line 152 through the conductor via 153. Note that, in the drawings, dashed lines extending from the feed point 107 indicate electric circuits for the conductor feed line and the C-shaped conductor.

Figure 10:
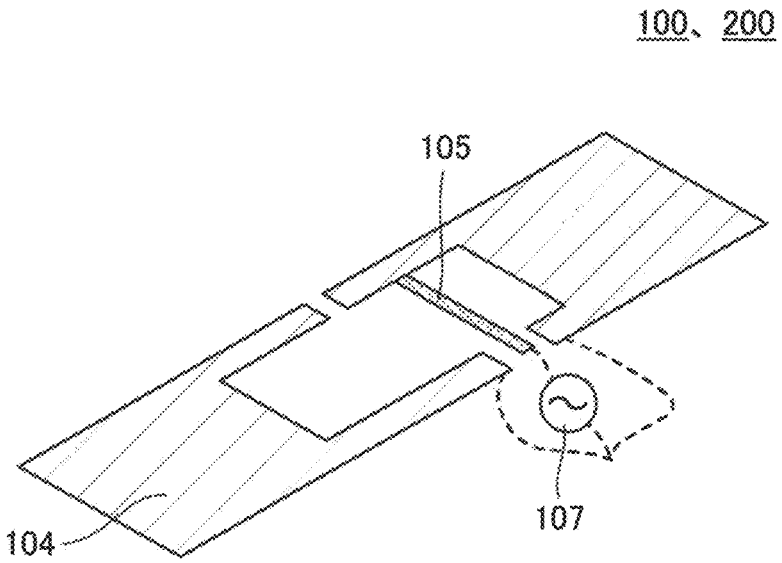
FIG. 10 is a perspective view illustrating a modification example of the antenna according to the first example embodiment of the present invention.
Figure 11:
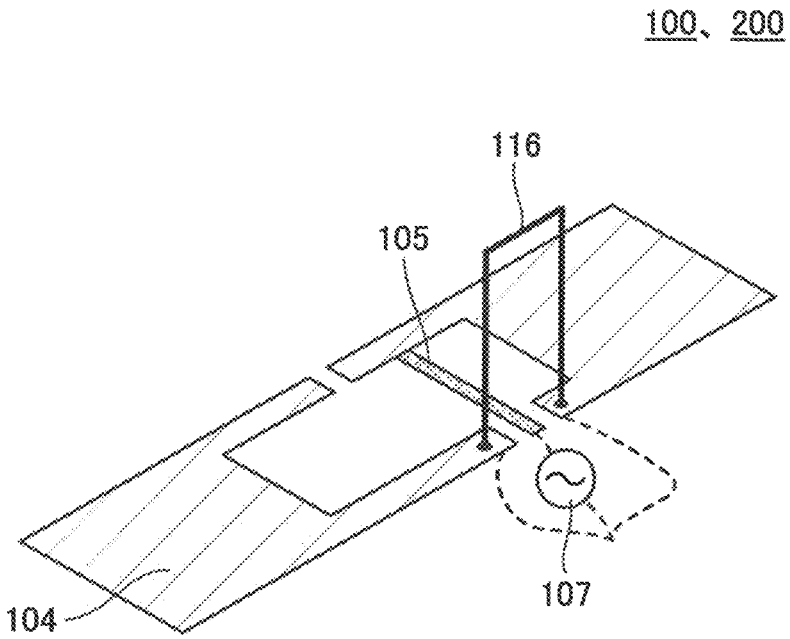
FIG. 11 is a perspective view illustrating a modification example of the antenna according to the first example embodiment of the present invention.

In addition, a configuration may be made as illustrated in FIG. 10. In an example illustrated in FIG. 10, a portion on a long side of the C-shaped conductor 104 on a close side to the conductor reflection plate 101 is cut out. In addition, the conductor feed line 105 is passed through the cut-out part. Further, the feed point 107 is provided so as to electrically excite between the conductor feed line 105 and end sections of the C-shaped conductor 104 forming the cutout. When such a configuration is made, the C-shaped conductor 104 and the conductor feed line 105 can be formed on an identical layer, which can facilitate manufacturing. However, further devisal may be made in order to compensate for deterioration in a resonance characteristic of the split ring resonator, caused by cutting out the C-shaped conductor 104. For example, as illustrated in FIG. 11, the antenna element 100 may include a bridging conductor 116 that conducts the cut-out part of the split ring resonator without making contact with the conductor feed line 105.

Additionally, further devisal for enhancing an electrical characteristic may be made to the antenna elements 100 and 200.

Figure 12:
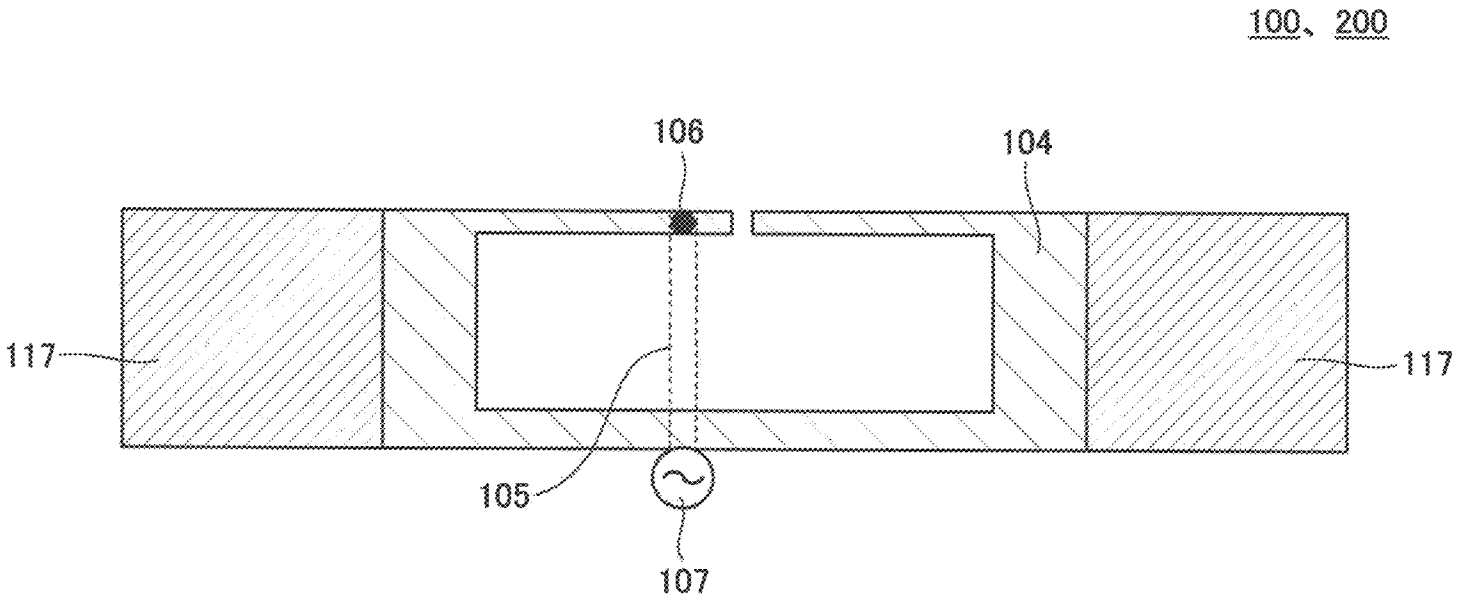
FIG. 12 is a front elevational view illustrating a modification example of the antenna according to the first example embodiment of the present invention.

As described above, a current component of current flowing through the C-shaped conductor 104 that mainly contributes to radiation is a current component in a lengthwise direction (x-axis direction in FIGS. 1 and 2) of the antenna elements 100 and 200. Thus, for example, as illustrated in FIG. 12, each of the antenna elements 100 and 200 may include conductive conductor radiation sections 117 at both end sections in a lengthwise direction of the C-shaped conductor 104. In other words, the conductor radiation sections 117 are electrically connected with outer edges positioned on both ends of the C-shaped conductor 104 in a direction in which both the conductor parts 110 and 111 face each other. Note that the conductor radiation section 117 is a conductor, and may be a material that is the same as that of the C-shaped conductor 104. With such a configuration, a current component in a lengthwise direction of the C-shaped conductor 104 contributing to radiation can be induced to the conductor radiation section 117, which enables improvement of radiation efficiency. Note that the conductor radiation section 117 may be provided only on one end of the C-shaped conductor 104.

Figure 13:
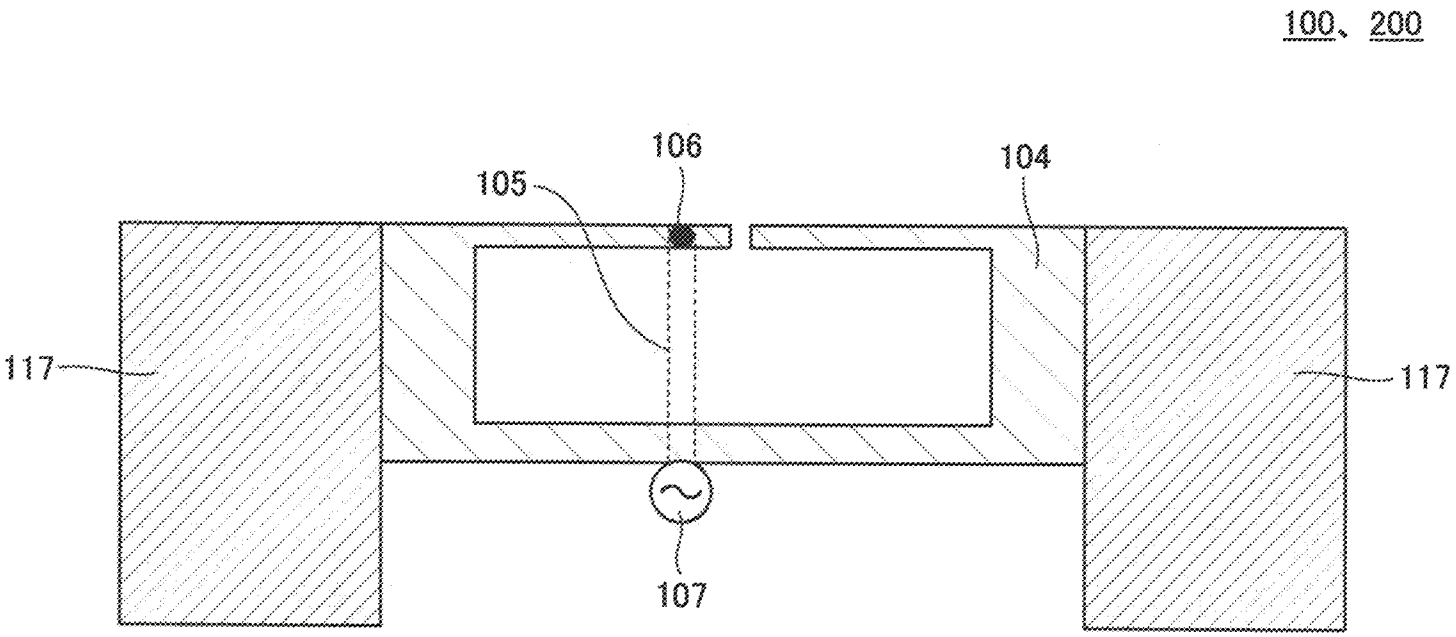
FIG. 13 is a front elevational view illustrating a modification example of the antenna according to the first example embodiment of the present invention.
Figure 14:
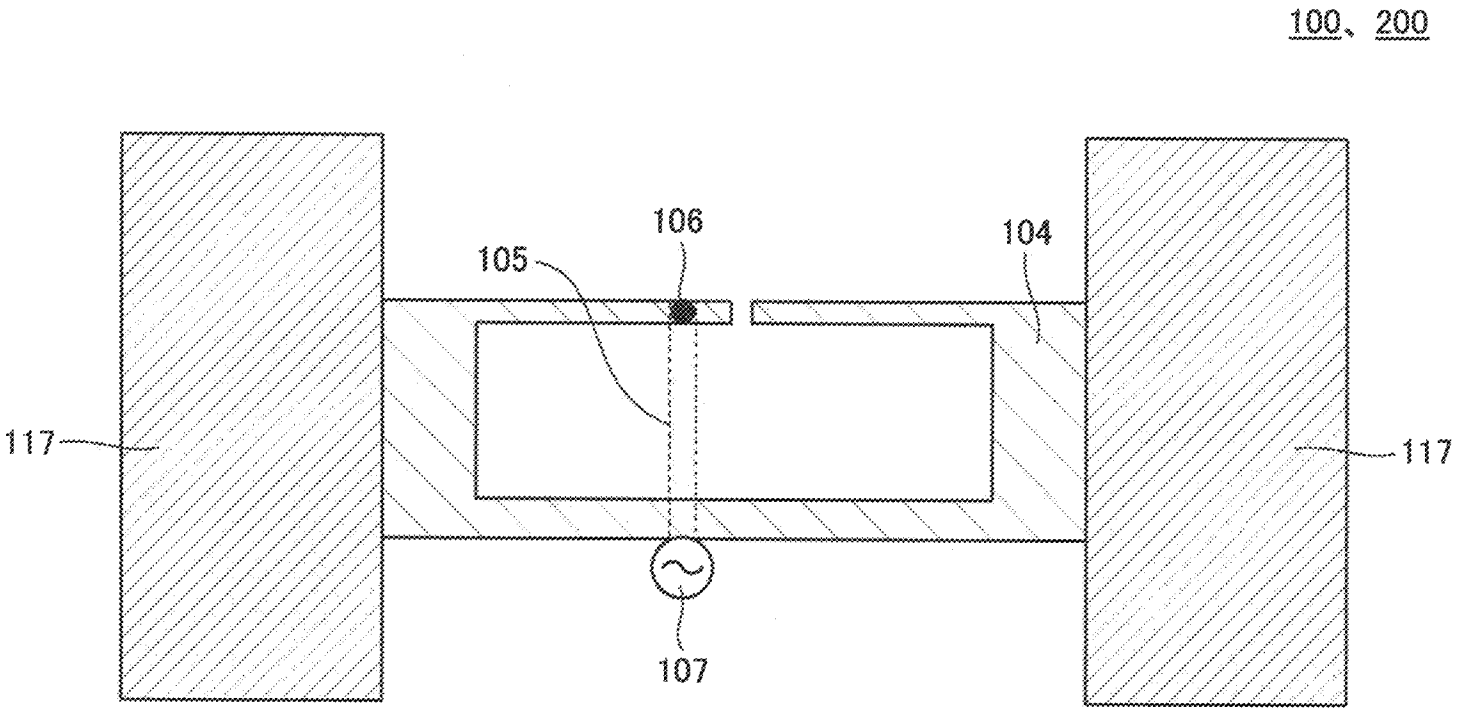
FIG. 14 is a front elevational view illustrating a modification example of the antenna according to the first example embodiment of the present invention.
Figure 15:
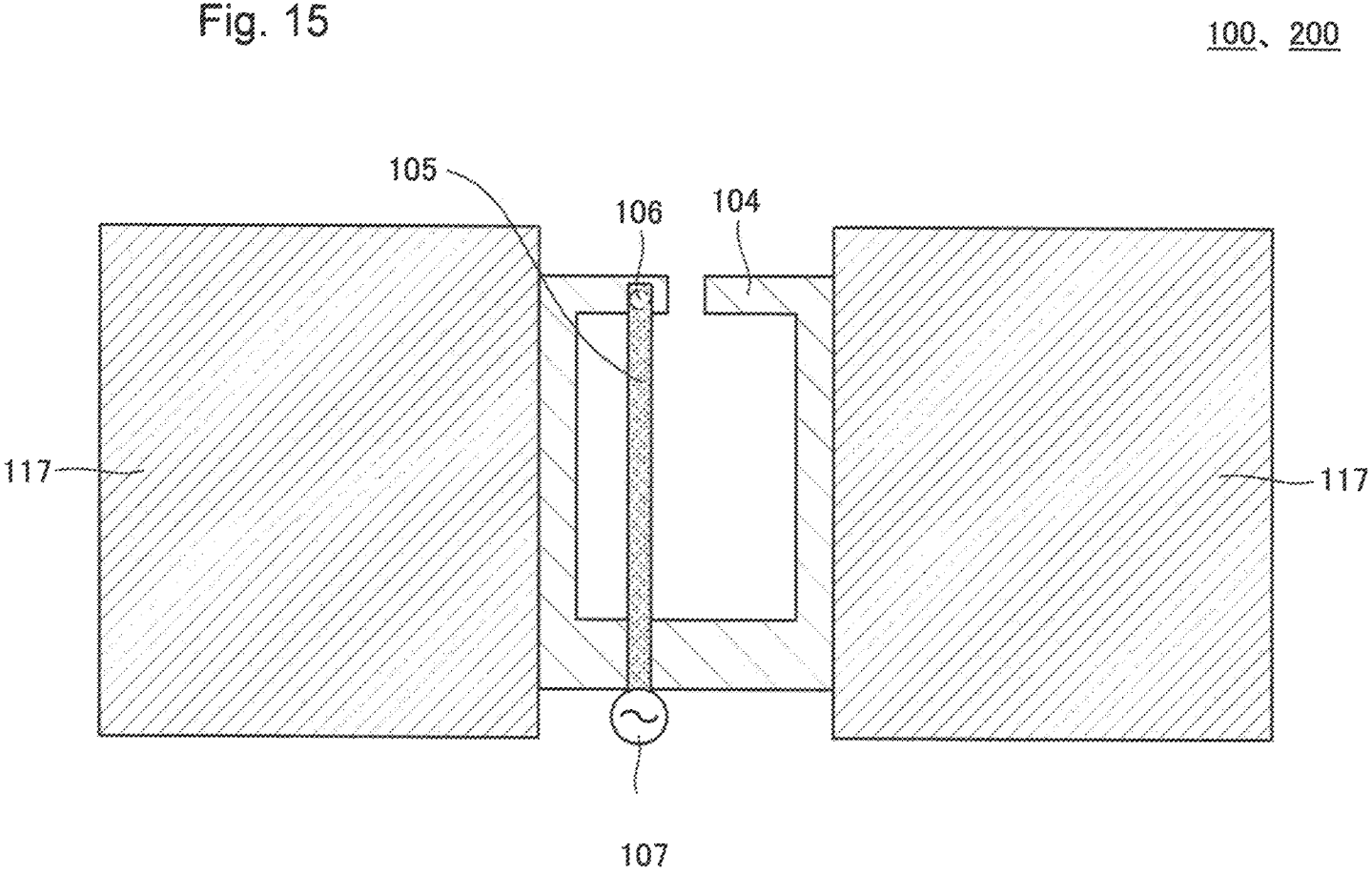
FIG. 15 is a front elevational view illustrating a modification example of the antenna according to the first example embodiment of the present invention.

A shape of the conductor radiation section 117 is not limited to a shape illustrated in FIG. 12, but may be modified in various ways. For example, FIG. 12 illustrates a shape of the conductor radiation section 117 having a side matching in size with a side of the C-shaped conductor 104 at a part where the conductor radiation section 117 and the C-shaped conductor 104 are coupled, but the conductor radiation section 117 is not limited to the shape. For example, respective sides of the conductor radiation section 117 and the C-shaped conductor 104 at a part where the conductor radiation section 117 and the C-shaped conductor 104 are coupled may not have the same size. For example, as illustrated in FIGS. 13 and 14, the conductor radiation section 117 may be configured to have a larger side than a side of the C-shaped conductor 104. In a case of a configuration including the conductor radiation section 117, more satisfactory radiation efficiency is achieved by extending a conductor part in a lengthwise direction of each of the antenna elements 100 and 200 by means of the C-shaped conductor 104 and the conductor radiation section 117. At this time, a lengthwise direction of the C-shaped conductor 104 may not match with a lengthwise direction of each of the antenna elements 100 and 200. For example, as illustrated in FIG. 15, a shape of the C-shaped conductor 104 may be a rectangle having a long side in a z-axis direction. In addition, without limitation to a rectangle, the conductor radiation section 117 may have a shape such as a square shape, a circular shape, and a triangle shape.

In addition, as described above, the resonance frequency of the split ring resonator can be lowered when the inductance is increased by elongating a current path by increasing a ring size of the split ring, or when the capacitance is increased by narrowing the space between the conductors facing each other at the split section 109.

Figure 16:
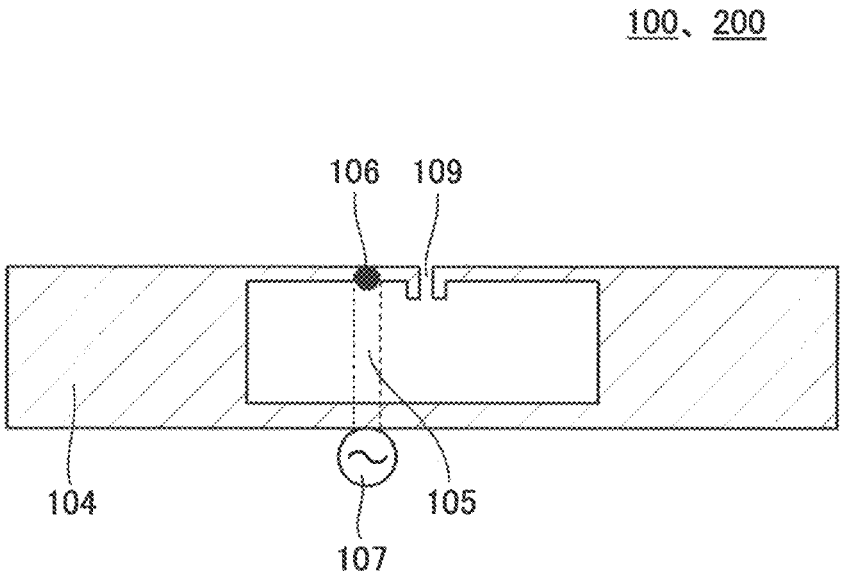
FIG. 16 is a front elevational view illustrating a modification example of the antenna according to the first example embodiment of the present invention.

At this time, as another method of increasing the capacitance, an area of the C-shaped conductor 104 facing at the split section 109 may be changed to be increased. In an example illustrated in FIG. 16, with regard to both end sections of the C-shaped conductor 104 facing each other across the split section 109, an area of the C-shaped conductor 104 facing at the split section 109 is increased by bending the both end sections into a direction substantially orthogonal to a facing direction.

Figure 17:
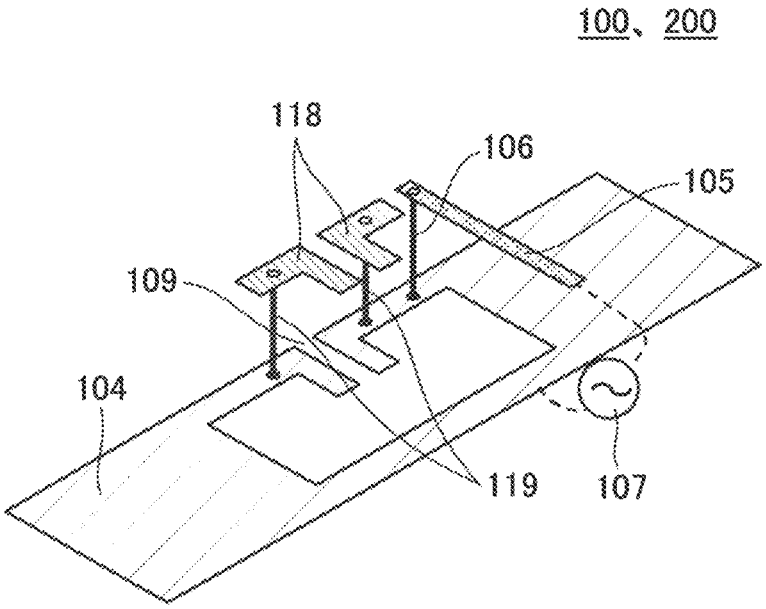
FIG. 17 is a perspective view illustrating a modification example of the antenna according to the first example embodiment of the present invention.
Figure 18:
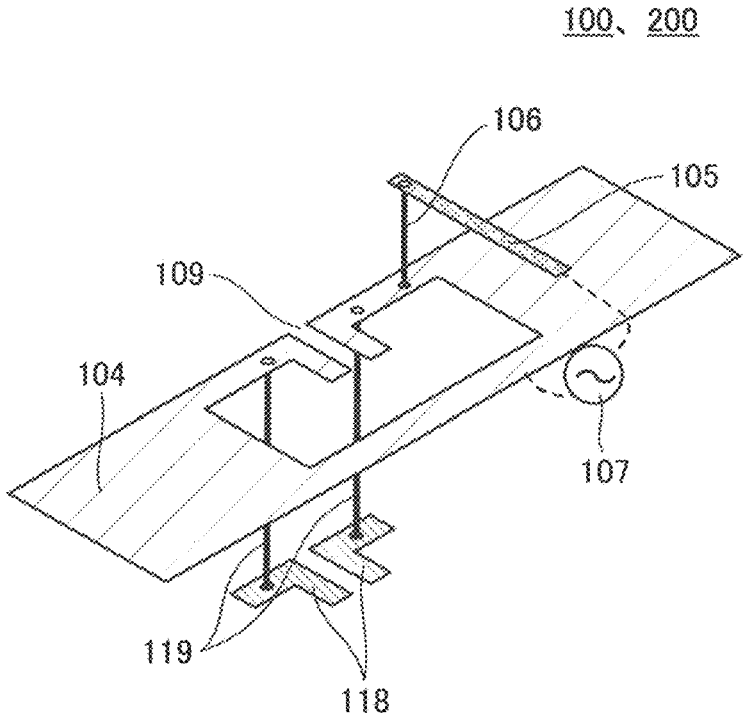
FIG. 18 is a perspective view illustrating a modification example of the antenna according to the first example embodiment of the present invention.

In addition, besides the above, as illustrated in FIG. 17 or 18, a conductor area facing at the split section 109 may be increased by providing an auxiliary conductor pattern on a different layer from a layer on which the C-shaped conductor 104 is present. In examples illustrated in FIGS. 17 and 18, two auxiliary conductor patterns 118 are provided on a different layer from a layer on which the C-shaped conductor 104 is present. Further, conductor vias 119 electrically connect between the respective auxiliary conductor patterns 118 and a vicinity of the respective end sections of the C-shaped conductor 104 facing each other across the split section 109. In the examples illustrated in FIGS. 17 and 18, more specifically, the two auxiliary conductor patterns 118 respectively have shapes that are bent similarly to the bent end sections of the C-shaped conductor 104 in such a way as to face the bent end sections. With such a configuration, a conductor area facing at the split section 109 in the split ring resonator may be increased.

Note that, in the example illustrated in FIG. 17, the two auxiliary conductor patterns 118 are arranged on the same layer as that of the conductor feed line 105. In addition, in the example illustrated in FIG. 18, the two auxiliary conductor patterns 118 are arranged on a different layer from those of both the C-shaped conductor 104 and the conductor feed line 105.

Figure 19:
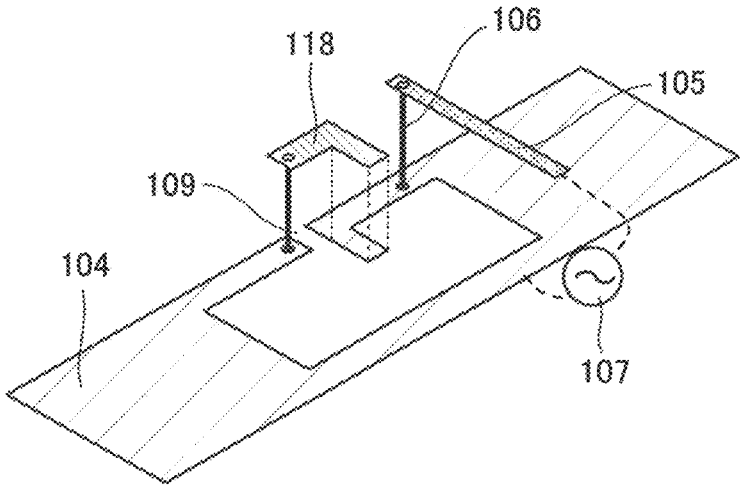
FIG. 19 is a perspective view illustrating a modification example of the antenna according to the first example embodiment of the present invention.

In addition, as illustrated in FIG. 19, each of the antenna elements 100 and 200 may include at least one auxiliary conductor pattern 118 that is electrically connected with one part out of the both parts of the C-shaped conductor 104 facing each other across the split section 109, and that faces another part. Note that, in the example illustrated in FIG. 19, the conductor via 119 electrically connects between the auxiliary conductor pattern 118 and the C-shaped conductor 104. In the examples illustrated in FIGS. 17 and 18, the auxiliary conductor patterns 118 are provided for both respective conductor parts facing each other across the split section 109, whereas, in the example illustrated in FIG. 19, the auxiliary conductor pattern 118 is provided only for one conductor part. Then, the auxiliary conductor pattern 118 and at least a part of another conductor part face each other between a layer of the C-shaped conductor 104 and a layer of the auxiliary conductor pattern 118, which increases a conductor area facing at the split section 109.

Note that, in the example illustrated in FIG. 17, the auxiliary conductor patterns 118 and the conductor feed line 105 are arranged on an identical layer, but may be arranged on different layers. In addition, in the examples illustrated in FIGS. 17 to 19, the both end sections of the C-shaped conductor 104 and the auxiliary conductor pattern 118 have bent shapes, but may have unbent shapes, or other shapes.

In addition, changing a connection position between the conductor via 106 (when the conductor via 106 is omitted, one end of the conductor feed line 105) and the C-shaped conductor 104 can vary an input impedance of the split ring resonator when viewed from the feed point 107. Then, matching the input impedance of the split ring resonator with an impedance of a not-illustrated radio communication circuit or transmission line ahead of the feed point 107 makes it possible to supply a radio communication signal to an antenna without reflection. However, even unmatched impedances do not affect an essential advantageous effect of the present invention.

Figure 20:
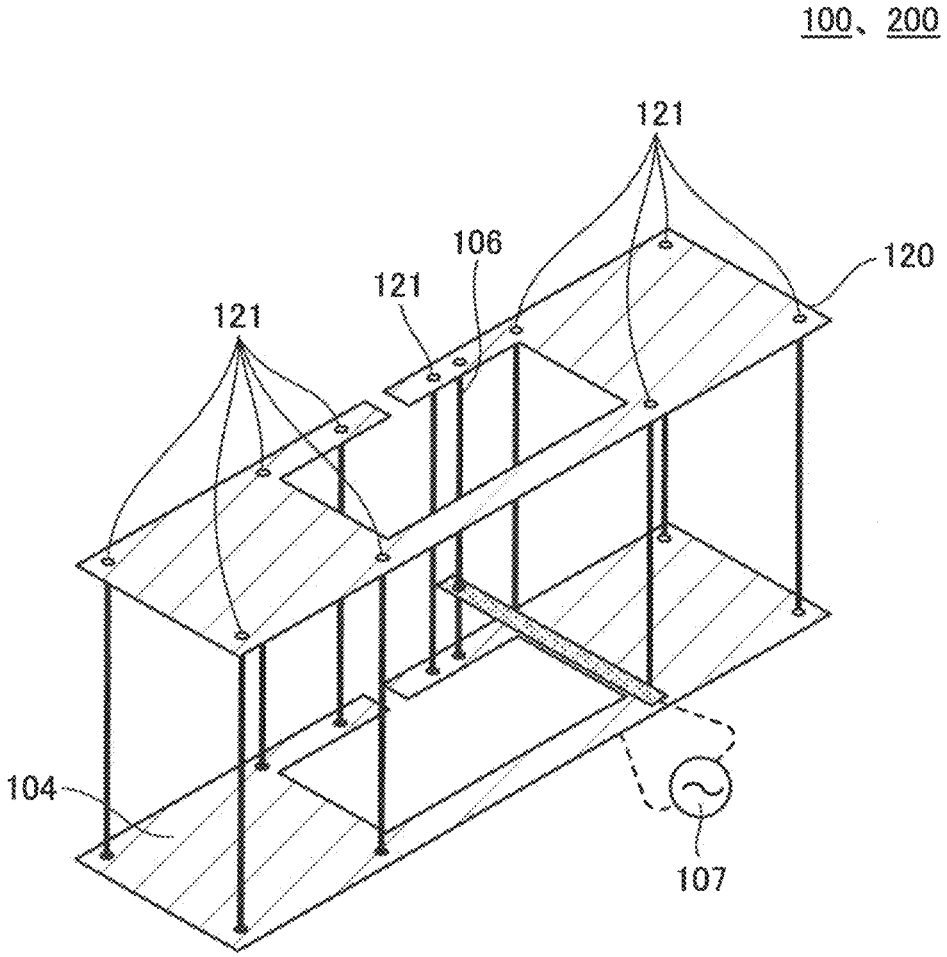
FIG. 20 is a perspective view illustrating a modification example of the antenna according to the first example embodiment of the present invention.

In addition, as illustrated in FIG. 20, each of the antenna elements 100 and 200 may be configured to include, in addition to the C-shaped conductor 104, a C-shaped conductor 120 having the same configuration as the C-shaped conductor 104 in an overlapping manner. Herein, in the example illustrated in FIG. 20, the C-shaped conductor 120 that is a second C-shaped conductor is provided on a different layer from those of both the C-shaped conductor 104 and the conductor feed line 105.

More specifically, a configuration is made in such a way that the layer of the C-shaped conductor 104 and the layer of the C-shaped conductor 120 sandwich the layer of the conductor feed line 105. Then, the C-shaped conductor 104 and the C-shaped conductor 120 are electrically connected with each other through a plurality of conductor vias 121. In this case, the C-shaped conductor 104 and the C-shaped conductor 120 operate as a single split ring resonator. At this time, most of a peripheral part of the conductor feed line 105 is surrounded by the plurality of conductor vias 121 and the C-shaped conductors 104 and 120 that are mutually conductive conductors. Accordingly, unnecessary radiation of a signal electromagnetic wave from the conductor feed line 105 can be reduced.

Figure 21:
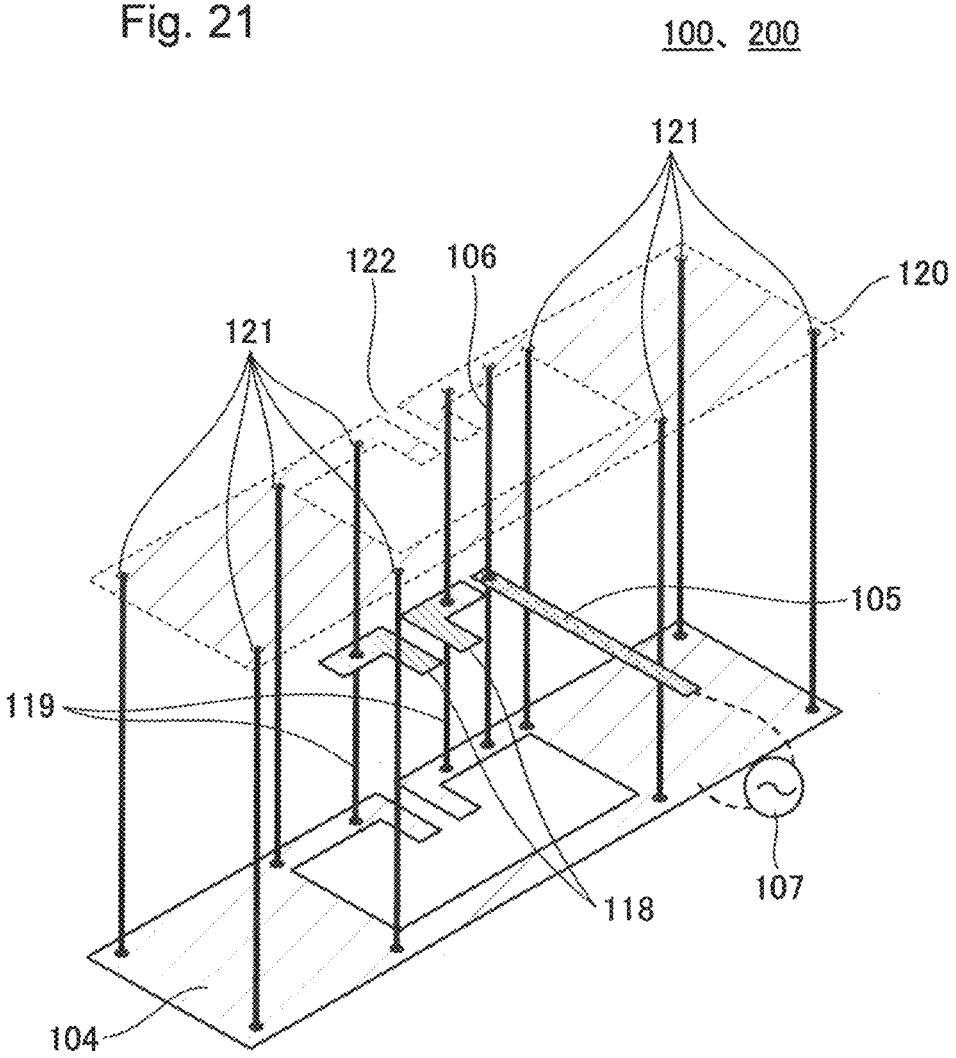
FIG. 21 is a perspective view illustrating a modification example of the antenna according to the first example embodiment of the present invention.

In addition, as illustrated in FIG. 21, the auxiliary conductor patterns 118 may be provided similarly to FIG. 17. Specifically, in the example illustrated in FIG. 21, the auxiliary conductor patterns 118 are provided on a different layer (a layer sandwiched between a layer of the C-shaped conductor 104 and a layer of the C-shaped conductor 120) from those of both the C-shaped conductor 104 and the C-shaped conductor 120. In addition, through the conductor vias 119, the auxiliary conductor patterns 118 are electrically connected with conductor parts around the split section 109 in the C-shaped conductor 104 and conductor parts around a split section 122 in the C-shaped conductor 120. With such a configuration, a conductor area facing at the split section 109 of the C-shaped conductor 104 and a conductor area facing at the split section 122 of the C-shaped conductor 120 are increased by the auxiliary conductor patterns 118. Thus, it becomes possible to increase the capacitance without increasing an overall size of the resonator.

Figure 22:
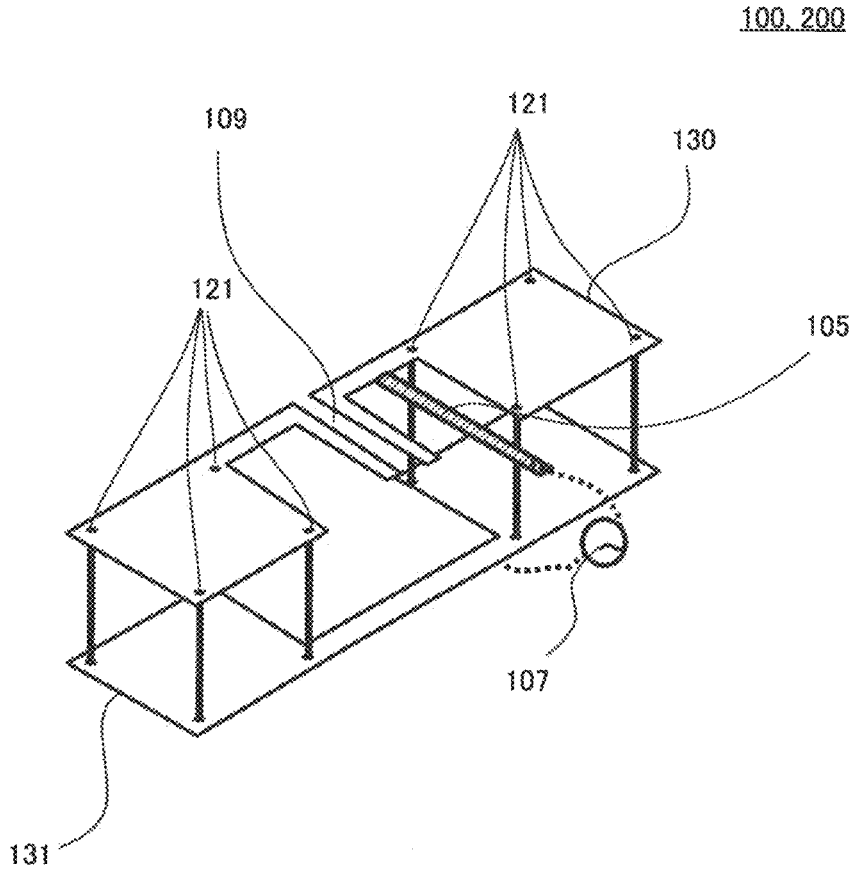
FIG. 22 is a perspective view illustrating a modification example of the antenna according to the first example embodiment of the present invention.

As another configuration, a configuration as illustrated in FIG. 22 may be employed.

In the configuration illustrated in FIG. 22, each of the antenna elements 100 and 200 includes conductor sections 130 and 131 connected through theplurality of conductor vias 121. Two layers of these conductor sections 130 and 131 form a single C-shaped conductor. In other words, the conductor section 130 has a configuration of the second C-shaped conductor 120 in FIG. 20 from which a long side section facing the split section 109 across an opening is removed. In addition, the conductor section 131 has a configuration of the C-shaped conductor 104 in FIG. 20 from which a long side section including the split section 109 is removed. With such a configuration, the bent conductor pattern ends facing each other across the split section 109 can be extended as in FIG. 22, and further, the capacitance at the split section 109 can be increased.

Figure 23:
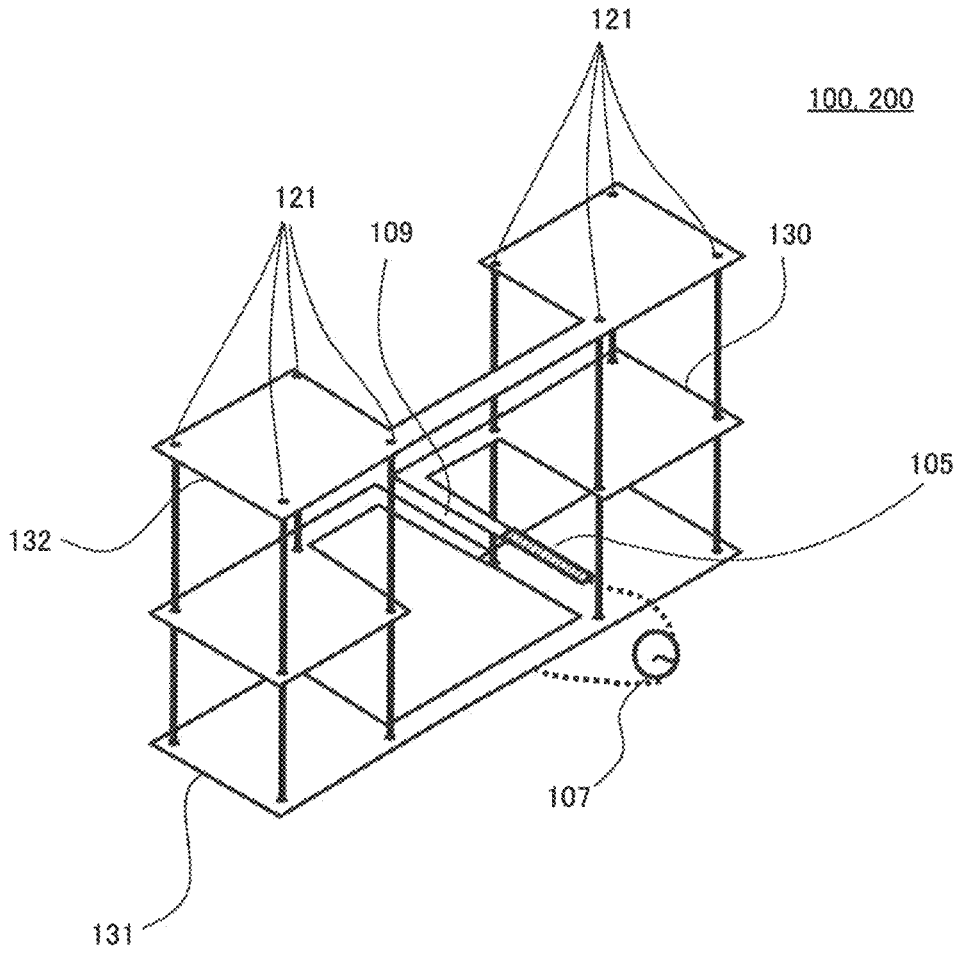
FIG. 23 is a perspective view illustrating a modification example of the antenna according to the first example embodiment of the present invention.

As another configuration, a configuration illustrated in FIG. 23 may be employed.

In the configuration illustrated in FIG. 23, each of the antenna elements 100 and 200 further includes, in addition to the configuration illustrated in FIG. 22, a conductor section 132 having the same shape as that of the conductor section 131. The conductor section 132 is provided on an opposite side from the conductor section 131 when viewed from the conductor section 130. The conductor section 132 is connected with the conductor section 130 through the plurality of conductor vias 121 in the same way as the conductor section 131.

With this configuration, the split section 109 can be formed on an inner layer of the dielectric layer 108. Thus, magnitude of the capacitance generated by the split section 109 can be made less affected by a substance outside the dielectric layer 108.

In the configuration illustrated in FIG. 23, the conductor feed line 105 is directly connected with an end section of one of the bent and extended conductor patterns facing each other across the split section 109.

Figure 24:
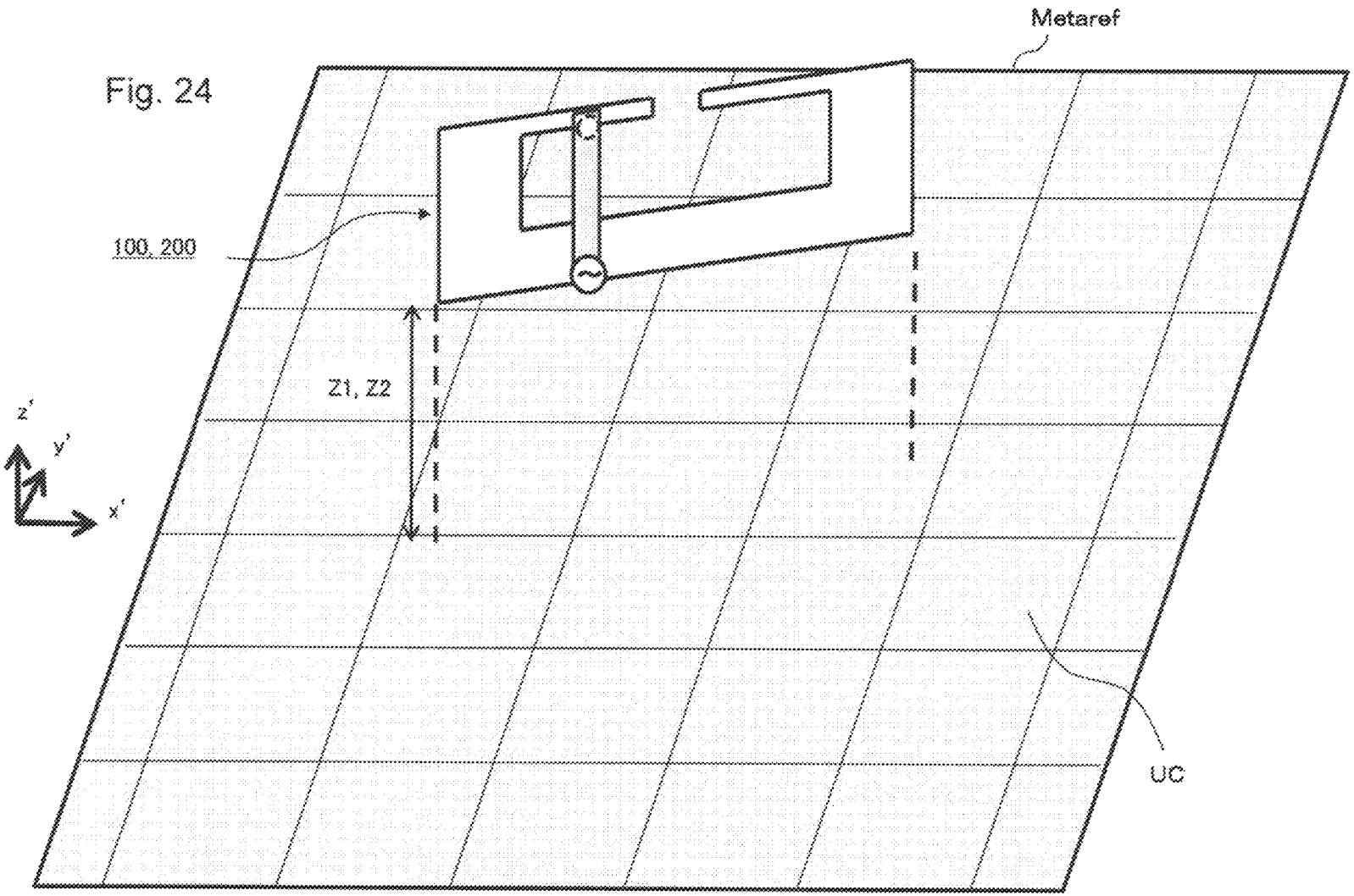
FIG. 24 is a perspective view illustrating a modification example of the antenna according to the first example embodiment of the present invention.

As another configuration, for example, as illustrated in FIG. 24, a metamaterial reflection plate Metaref may be used as the conductor reflection plate 101. Herein, a metamaterial reflection plate Metaref (also called as an artificial magnetic conductor, a high impedance surface, and the like) indicates a reflection plate in which periodic structures UC composed of conductor pieces or dielectric pieces formed into a predetermined shape are periodically aligned in a longitudinal direction (Y'-axis direction) and a lateral direction (X'-axis direction), as illustrated in FIG. 24, for example. With such a configuration, phase rotation caused by reflection of an electromagnetic wave reflecting on the metamaterial reflection plate Metaref can take a value that is different from a reflection phase of 180° for normal metal plates. Controlling a reflection phase at an operating frequency of each of the antenna elements 100 and 200 by use of this metamaterial reflection plate Metaref can suppress a change in a resonance characteristic of each of the antenna elements 100 and 200, even when the distances Z1 and Z2 are shorter than ¼ of λ1 and ¼ of λ2, respectively. Note that the metamaterial reflection plate can be used in both of the cases when a C-shaped conductor is a single layer and when a plurality of C-shaped conductors are layered.

(Second Example Embodiment)

Figure 25:
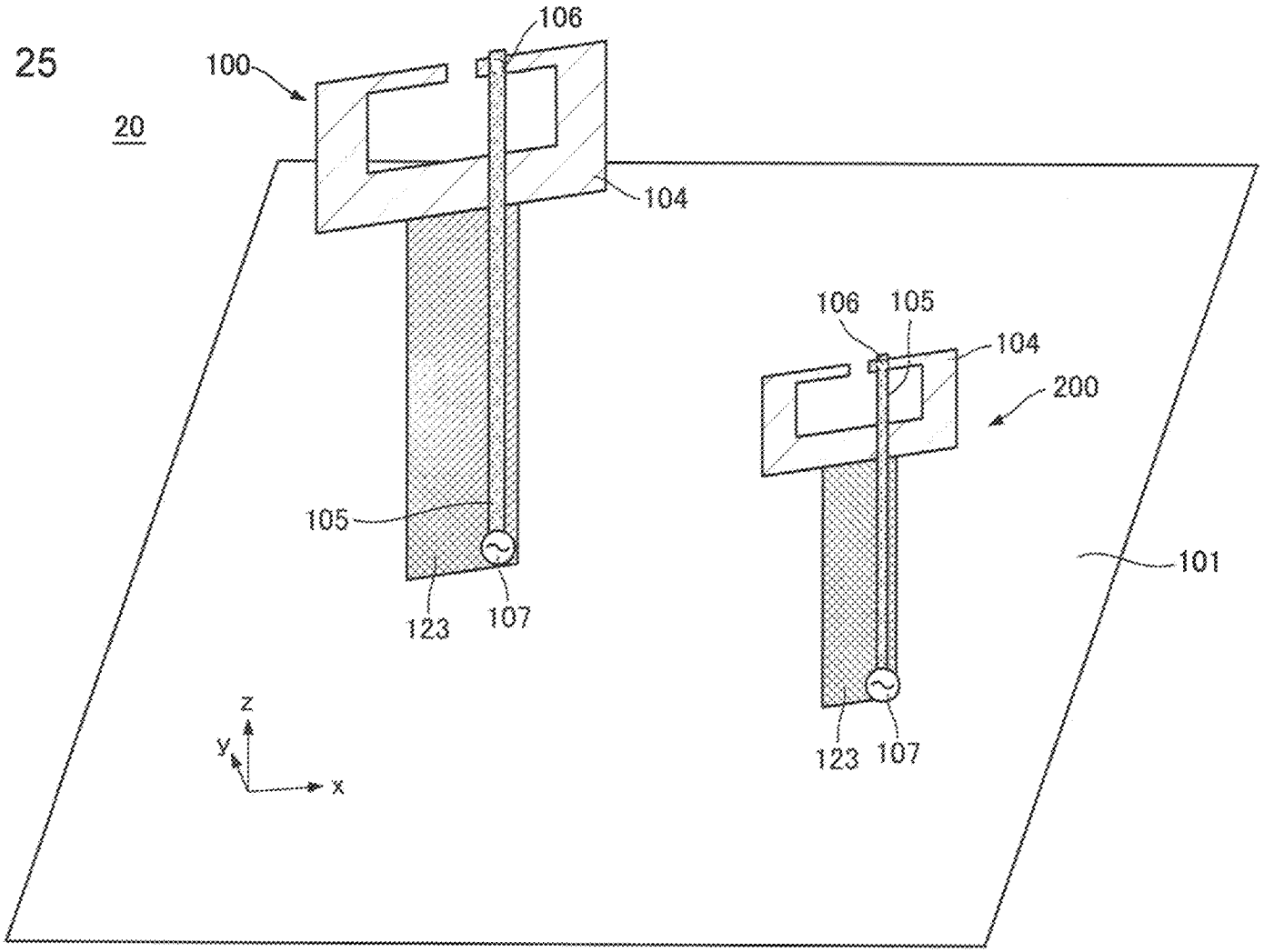
FIG. 25 is a perspective view of an antenna according to a second example embodiment of the present invention.
Figure 26:
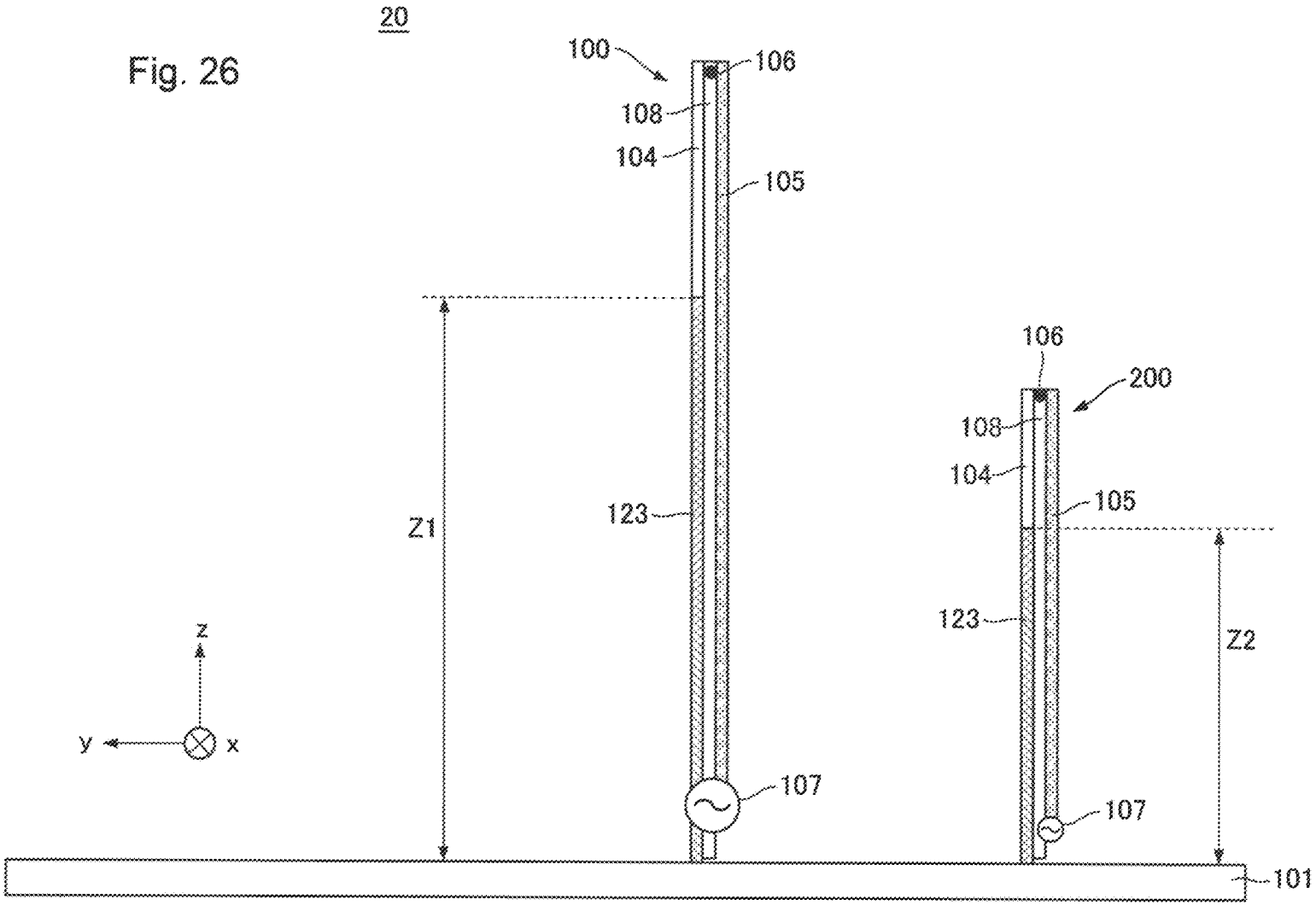
FIG. 26 is a side view of the antenna according to the second example embodiment of the present invention.

Next, an antenna 20 according to a second example embodiment of the present invention will be described below. Note that, in the following description, the same components as the above-described components are assigned with the same reference numerals, and description therefor will be omitted as appropriate. FIG. 25 is a perspective view of the antenna 20, and FIG. 26 is a side view of the antenna 20. Note that, regarding a dielectric layer 108, illustration of the dielectric layer 108 of each of antenna elements 100 and 200 is omitted in FIG. 25, for ease of understanding arrangement of other configurations.

The antenna 20 is different from the antenna 10 according to the first example embodiment in further including a conductor feed section 123. The conductor feed section 123 has one end coupled to an outer edge portion of a C-shaped conductor 104, and another end coupled to a conductor reflection plate 101. In the antenna 20, the conductor feed sections 123 are provided for the respective antenna elements 100 and 200 constituting the antenna 20. The conductor feed section 123 is a conductor that constitutes an electric circuit for feeding power to the C-shaped conductor 104. The conductor feed section 123 has one end coupled to the outer edge portion in a vicinity of a position facing a split section 109, of the C-shaped conductor 104, and another end coupled to the conductor reflection plate 101. More specifically, the conductor feed section 123 is coupled to the outer edge portion of the C-shaped conductor 104 at a central section (a central part of the C-shaped conductor 104 in an x-axis direction) or in a vicinity thereof. In this way, the C-shaped conductor 104 and the conductor feed section 123 are coupled to each other at a position within a predetermined range from the central section of the C-shaped conductor 104. As illustrated in FIG. 26, the conductor feed section 123 has a length of Z1 in the antenna element 100, and Z2 in the antenna element 200, which is shorter than Z1.

In addition, in the antenna 20, a conductor feed line 105 is extended toward the conductor reflection plate 101. In addition, in the antenna 20, the dielectric layer 108 is also extended toward the conductor reflection plate 101. Then, the conductor feed section 123 is arranged along with the extended conductor feed line 105. More specifically, the conductor feed section 123 is arranged along with the conductor feed line 105 in a manner of facing each other. In this way, in the second example embodiment, the antenna element 100 is secured to the conductor reflection plate 101 by means of the conductor feed section 123.

In addition, a feed point 107 in the antenna 20 is arranged in a vicinity of one end part on an extended side (in other words, on a side of the conductor reflection plate 101) of the conductor feed line 105. Then, the feed point 107 is capable of electrically exciting between the one end part on the extended side of the conductor feed line 105 and the conductor feed section 123 in a vicinity of a position where the feed point 107 is arranged. Note that, on a rear side of the conductor reflection plate 101, in other words, on an opposite side from a side where the antenna 20 is present, a not-illustrated power source including, for example, an oscillator, an amplifier, and the like may be configured. In this case, the feed point 107 is supplied with power from the power source on the rear side of the conductor reflection plate 101.

The antenna 20 is different from the antenna 10 according to the first example embodiment in the point described above. However, other configurations are the same as those in the antenna 10. Note that the conductor feed section 123 is coupled to the conductor reflection plate 101 in the examples illustrated in FIGS. 25 and 26, but may not necessarily be coupled thereto.

An advantageous effect of the antenna 20 according to the second example embodiment will be described below.

When a transmission line transmitting a radio signal via a feed point is connected with an antenna element, a conductor is coupled to a resonator. Thus, there is a possibility that a resonance characteristic of the antenna element may change depending on arrangement, a shape, or the like of the transmission line in a vicinity of the antenna element.

In the antenna 20 according to the present example embodiment, a part where the conductor feed section 123 is coupled to the antenna element 100 or 200 is positioned at a substantial central section of the antenna element 100 or 200. Herein, when being electromagnetically resonated, each of the antenna elements 100 and 200 has electrically open faces in vicinities of both end sections in a lengthwise direction (x-axis direction in FIGS. 1 and 2), the electrically open faces having strong electric field intensity and weak magnetic field intensity. Then, each of the antenna elements 100 and 200 has an electrically short-circuiting face in a vicinity of a substantial central section in a lengthwise direction, the electrically short-circuiting face having strong magnetic field intensity and weak electric field intensity. Hence, the position where the conductor feed section 123 is coupled to the antenna element 100 or 200 is a part that becomes an electrically short-circuiting face when being resonated and has weak electric field intensity. Thus, when the conductor feed section 123 is coupled in a way as described above, the conductor feed section 123 does not increase a surplus capacitance or inductance that may affect a resonance characteristic. As a result, a resonance characteristic of the antenna elements 100 and 200 hardly changes. The inventors have found the above described fact.

In the present example embodiment, the extended conductor feed line 105 and the conductor feed section 123 arranged along with the conductor feed line 105 form a transmission line coupled to an antenna element. Then, the transmission line can reduce influence on a resonance characteristic. In addition, by providing the feed point 107 on the transmission line on a far side from each of the antenna elements 100 and 200, a distance between the antenna element 100 and the transmission line continuing ahead of the feed point 107 can be long. As a result, the antenna elements 100 and 200 can be made less affected by the transmission line.

As described above, the conductor feed section 123 is preferably coupled to an outer edge portion of the antenna element 100 or 200, corresponding to a substantial central section of the antenna element 100 or 200, which is an electrically short-circuiting face when being resonated. In more detail, a face that includes a central section of the antenna element 100 or 200 and is perpendicular to a lengthwise direction (x-axis direction in FIGS. 1 and 2) of the antenna element 100 or 200 becomes an electrically short-circuiting face when being resonated. In other words, for example, in FIGS. 25 and 26, a y-z plane including a central section of the antenna element 100 or 200 is an electrically short-circuiting face when being resonated.

Then, a face that includes a range not greater than ¼ of a lengthwise size (a size including a conductor radiation section 117 when included as a modification example) of the antenna element 100 or 200 in a lengthwise direction (x-axis direction in the figures) of the antenna element 100 or 200 from the electrically short-circuiting face can be regarded as an approximate short-circuiting face.

Thus, the conductor feed section 123 is preferably positioned within this range, in other words, within a range of ½ of a lengthwise size (a size including a conductor radiation section 117 when included as a modification example) of the antenna element 100 or 200, at around a central of the antenna element 100. Thus, the conductor feed section 123 when viewed in a lengthwise direction of the antenna element 100 or 200 preferably has a size of ½ or less of the lengthwise size of the antenna element 100 or 200.

However, even the conductor feed section 123 positioned in a range other than the above does not affect an essential advantageous effect of the present invention. In addition, even the conductor feed section 123 having a size other than the above when viewed in a lengthwise direction of the antenna element 100 or 200 does not affect an essential advantageous effect of the present invention.

As described above, a multiband antenna having reduced influence of a transmission line on a resonance characteristic of an antenna element in addition to the advantageous effect of the first example embodiment can be provided. In addition, when a wireless communications device is configured by using the antenna 20 similarly to the first example embodiment, a wireless communications device having reduced influence of a transmission line on a resonance characteristic of an antenna element can be provided.

All of the modification examples of the antenna elements 100 and 200 described in the first example embodiment are applied to the antenna elements 100 and 200 according to the present example embodiment as appropriate.

Note that, when the antenna elements 100 and 200 are arranged in a parallel attitude with respect to the conductor reflection plate 101 as in FIG. 5, the antenna 20 may be configured as follows. The antenna elements 100 and 200 and the conductor reflection plate 101 are configured respectively on different layers within an identical substrate. In addition, with regard to the conductor feed sections 123, conductor vias in the substrate are respectively extended to connect to the conductor reflection plate 101, and also with regard to the conductor feed lines 105, other conductor vias in the substrate are respectively extended to connect to the conductor reflection plate. In this way, the overall antenna 20 may be created as an integrated substrate.

In addition, when the antenna elements 100 and 200 are configured within an identical substrate as in FIG. 6, the conductor feed sections 123 may also be configured within the same substrate similarly.

Further, various modification examples of the second example embodiment will be described below. Note that the various modification examples described below may be combined as appropriate.

Figure 27:
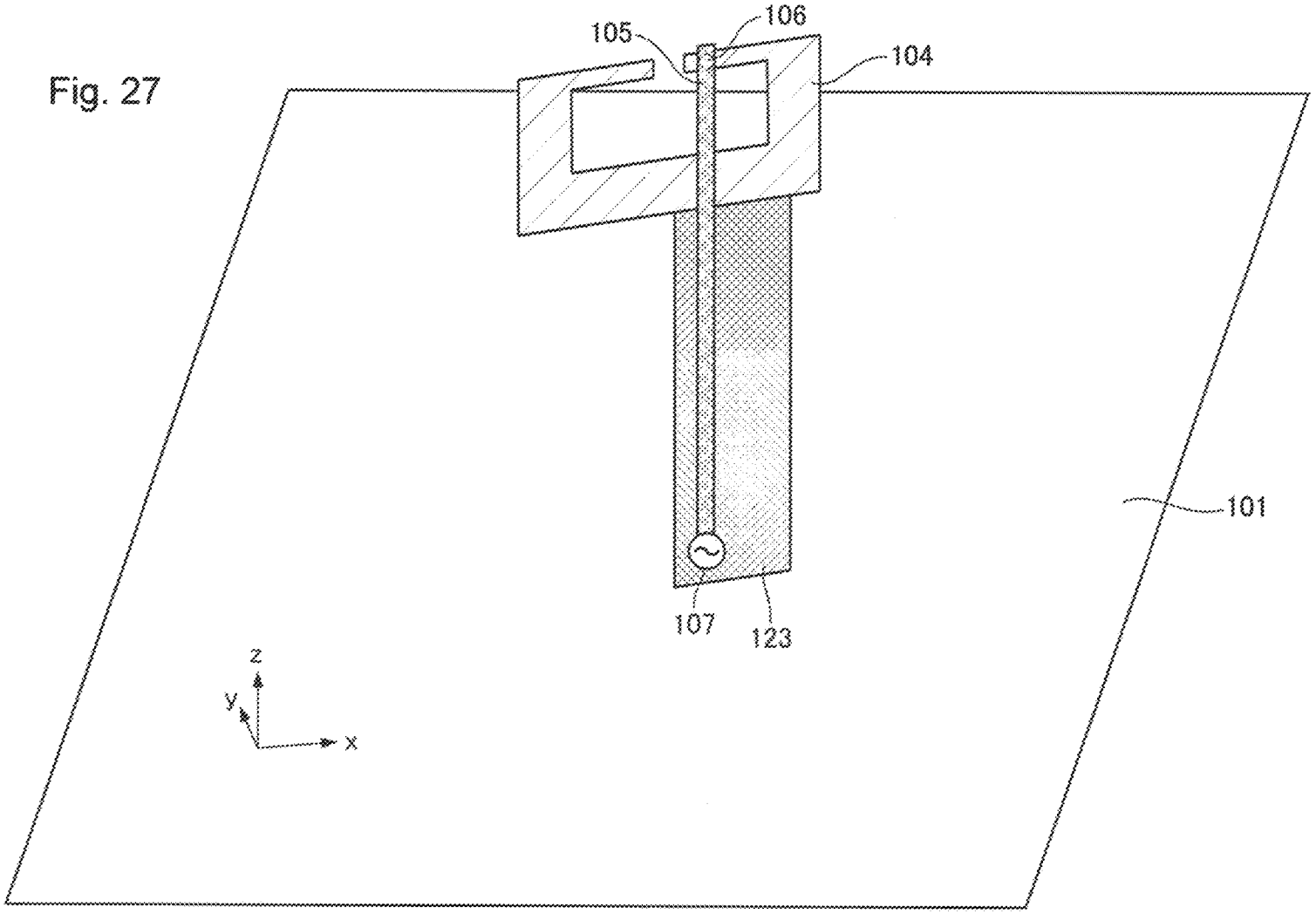
FIG. 27 is a perspective view illustrating a modification example of the antenna according to the second example embodiment of the present invention.
Figure 28:
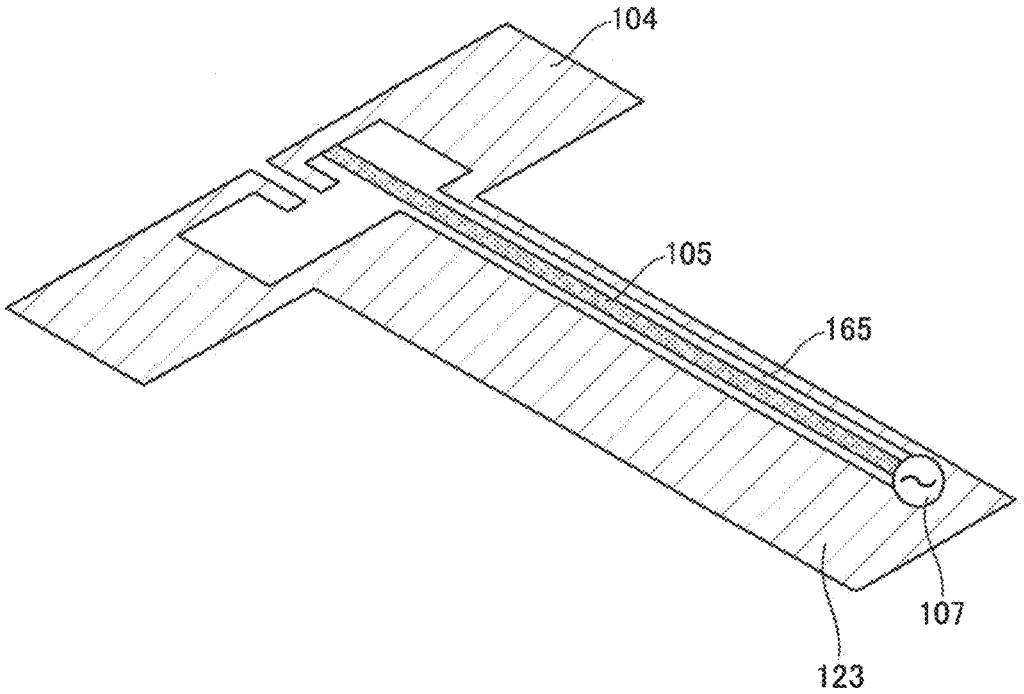
FIG. 28 is a perspective view illustrating a modification example of the antenna according to the second example embodiment of the present invention.

In the above-described example embodiment, the conductor feed section 123 has one end coupled to the C-shaped conductor 104 in a vicinity of an end section facing the split section 109. However, the coupling part may be changed as appropriate within an allowable range of influence imparted by the conductor feed section 123 on a resonance characteristic of each of the antenna elements 100 and 200. For example, as illustrated in FIG. 27, the conductor feed section 123 may be coupled to the C-shaped conductor 104, reaching a part of the C-shaped conductor 104 other than the vicinity of the end section facing the split section 109. In addition, as described in the first example embodiment, the antenna element 200 may be positioned immediately below the antenna element 100 in a z-axis direction, and at this time, the conductor feed section 123 belonging to the antenna element 100 may be structured to deform in a way to avoid the antenna element 200.

In addition, in FIGS. 25 and 26, the conductor feed sections 123 of the respective antenna elements 100 and 200 are separated, but the conductor feed sections 123 may be coupled to each other within an allowable range of influence imparted by the antenna elements 100 and 200 on a resonance characteristic. Note that illustration of the dielectric layer 108 is omitted in FIG. 27, for ease of understanding arrangement of other configurations. In addition, illustration of the dielectric layer 108 is also omitted similarly in FIGS. 28 to 31 to be described later.

In addition, as described in the description relating to the first example embodiment, an input impedance to an antenna when viewed from the feed point 107 is dependent on a connecting position between the conductor via 106 (one end of the conductor feed line 105 when the conductor via 106 is omitted) and the C-shaped conductor 104. However, in the antenna 20 according to the present example embodiment, the input impedance to the antenna is also dependent on a characteristic impedance of the transmission line constituted of the extended conductor feed line 105 and the conductor feed section 123. Then, matching the characteristic impedance of the above-described transmission line with the input impedance of the split ring resonator makes it possible to supply a radio communication signal to an antenna without reflection between the above-described transmission line and the split ring resonator. However, even unmatched impedances do not affect an essential advantageous effect of the present invention.

In addition, the transmission line constituted of the extended conductor feed line 105 and the conductor feed section 123 may be a coplanar line. In an example illustrated in FIG. 28, the C-shaped conductor 104, the conductor feed line 105, and the conductor feed section 123 are formed on an identical layer. In addition, as in FIG. 10 or 11 referred to in the description of the first example embodiment, in the antenna element 100, a portion on a long side of the C-shaped conductor 104 on a close side (a side facing the split section 109) to the conductor reflection plate 101 is cut out. Then, the conductor feed line 105 extends toward the conductor reflection plate 101 by passing through the cut-out part. In addition, the conductor feed section 123 is coupled to the C-shaped conductor 104 on both sides of the cut-out part. Further, the conductor feed section 123 has a slit section 165 formed at a position corresponding to the cut-out part in order to arrange the extended conductor feed line 105, the slit section 165 having an elongated U-shape. By the conductor feed line 105 extending in a direction of the conductor reflection plate 101 and passing through inside the slit section 165, the transmission line constituted of the above-described conductor feed line 105 and the conductor feed section 123 can be made to be a coplanar line.

Figure 29:
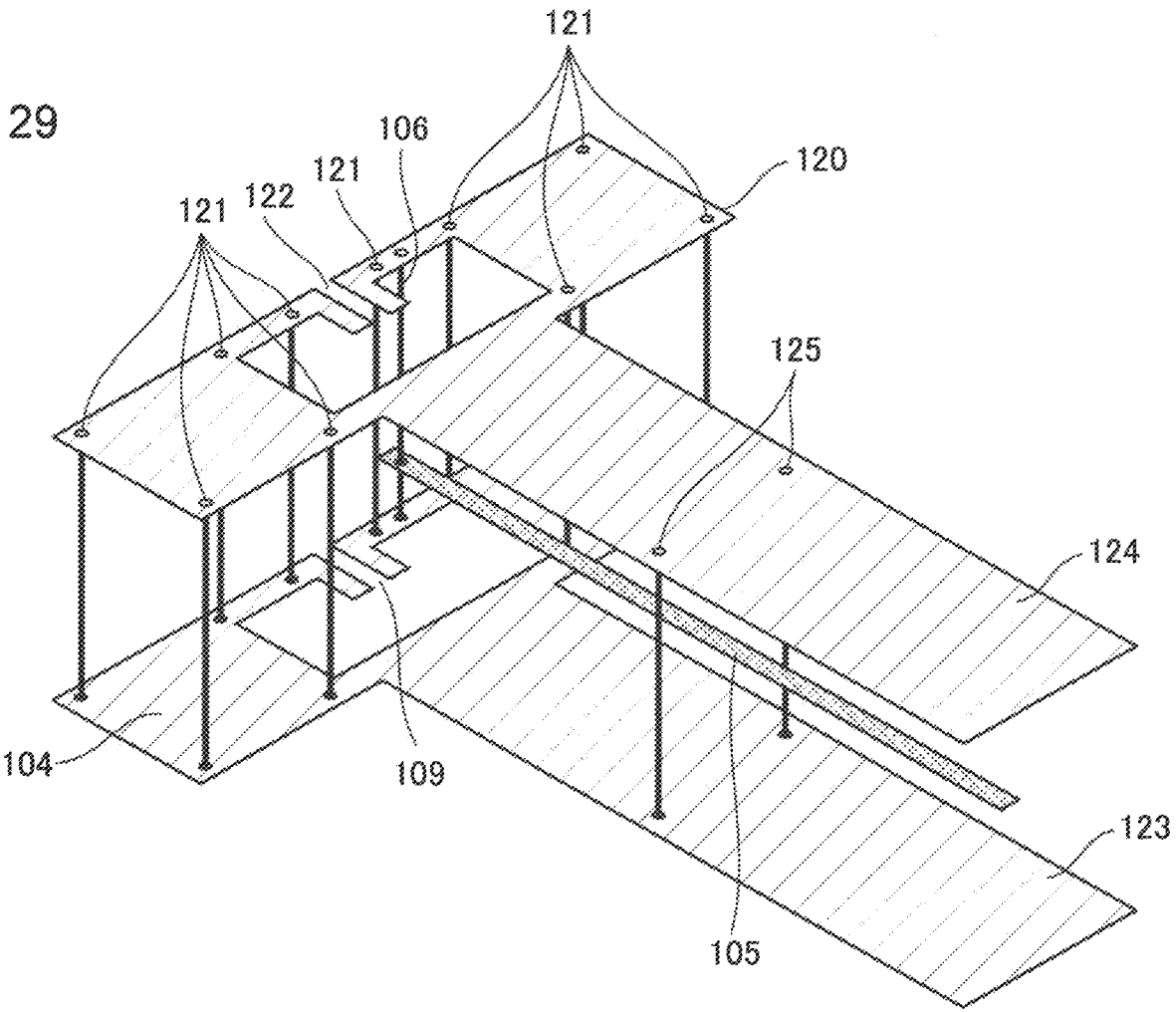
FIG. 29 is a perspective view illustrating a modification example of the antenna according to the second example embodiment of the present invention.

Further, as illustrated in FIG. 29, the antenna 20 may be configured to include, in addition to the C-shaped conductor 104, a C-shaped conductor 120 having the same configuration as the C-shaped conductor 104 in an overlapping manner, as in FIG. 20 or 21 referred to in the description of the first example embodiment. In an example illustrated in FIG. 29, the C-shaped conductor 120 that is a second C-shaped conductor is provided on a different layer from those of both the C-shaped conductor 104 and the conductor feed line 105. In addition, in the same way in which the conductor feed section 123 is coupled to the C-shaped conductor 104, a conductor feed section 124 on the same layer as that of the C-shaped conductor 120 is coupled to the C-shaped conductor 120. In addition, the antenna 20 is configured in such a way that the layer of the C-shaped conductor 104 and the conductor feed section 123, and the layer of the C-shaped conductor 120 and the conductor feed section 124 sandwich the layer of the conductor feed line 105. The conductor feed line 105 faces the conductor feed section 123 and the conductor feed section 124.

Then, the C-shaped conductor 104 and the C-shaped conductor 120 are electrically connected with each other through a plurality of conductor vias 121. In addition, the conductor feed section 123 and the conductor feed section 124 are electrically connected with each other through a plurality of conductor vias 125.

At this time, most of a peripheral part of the conductor feed line 105 is surrounded by the C-shaped conductor 104 and the C-shaped conductor 120 that are mutually conductive conductors, the plurality of conductor vias 121, the conductor feed section 123 and the conductor feed section 124, and the plurality of conductor vias 125. Accordingly, unnecessary radiation of a signal electromagnetic wave from the conductor feed line 105 can be reduced.

Figure 30:
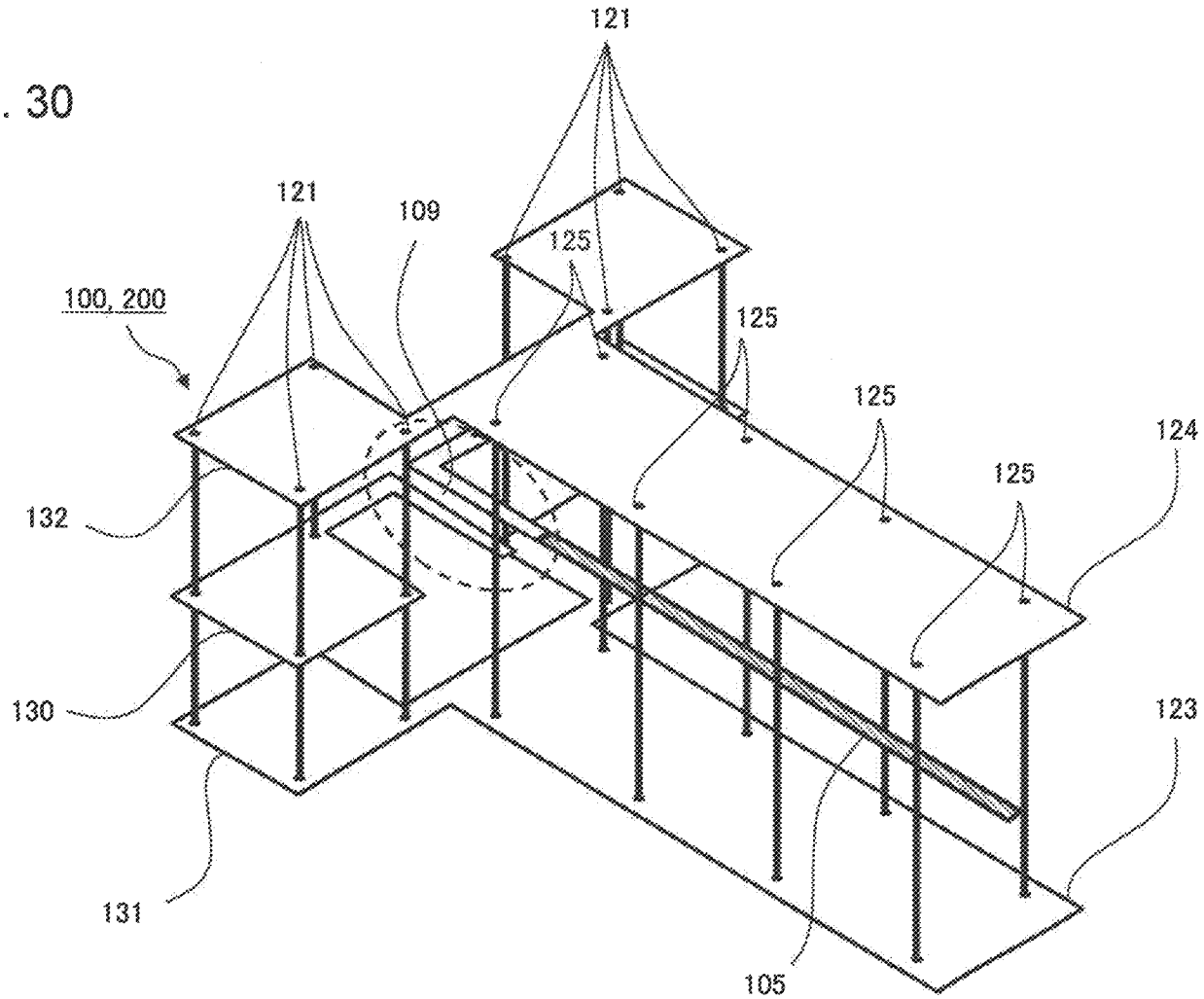
FIG. 30 is a perspective view illustrating a modification example of the antenna according to the second example embodiment of the present invention.

As another configuration, as illustrated in FIG. 30, the conductor feed sections 123 and 124, and the conductor vias 125 may be further added to the configuration in FIG. 23 described in the first example embodiment. With this configuration, the split section 109 can be formed on an inner layer of the dielectric layer 108, similarly to the configuration in FIG. 23. Thus, magnitude of the capacitance generated by the split section 109 can be made less affected by a substance outside the dielectric layer 108. In addition, the bent conductor pattern ends facing each other across the split section 109 can be extended, and further, the capacitance at the split section 109 can be increased.

Figure 31:
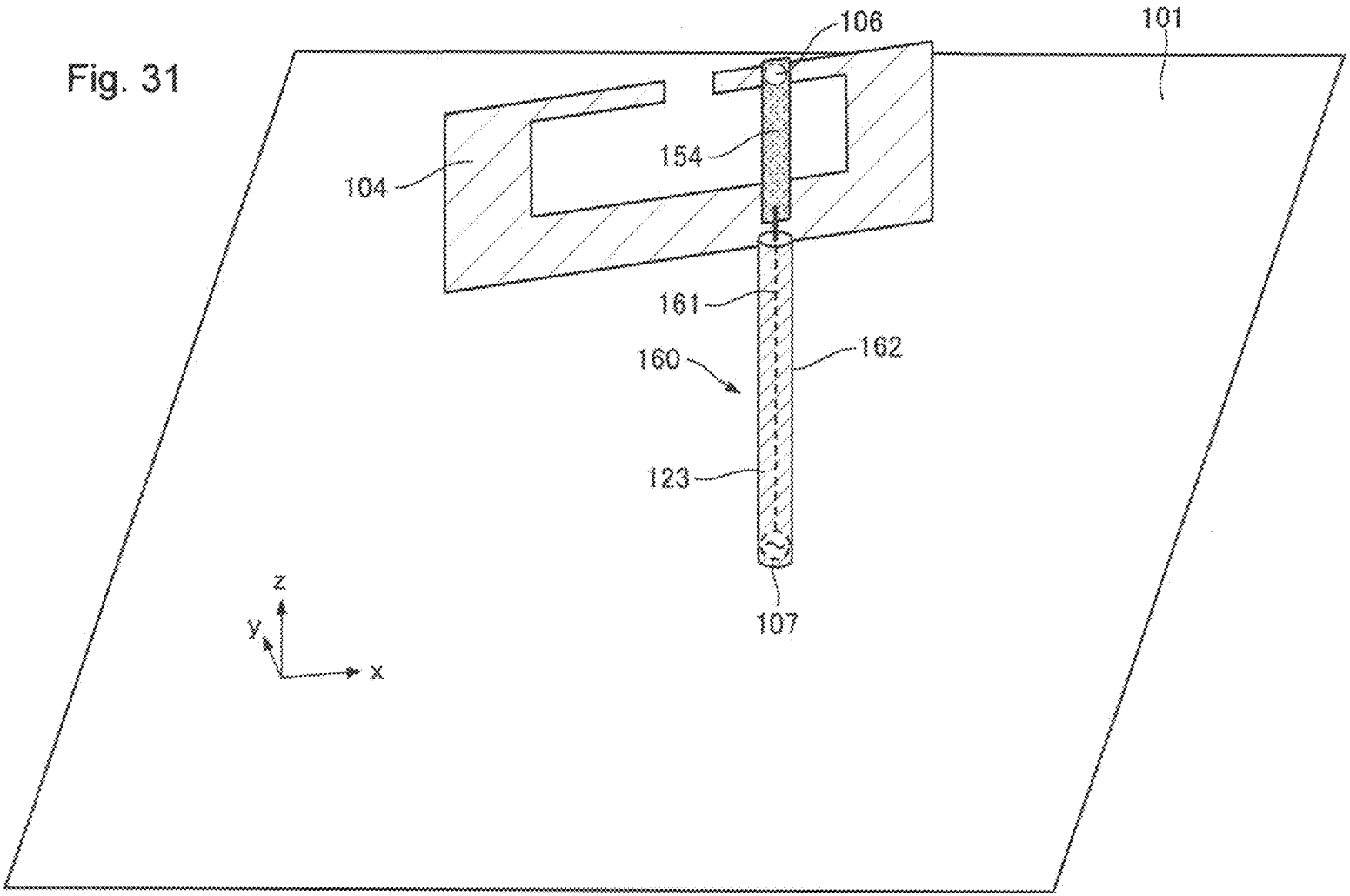
FIG. 31 is a perspective view illustrating a modification example of the antenna according to the second example embodiment of the present invention.

In addition, the transmission line constituted of the above-described extended conductor feed line 105 and the conductor feed section 123 may be a coaxial line. FIG. 31 is a diagram illustrating an example of the antenna 20 when the transmission line is a coaxial line. Note that illustration of the dielectric layer 108 is omitted in FIG. 31, for understanding other configurations. In the example illustrated in FIG. 31, the antenna element 100 includes a conductor feed line 154 that is the same as in the first example embodiment. In addition, a coaxial cable 160 is coupled to the antenna element 100. The coaxial cable 160 is constituted of a core wire 161 and an outer conductor 162. Herein, the core wire 161 is connected with the conductor feed line 154, and the outer conductor 162 is connected with a lower end of the C-shaped conductor 104. In addition, the feed point 107 is provided so as to electrically excite between the core wire 161 and the outer conductor 162. Herein, the core wire 161 and the conductor feed line 154 are equivalent to the conductor feed line 105, and the outer conductor 162 is equivalent to the conductor feed section 123.

Figure 32:
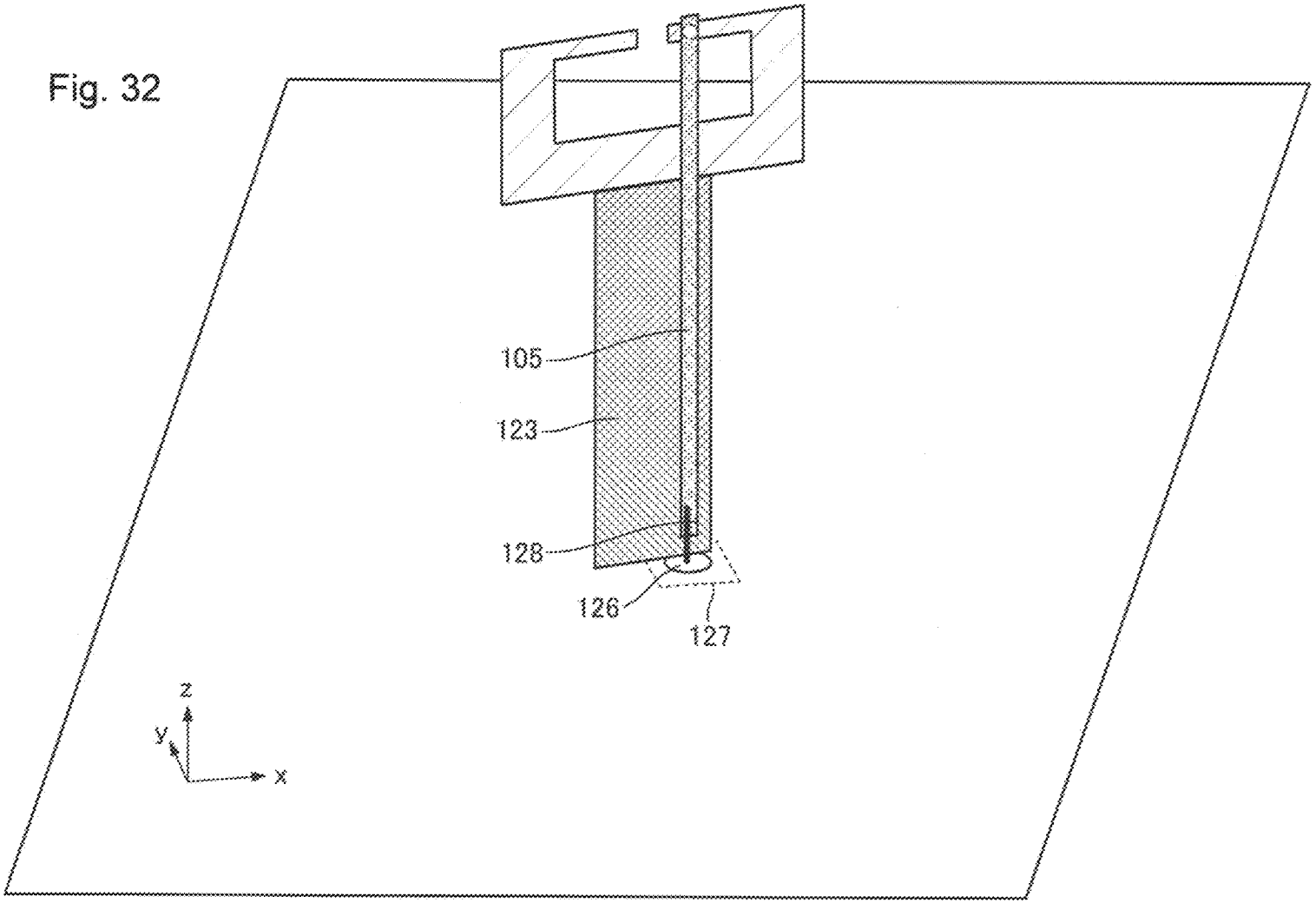
FIG. 32 is a perspective view illustrating a modification example of the antenna according to the second example embodiment of the present invention.
Figure 33:
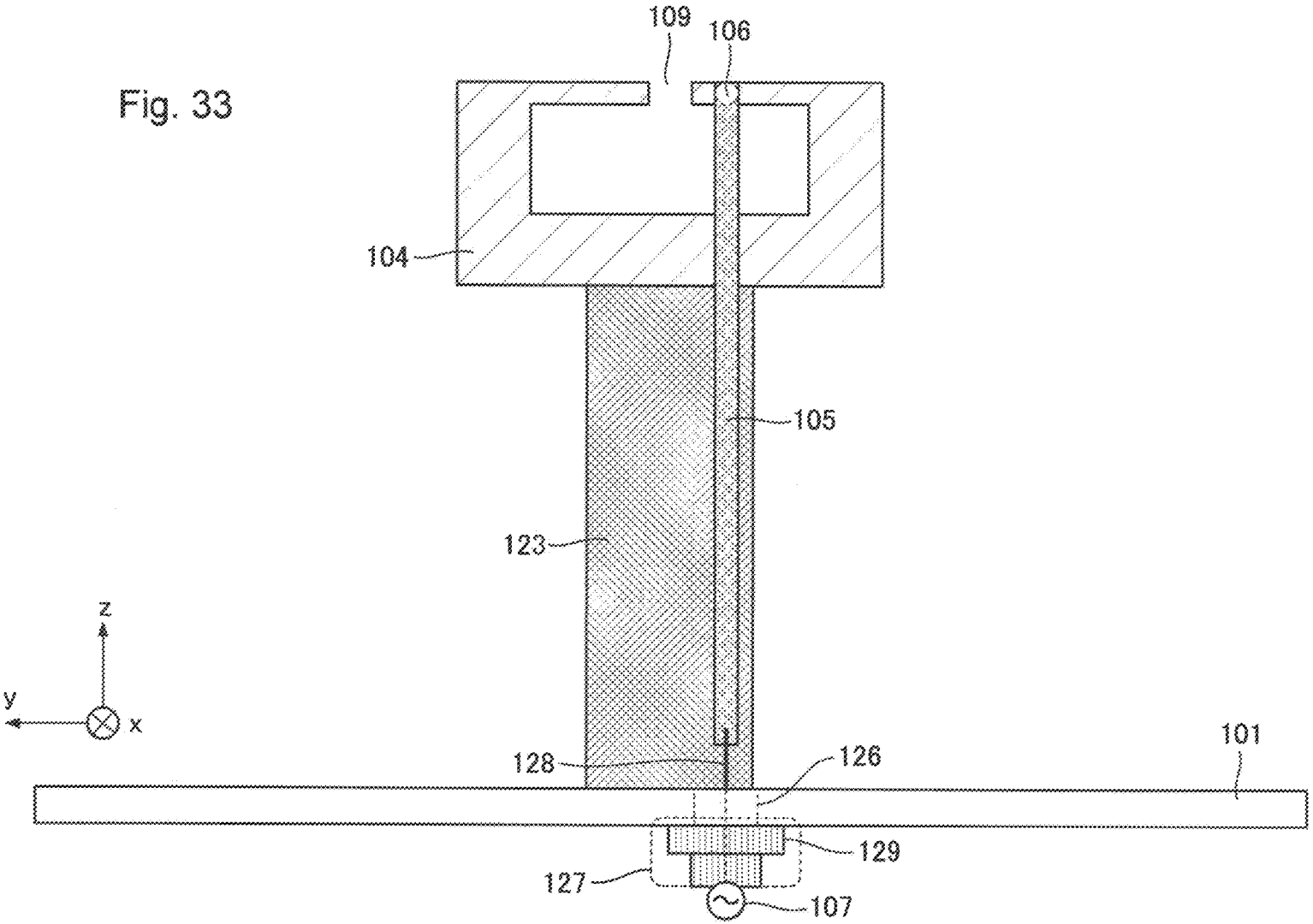
FIG. 33 is a front elevational view illustrating a modification example of the antenna according to the second example embodiment of the present invention.

In addition, when a coaxial cable is used, the coaxial cable may be provided on a rear side (z-axis negative direction-side) of the conductor reflection plate 101. FIGS. 32 and 33 are diagrams illustrating an example of the antenna 20 when a coaxial cable is provided on a rear side of the conductor reflection plate 101. Note that illustration of the dielectric layer 108 is omitted in FIGS. 32 and 33, for understanding other configurations. In the example illustrated in FIGS. 32 and 33, a clearance 126 that is a through-hole is provided for the conductor reflection plate 101. In addition, a connector 127 is provided at a position on a rear side (z-axis negative direction-side) of the conductor reflection plate 101, corresponding to a position of the clearance. The connector 127 is a connector that connects a not-illustrated coaxial cable. Herein, an outer conductor 129 of the connector 127 is electrically connected with the conductor reflection plate 101. Then, a core wire 128 of the connector 127 is electrically connected with the conductor feed line 105 of the antenna element 100 by passing through inside of the clearance 126 and penetrating to a front side (z-axis positive direction-side) of the conductor reflection plate 101. Further, the feed point 107 is capable of electrically exciting between the core wire 128 and the outer conductor 129, of the connector 127.

With such a configuration, it becomes possible to feed power to the antenna element 100 on the front side of the conductor reflection plate 101 from a radio communication circuit, a digital circuit, or the like arranged on the rear side of the conductor reflection plate 101. Thus, a wireless communications device can be configured without largely affecting a radiation pattern and radiation efficiency. Note that, in the example illustrated in FIGS. 32 and 33, a coaxial cable is provided on the rear side of the conductor reflection plate 101. However, it is sufficient that a conductor constituting a transmission line be provided on the rear side of the conductor reflection plate 101, and the conductor may not necessarily be a coaxial cable.

Furthermore, the conductor reflection plate 101 is a short-circuiting face for the antenna elements 100 and 200, similarly to the first example embodiment. Thus, in order to suppress influence on a resonance characteristic of the antenna element, it is more desirable that each of the distances Z1 and Z2 respectively between the antenna element 100 and the conductor reflection plate 101 and between the antenna element 200 and the conductor reflection plate 101 in FIG. 26 be substantially ¼ of a wavelength of an electromagnetic wave whose frequency is a resonance frequency of each antenna element when traveling through a substance filling a region. However, even distance that is not substantially ¼ of a wavelength does not affect an essential advantageous effect of the present invention.

Figure 34:
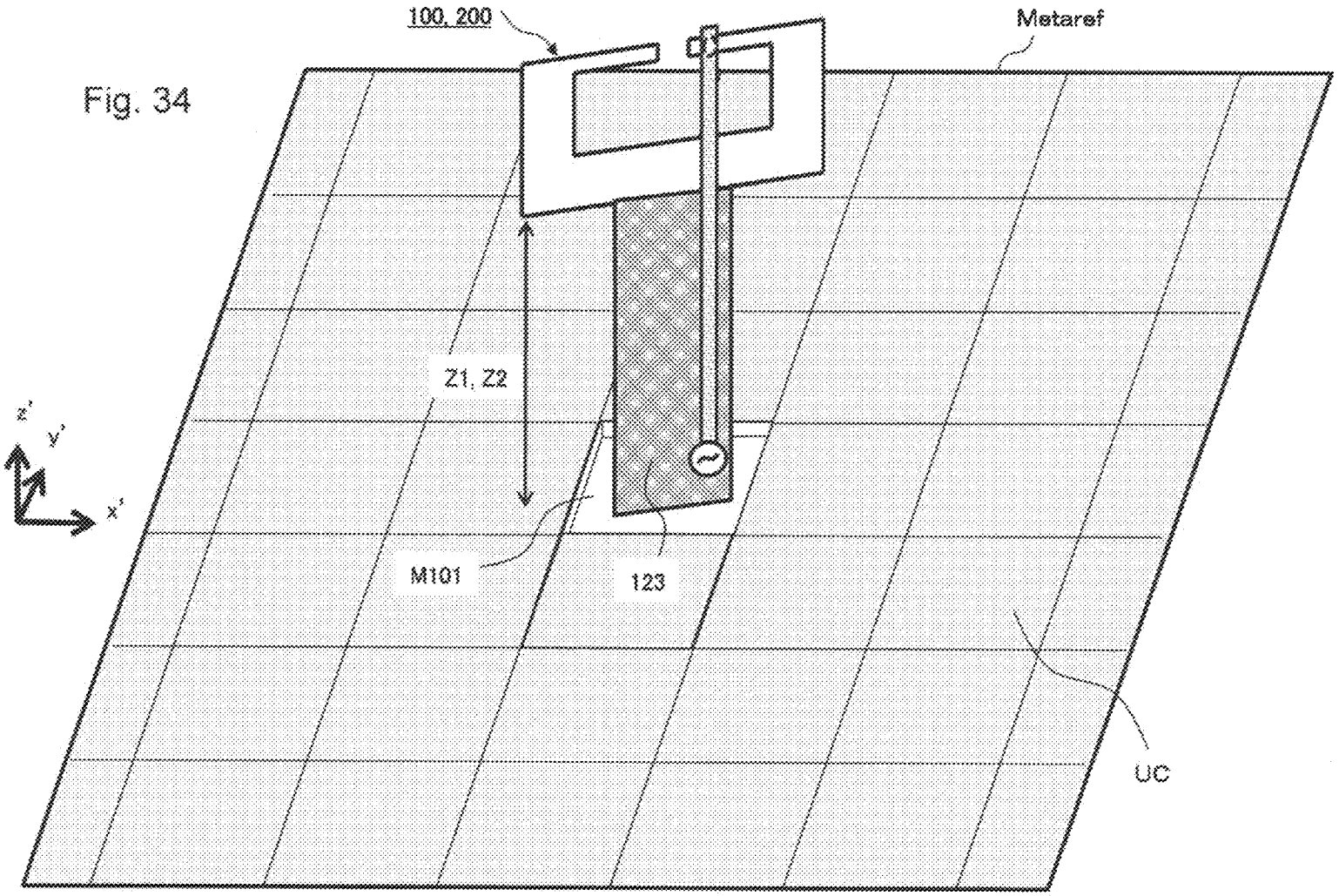
FIG. 34 is a perspective view illustrating a modification example of the antenna according to the second example embodiment of the present invention.

FIG. 34 is a diagram illustrating a configuration of the antenna elements 100 and 200 according to the modification example of the second example embodiment. As illustrated in FIG. 34, in the antenna 20 according to the second example embodiment, a metamaterial reflection plate Metaref may be used as the conductor reflection plate 101, similarly to FIG. 24. This can suppress a change in a resonance characteristic of each of the antenna elements 100 and 200, even when the distances Z1 and Z2 are shorter than ¼ of λ1 and ¼ of λ2, respectively. At this time, as illustrated in FIG. 34, a conductor piece or the like that constitutes a periodic structure UC positioned immediately below each of the antenna elements 100 and 200 among periodic structures UC constituting the metamaterial reflection plate Metaref may be removed, and only a conductor plate M101 may exist. With such a configuration, the conductor feed line 105 and the conductor feed section 123 can be prevented from being superimposed on the periodic structure UC. Even this configuration does not cause remarkable deterioration in performance of reflection phase control of the metamaterial reflection plate Metaref.

(Third Example Embodiment)

Figure 35:
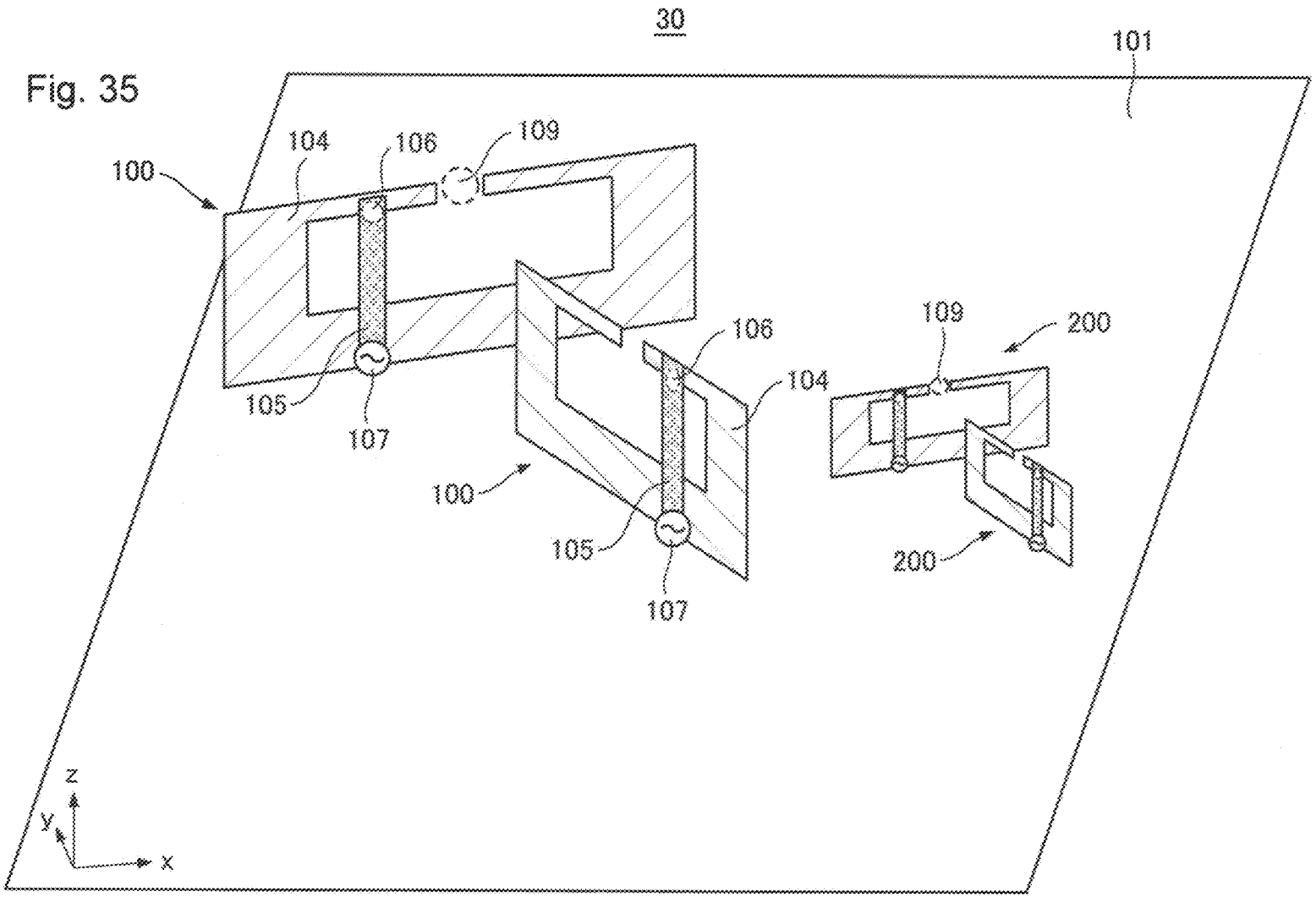
FIG. 35 is a perspective view of an antenna according to a third example embodiment of the present invention.
Figure 36:
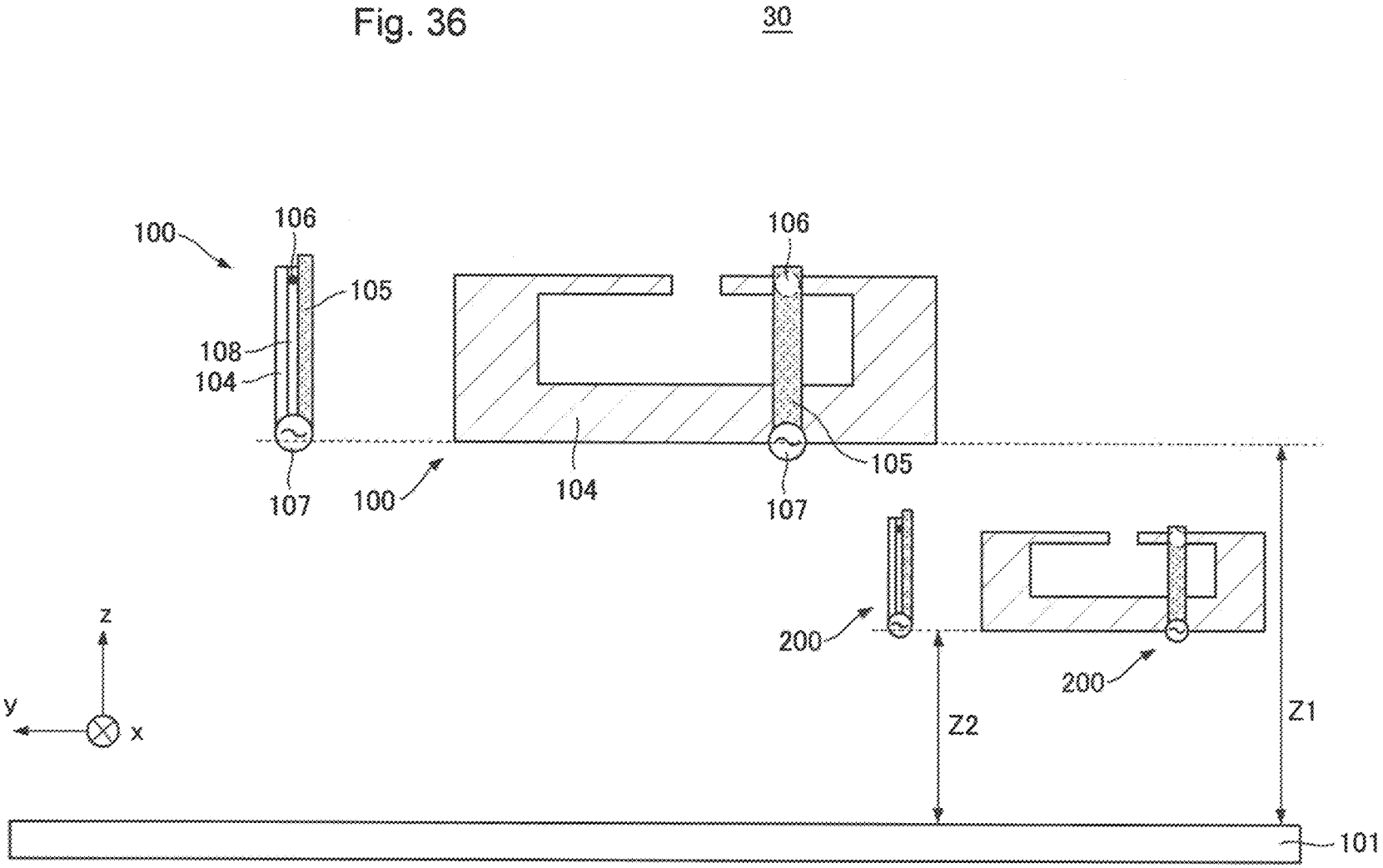
FIG. 36 is a front elevational view of the antenna according to the third example embodiment of the present invention.
Figure 37:
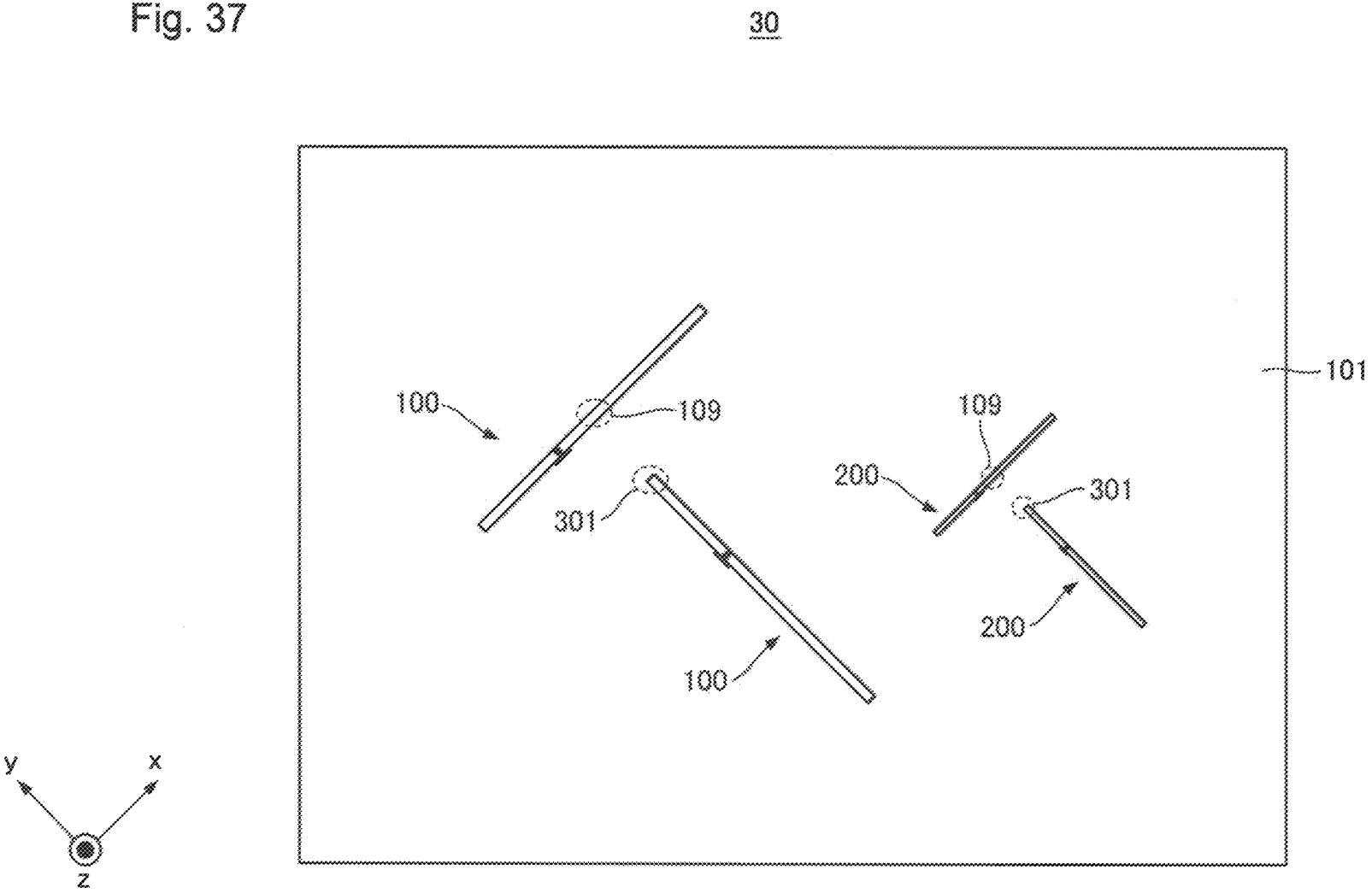
FIG. 37 is a top view of the antenna according to the third example embodiment of the present invention.

Next, an antenna 30 according to a third example embodiment of the present invention will be described below. Note that, in the following description, the same components as the above-described components are assigned with the same reference numerals, and description therefor will be omitted as appropriate. FIG. 35 is a perspective view of the antenna 30, FIG. 36 is a side view of the antenna 30, and FIG. 37 is a top view of the antenna 30. Note that, regarding a dielectric layer 108, illustration of the dielectric layer 108 of each of antenna elements 100 and 200 is omitted in FIGS. 35 and 36, for ease of understanding arrangement of other configurations.

The antenna 30 is different from the antenna 10 in including two antenna elements 100 and two antenna elements 200. Then, in FIG. 37, the two antenna elements 100 and the two antenna elements 200 respectively have element lengthwise directions that are in a substantial perpendicular relationship with respect to each other in a projected view on a conductor reflection plate 101, and an end section 301 in a lengthwise direction of one antenna element is positioned in a vicinity of a split section 109 that is a substantial central section of another antenna element. In other words, the two antenna elements 100 and the two antenna elements 200 are respectively arranged in such a way that a line extended in a lengthwise direction of one element intersects another element at a substantial central part of the another element.

An advantageous effect of the antenna 30 according to the third example embodiment will be described below. Since the antenna 30 includes the two antenna elements 100 and the two antenna elements 200 that are respectively in a substantial perpendicular relationship, a multiband and dual orthogonal polarization-supporting antenna can be provided.

In addition, as described in the first example embodiment, when being electromagnetically resonated, each of the antenna elements 100 and 200 has electrically open faces in vicinities of both end sections in a lengthwise direction, the electrically open faces having strong electric field intensity and weak magnetic field intensity. Then, each of the antenna elements 100 and 200 has an electrically short-circuiting face in a vicinity of a substantial central section in a lengthwise direction, the electrically short-circuiting face having strong magnetic field intensity and weak electric field intensity. Therefore, as described above, it is preferred that the two antenna elements 100 and the two antenna elements 200 be respectively arranged substantially perpendicularly in such a way that the end section 301 in a lengthwise direction of one antenna element is positioned in a vicinity of the split section 109 that is a substantial central section of another antenna element. The reason is that the two antenna elements 100 and the two antenna elements 200 can be respectively arranged orthogonally in such a way that a part having strong electric field intensity does not come in proximity to a part having strong magnetic field intensity. As a result, two antenna elements can be arranged close to each other while preventing electromagnetic coupling. In other words, when each of the antenna elements 100 and 200 is dual-polarized, elements of respective polarization waves can be arranged close to each other while preventing electromagnetic coupling between the polarization waves. As a result, an increase in size of an overall antenna accompanying dual polarization can be prevented.

As described above, a multiband antenna that supports dual orthogonal polarization and prevents an increase in size of an overall antenna due to dual polarization while preventing coupling between polarization waves can be provided, in addition to the advantageous effect of the first example embodiment. In addition, when a wireless communications device is configured by using the antenna 30 similarly to the first example embodiment, a wireless communications device supporting dual polarization can be provided.

Note that all of the modification examples of the antenna elements 100 and 200 described in the first and second example embodiments are applied to the antenna elements 100 and 200 according to the present example embodiment as appropriate.

Figure 38:
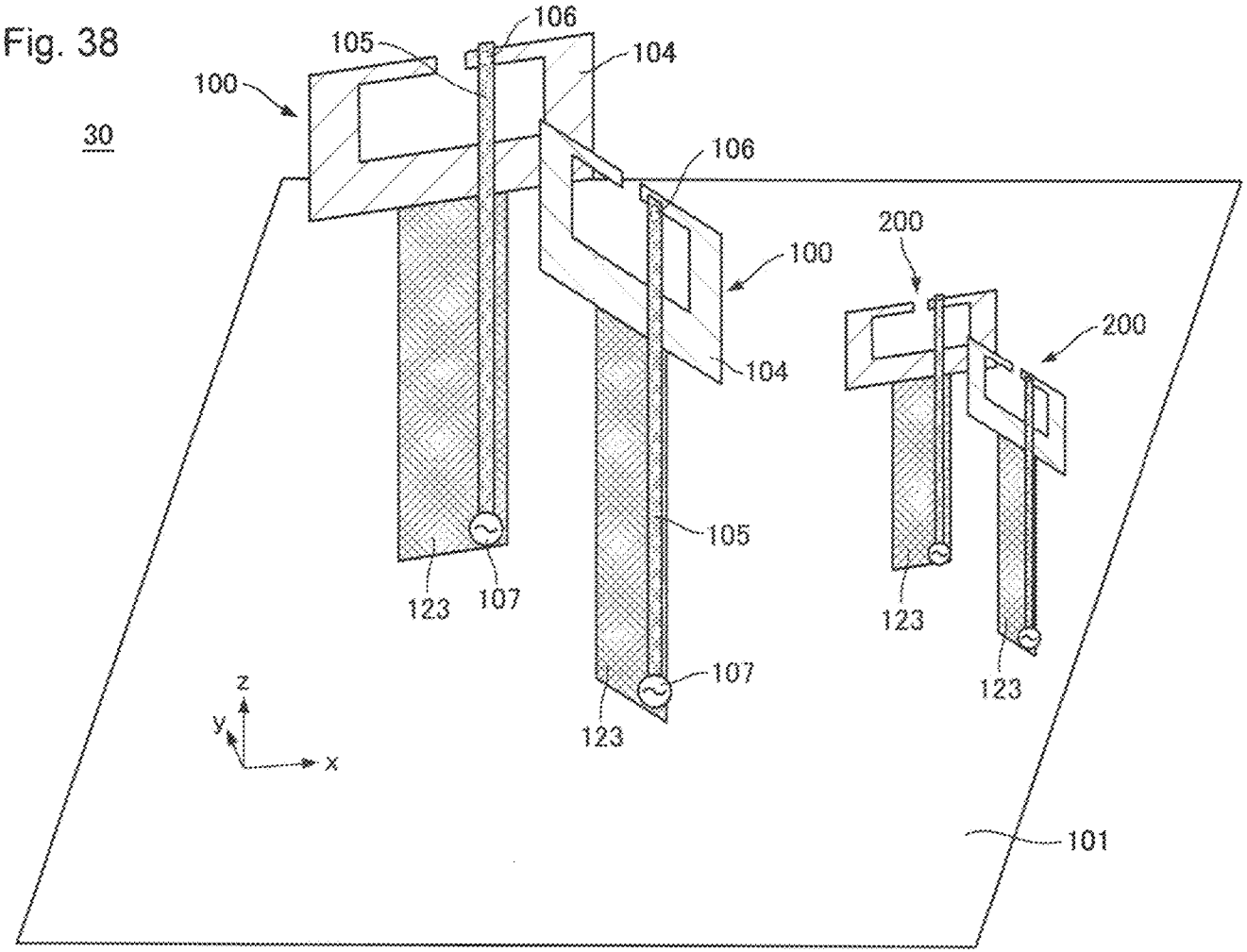
FIG. 38 is a perspective view illustrating a modification example of the antenna according to the third example embodiment of the present invention.

For example, as in FIG. 38, the two antenna elements 100 and the two antenna elements 200 may include the conductor feed sections 123 described in the second example embodiment. Further, various modification examples of the third example embodiment will be described below. Note that the various modification examples described below may be combined as appropriate.

Figure 39:
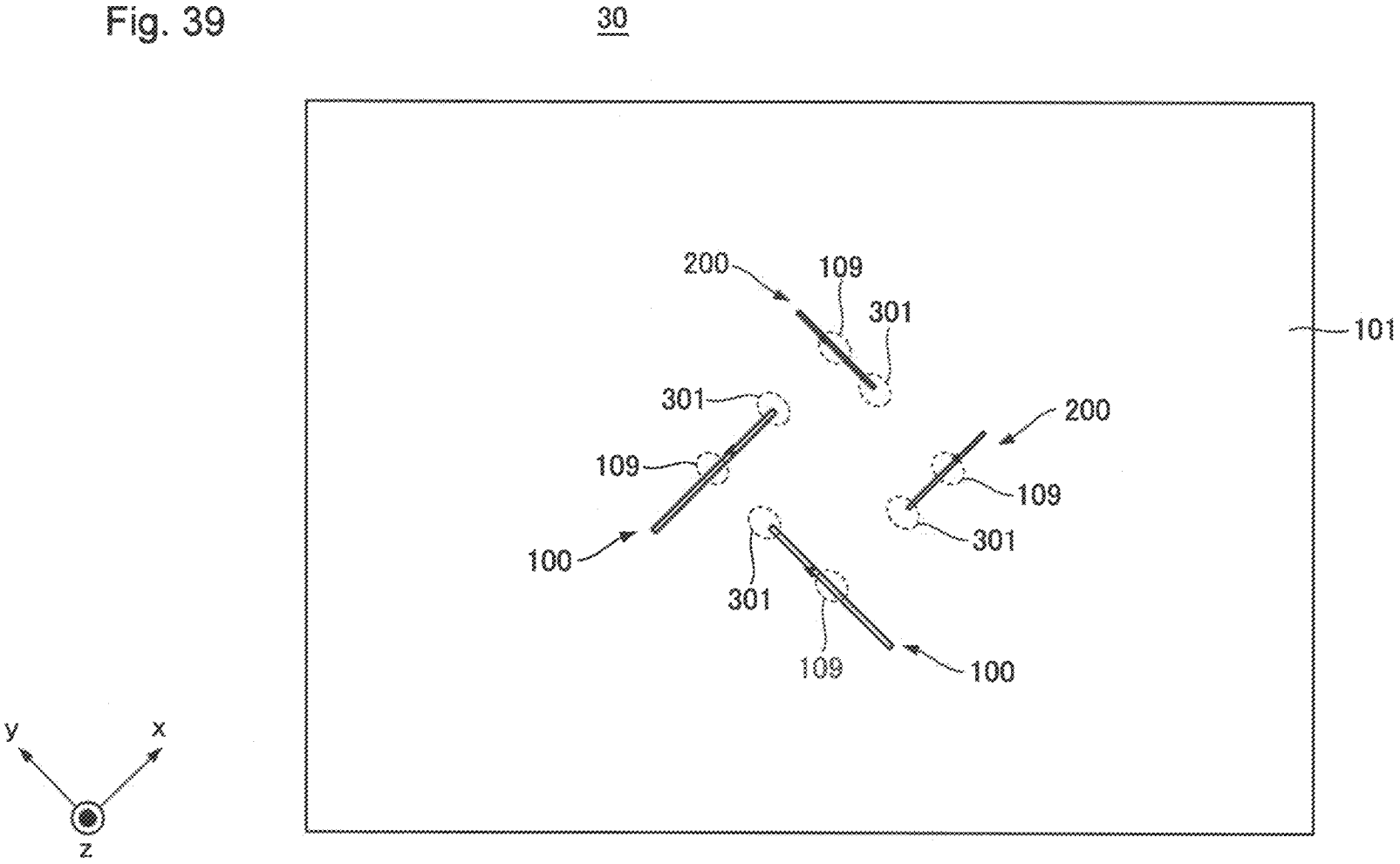
FIG. 39 is a top view illustrating a modification example of the antenna according to the third example embodiment of the present invention.

As in FIG. 39, with regard to the above-described arrangement example, further, the two antenna elements 100 and the two antenna elements 200 adjacent to one another may be all arranged substantially perpendicularly in such a way that the end section 301 in a lengthwise direction of one antenna element is positioned in a vicinity of the split section 109 that is a substantial central section of another antenna element. With this arrangement, mutual influence between the antenna element 100 and the antenna element 200 adjacent to each other can be also reduced, in addition to coupling between dual-polarization waves of the antenna elements 100 or 200.

In addition, arrangement of the two antenna elements 100 or the two antenna elements 200 that are in a perpendicular relationship may not necessarily be the arrangement illustrated in FIGS. 36, 37, and 38.

Figure 40:
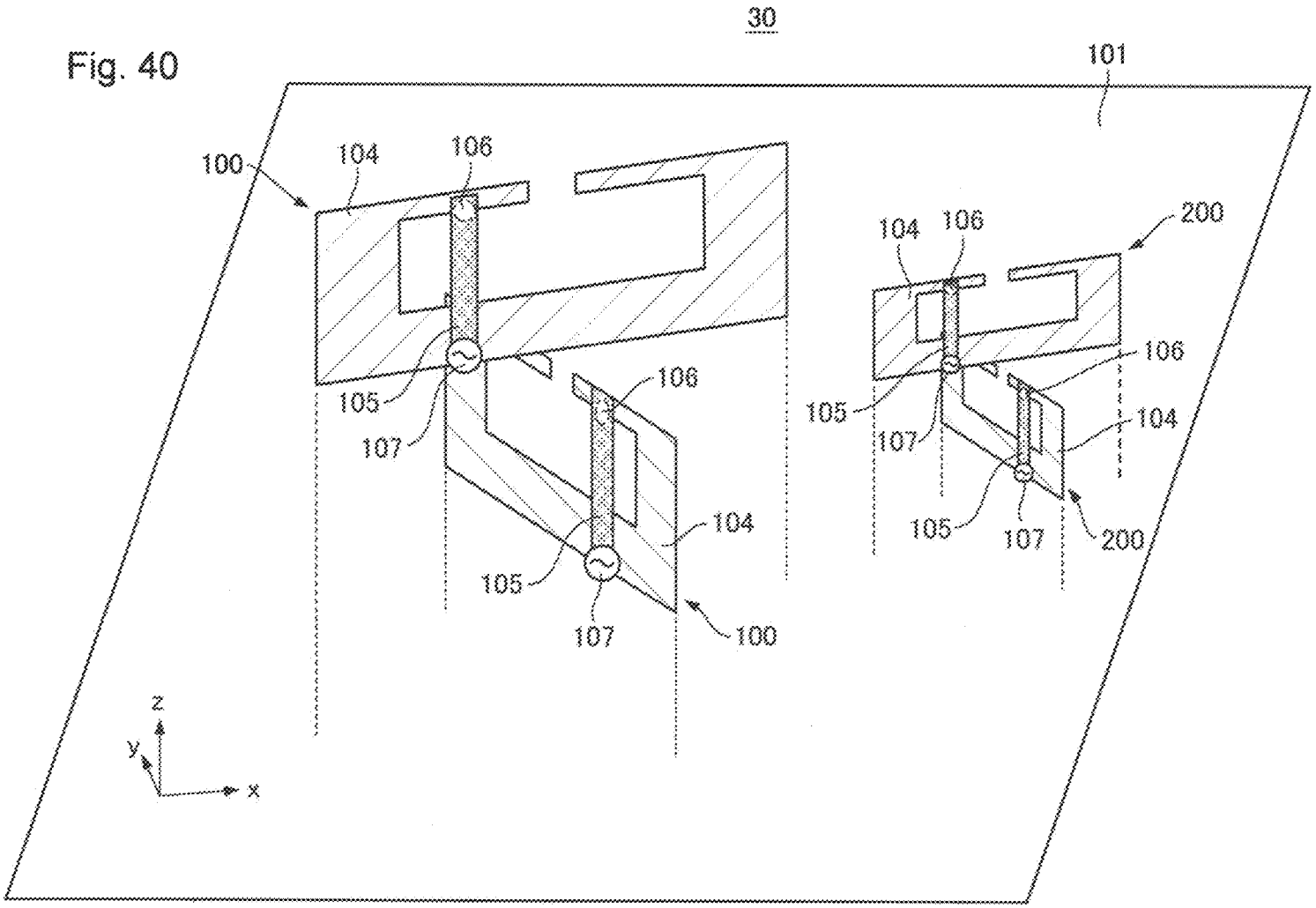
FIG. 40 is a perspective view illustrating a modification example of the antenna according to the third example embodiment of the present invention.
Figure 41:
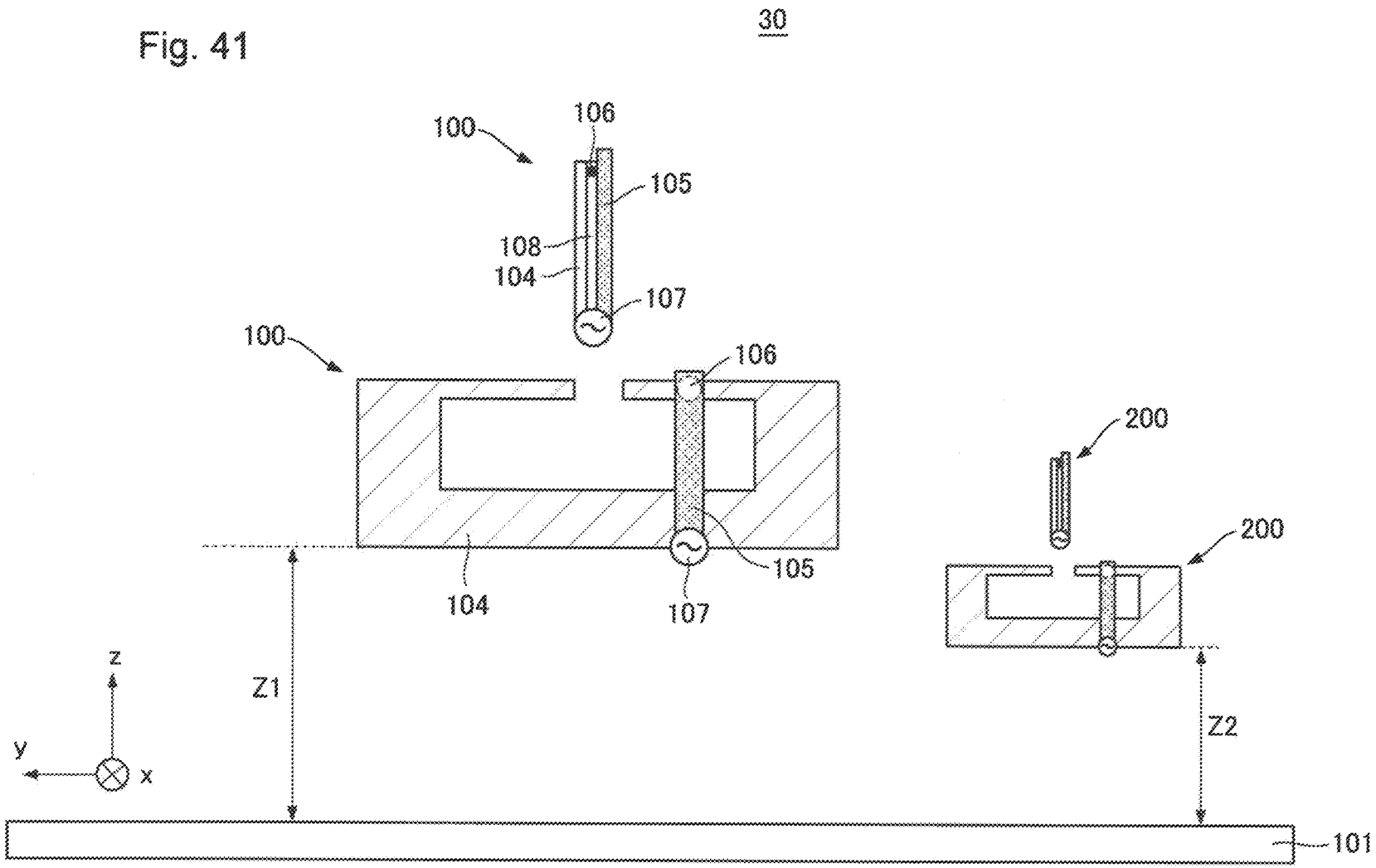
FIG. 41 is a side view illustrating a modification example of the antenna according to the third example embodiment of the present invention.
Figure 42:
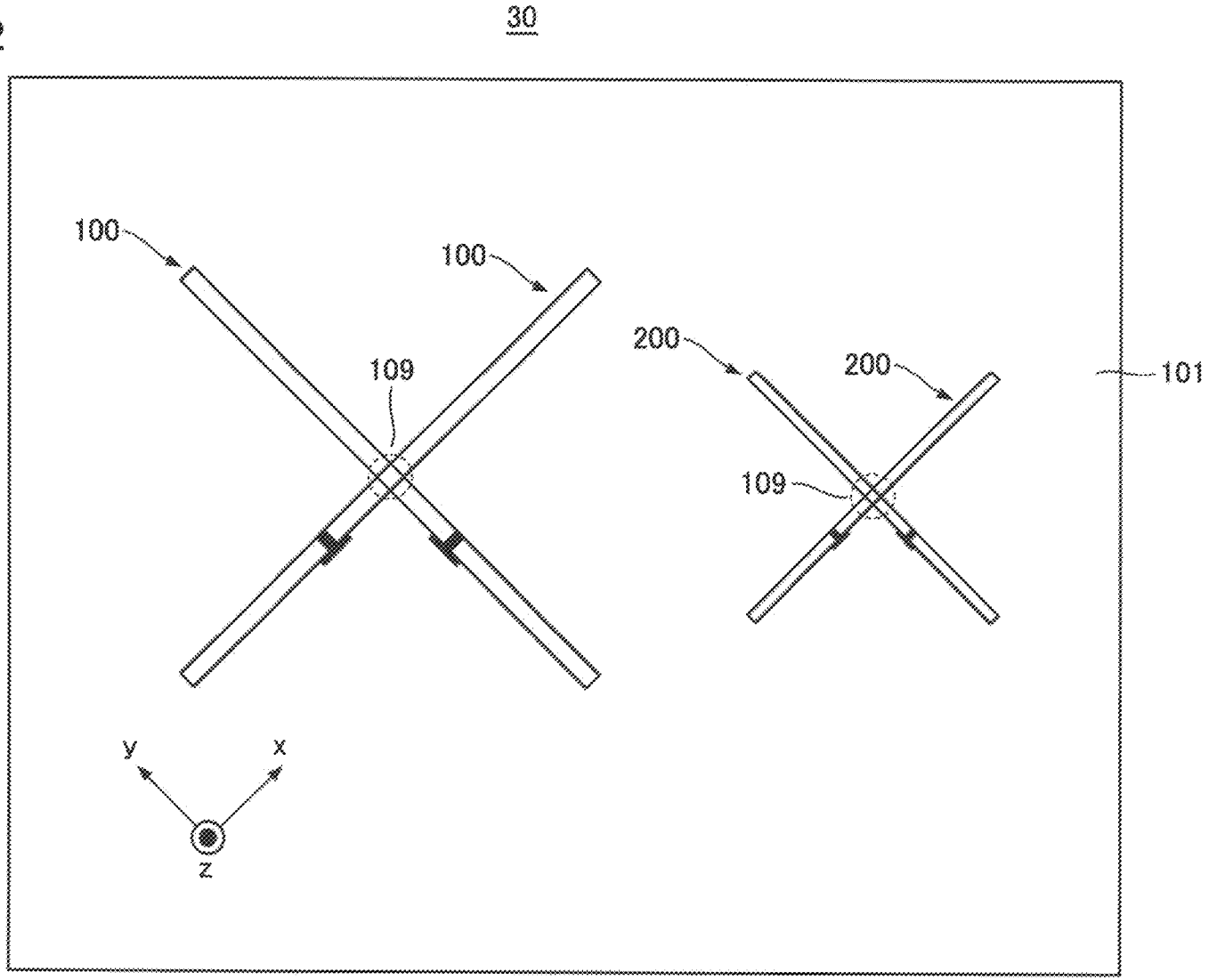
FIG. 42 is a top view illustrating a modification example of the antenna according to the third example embodiment of the present invention.

For example, the two antenna elements 100 or the two antenna elements 200 may be arranged as in FIGS. 40, 41, and 42. FIG. 40 is a perspective view, FIG. 41 is a side view, and FIG. 42 is a top view of an arrangement modification example of the antenna 30. As illustrated in FIG. 42, the two antenna elements 100 and the two antenna elements 200 that are respectively in a perpendicular relationship have lengthwise directions intersecting each other in a vicinity of the split section 109 equivalent to a substantial central section of each antenna element, in a projected view on the conductor reflection plate 101. Then, in FIGS. 40 and 41, the two antenna elements 100 and the two antenna elements 200 are respectively arranged with spacing in a z-axis direction above the conductor reflection plate 101 (z-axis positive direction in the drawings).

With this arrangement, both end sections in a lengthwise direction of an element, which become electrically open faces when being resonated and have strong electric field intensity, are separated in distance from both end sections in a lengthwise direction of another element. In addition, magnetic fields made by the two elements have high orthogonality with respect to each other. As a result of this, even in the above-described arrangement modification example, the two antenna elements 100 and the two antenna elements 200 that are respectively in a perpendicular relationship can be arranged close to each other while preventing coupling.

Figure 43:
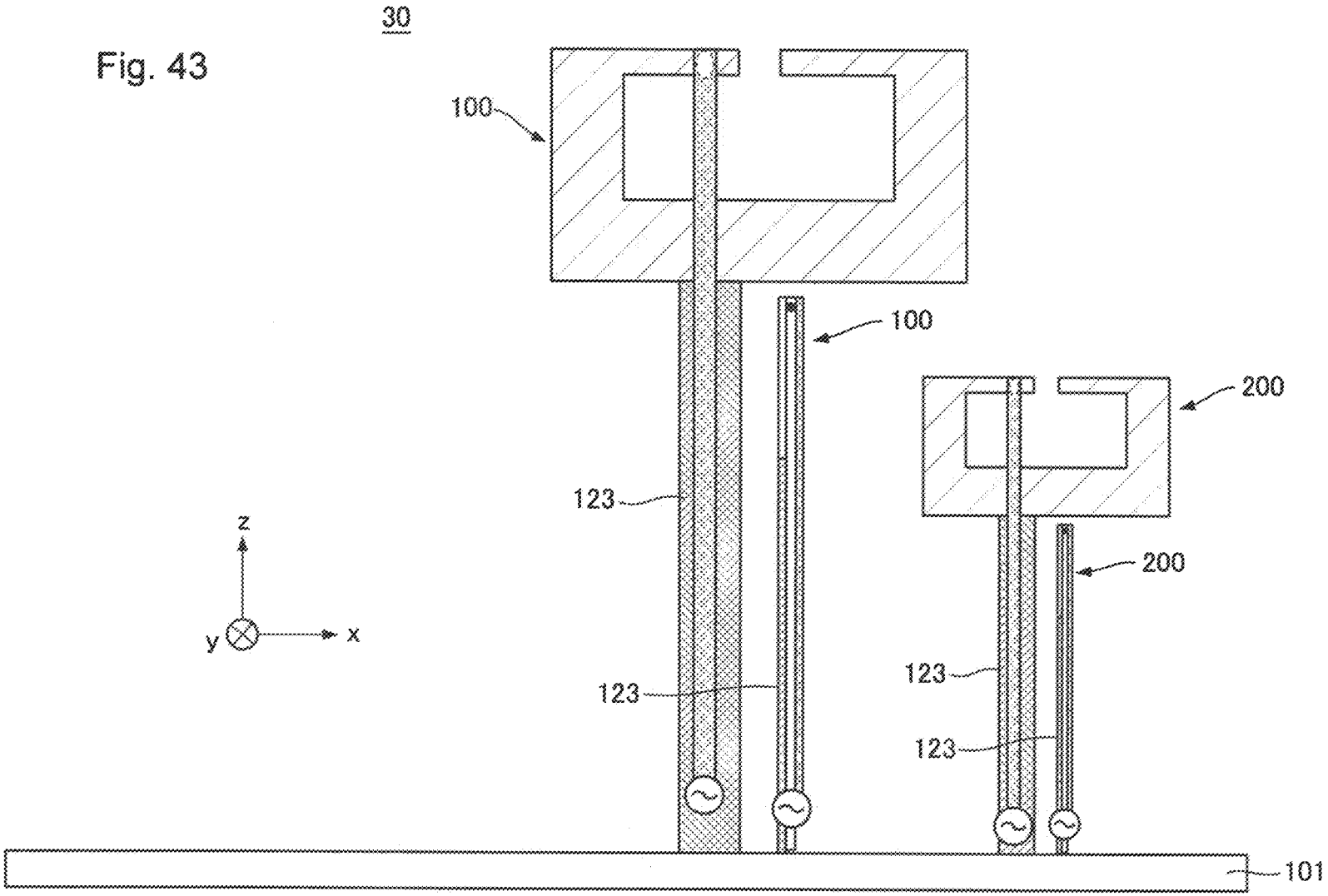
FIG. 43 is a side view illustrating a modification example of the antenna according to the third example embodiment of the present invention.

Note that, as illustrated in FIG. 43, even in the above-described arrangement modification example, the two antenna elements 100 and the two antenna elements 200 may include the conductor feed sections 123 described in the second example embodiment. In addition, at this time, as illustrated in FIG. 43, the conductor feed sections 123 may be formed by being shifted in position between the two antenna elements 100 and between the two antenna elements 200 that are respectively in a perpendicular relationship. In other words, an upper antenna element may be arranged so as not to overlap a lower-side (z-axis negative direction in the drawing) element, by shifting a position where the conductor feed section 123 of the upper antenna element is connected with the C-shaped conductor 104 from a center of the C-shaped conductor 104.

Note that, even besides the above-described arrangement examples, two elements that are in a perpendicular relationship may be arranged in any way within an allowable range of influence imparted by electromagnetic coupling between the two elements on an element characteristic.

(Fourth Example Embodiment)

Figure 44:
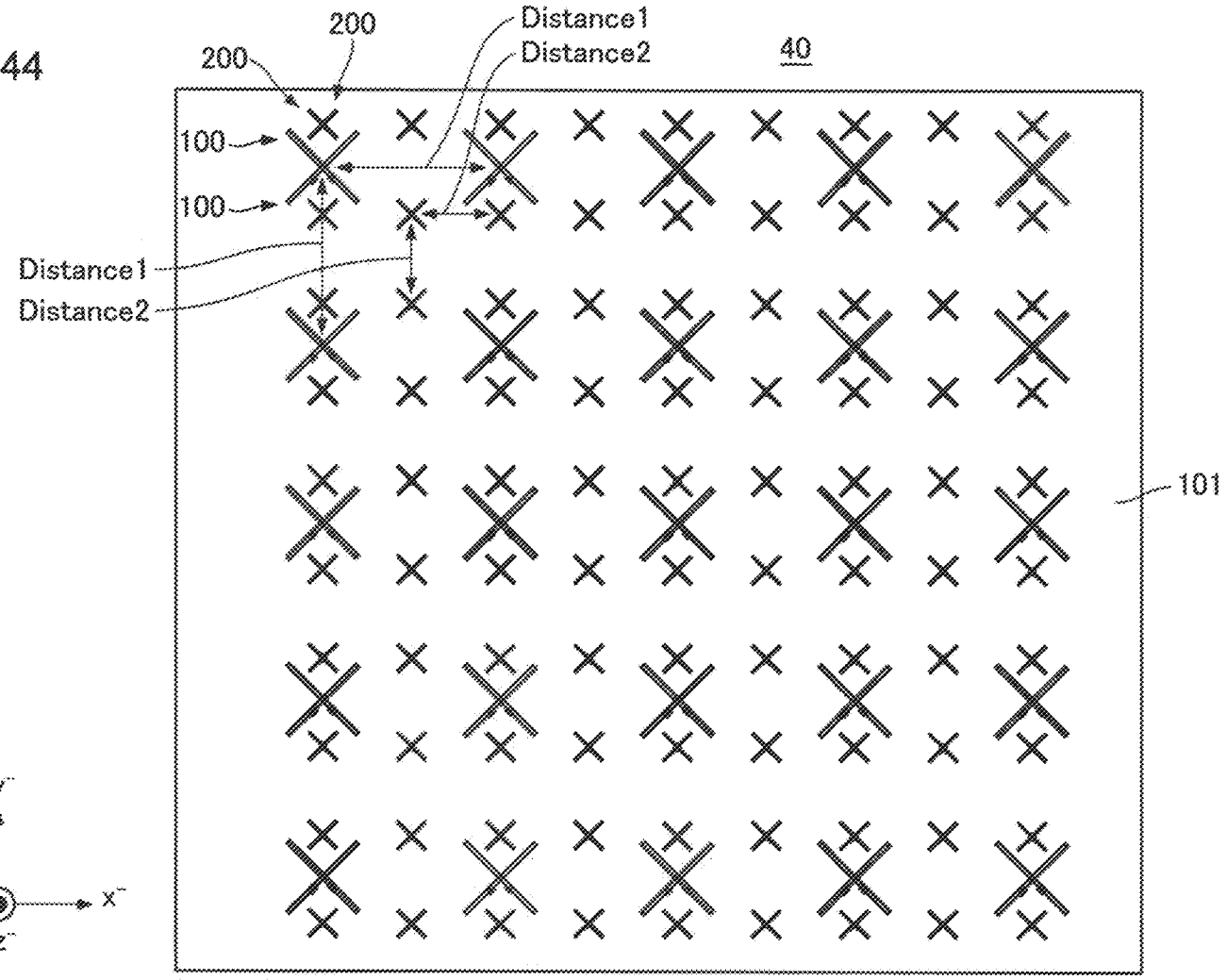
FIG. 44 is a top view of an antenna according to a fourth example embodiment of the present invention.

Next, an antenna 40 according to a fourth example embodiment of the present invention will be described below. Note that, in the following description, the same components as the above-described components are assigned with the same reference numerals, and description therefor will be omitted as appropriate. FIG. 44 is a top view of an example of the antenna 40.

The antenna 40 includes a plurality of antenna elements 100 and a plurality of antenna elements 200 that are respectively arranged in an array. In this example, the antenna elements 100 and 200 are respectively arranged in an X shape. In FIG. 44, the antenna elements 100 and 200 are respectively dual-polarized by two elements that are in a perpendicular relationship with the arrangement described in FIGS. 40, 41, and 42 in the third example embodiment. Further, the antenna elements 100 and 200 are respectively arranged in a substantial square array with a distance Distance1 and a distance Distance2, in a projected view on a conductor reflection plate 101. Then, the distance Distance1 and the distance Distance2 are, for example, substantially ½ of λ1 and substantially ½ of λ2, respectively. In addition, in FIG. 44, Distance1 is approximately equal to twice Distance2. Further, the antenna elements 100 and 200 are respectively aligned in an x and y directions at the same pitch.

By including the plurality of the antenna elements 100 and the plurality of antenna elements 200 that are respectively arranged in an array, the antenna 40 can configure a plurality of array antennas corresponding to respective frequencies and sharing the conductor reflection plate 101 on an identical plane.

In addition, the antenna 40 in FIG. 44, in which the antenna elements 100 and 200 are respectively dual-polarized with the arrangement described in the third example embodiment, includes array antennas for respective polarization waves of respective frequencies, as described above. Thus, the antenna 40 can configure multiband and dual polarization-supporting array antennas on an identical plane, which enables a multiband and dual polarization-supporting beamforming operation. In addition, when a wireless communications device is configured by using the antenna 40 similarly to the first example embodiment, a wireless communications device that is capable of multiband and dual polarization-supporting beamforming can be provided.

In addition, herein, when beamforming is performed, it is desirable that a distance between antenna elements of an array antenna be, in a square array, approximately around half a wavelength of an electromagnetic wave at a use frequency. At this time, when a dual polarization-supporting array antenna is configured by using antenna elements such as a dipole antenna whose lengthwise size is around a size of half a wavelength, a gap hardly remains between the antenna elements. In addition, when an array antenna for another frequency is further configured on the same plane, antenna elements for different frequencies come very close to each other, which results in large mutual interference.

However, as described in the first example embodiment, the antenna element 100 and the antenna element 200 have lengthwise sizes of approximately ¼ of λ1 and ¼ of λ2, respectively, which are compact while having satisfactory radiation efficiency. Therefore, in the antenna 40, even when the antenna elements 100 are arranged in an array at an interval of approximately substantially ½ of Distance1=λ, a certain amount of gap is generated between the antenna elements 100. Consequently, in a projected view on the conductor reflection plate, the antenna elements 200 can be arranged in regions between the antenna elements 100 without overlapping the antenna elements 100, and fabrication can be made simpler. In addition, since the respective antenna elements 100 and 200 are compact, a gap between the antenna elements 100 and 200 increases, and mutual interference can be reduced.

In addition, in FIG. 44, since Distance1 is approximately equal to twice Distance2, cycles of repetition of arrangement are substantially consistent. As a result, the antenna elements 200 can be arranged so as not to overlap the antenna elements 100 while maintaining approximately Distance2=λ2/2.

However, the distance between the antenna elements 100 or between the antenna elements 200 may not necessarily be limited to ½ of λ1 or ½ of λ2, and in addition, Distance1 may not necessarily be equal to twice Distance2. In addition, dual polarization may not necessarily be used, but the antenna elements 100 and 200 may respectively constitute an array antenna with only single polarization depending on uses. In addition, in FIG. 44, the antenna elements 100 and 200 are respectively arranged in a square array, but an array antenna may be configured in another way of alignment, such as rectangular arrangement and triangular arrangement. In addition, an array antenna may be an array having an elongated configuration as a whole, whose one side is shorter than another side, such as a one-column array and a two-column array.

In addition, all of the modification examples of the antenna elements 100 and 200 described in the first, second, and third example embodiments are applied to the antenna elements 100 and 200 according to the present example embodiment as appropriate. For example, each of the antenna elements 100 and 200 may include the conductor feed section 123 described in the second example embodiment.

Further, various modification examples of the fourth example embodiment will be described below. Note that the various modification examples described below may be combined as appropriate.

Figure 45:
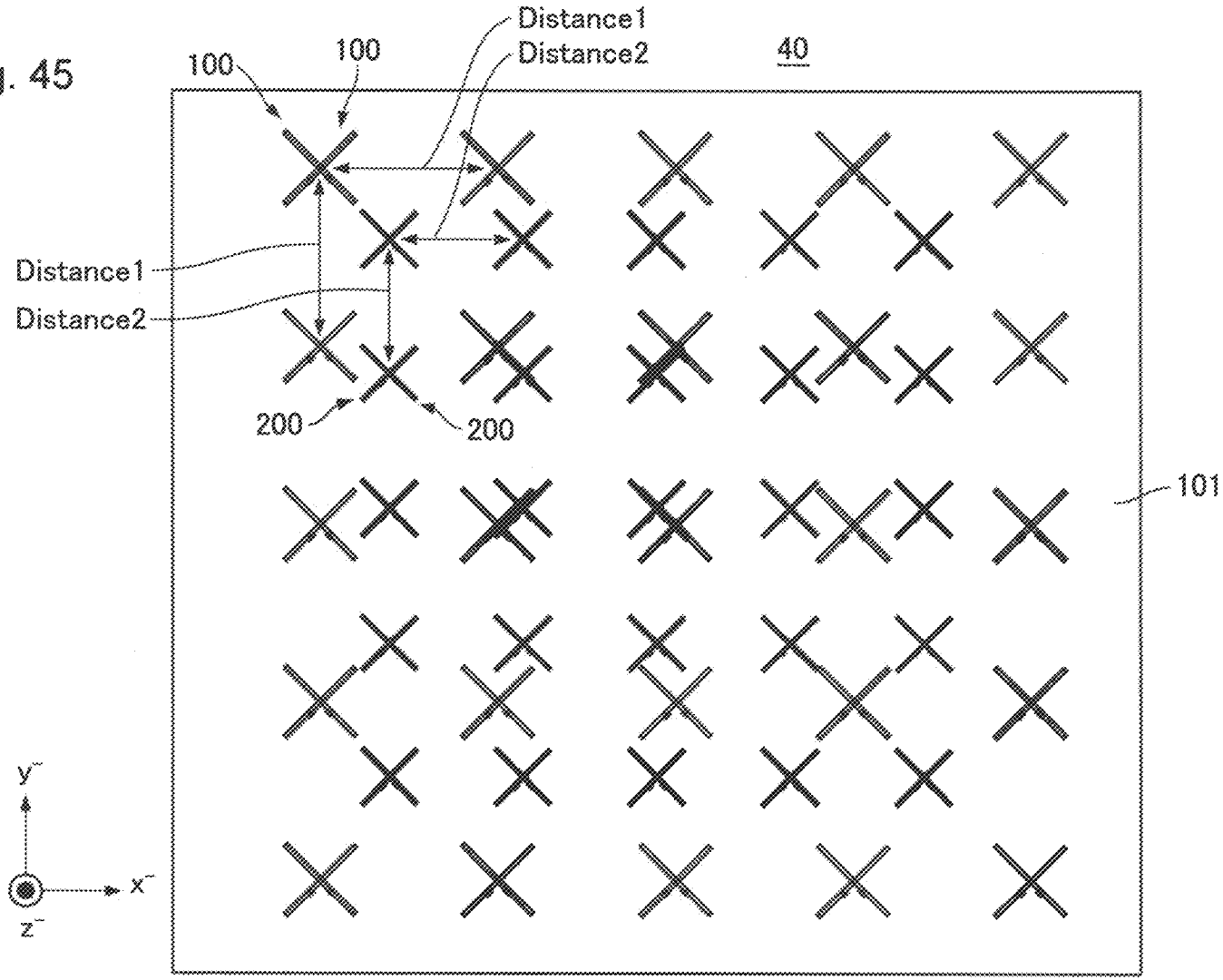
FIG. 45 is a top view illustrating a modification example of the antenna according to the fourth example embodiment of the present invention.
Figure 46:
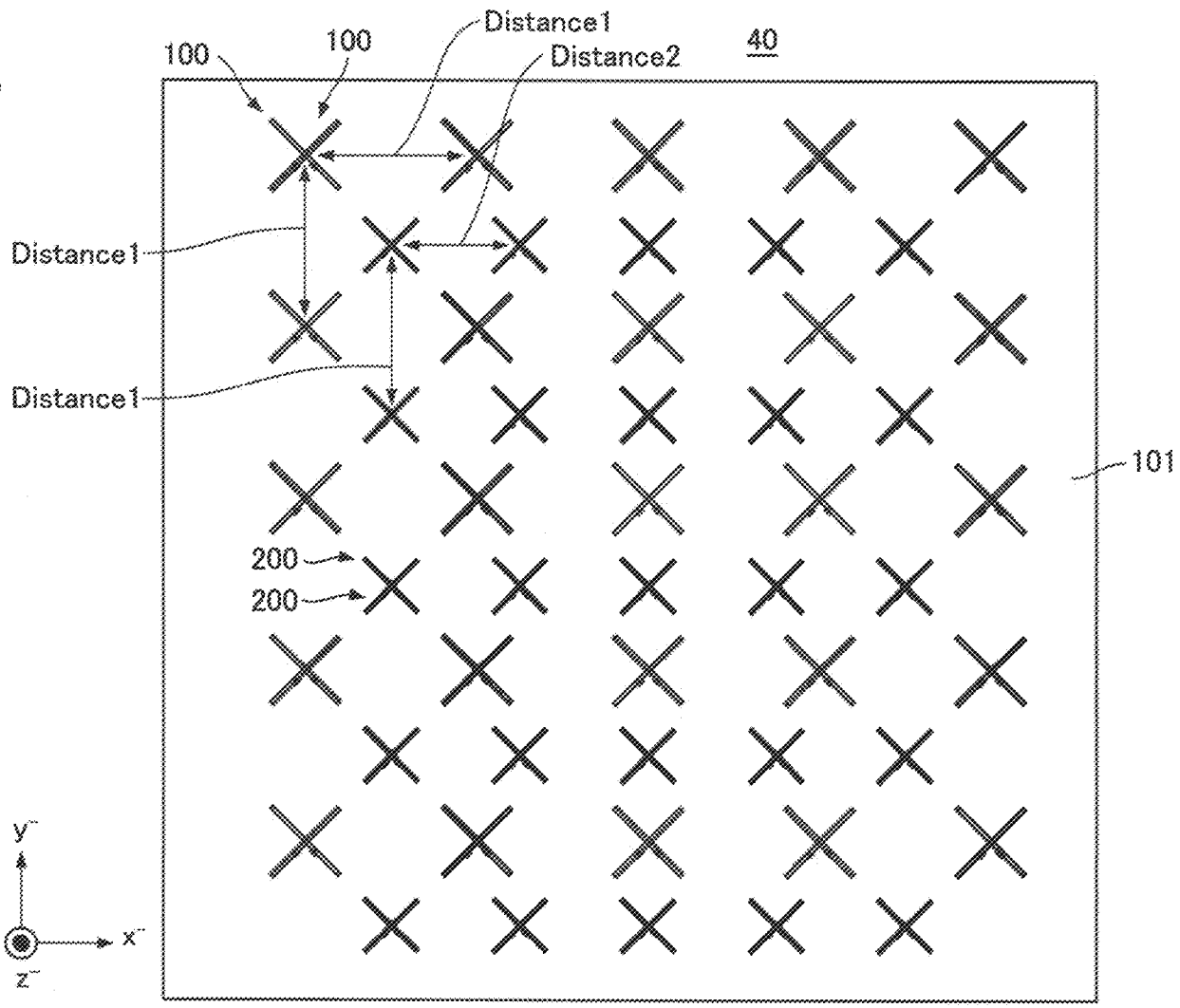
FIG. 46 is a top view illustrating a modification example of the antenna according to the fourth example embodiment of the present invention.

For example, in FIG. 44, the antenna elements 100 and the antenna elements 200 are arranged so as not to overlap each other in a projected view on the conductor reflection plate 101, but, depending on a relationship between λ1 and λ2, the antenna elements 100 and the antenna elements 200 may overlap each other in a projected view on the conductor reflection plate 101 as in FIG. 45. Additionally, for example, as illustrated in FIG. 46, an inter-antenna-element distance of either the antenna elements 100 or 200, herein, an inter-antenna-element distance of the antenna elements 200 in a $y^-$-axis direction in the drawing, may be changed. In other words, the antenna elements 100 and 200 may be arranged so as not to overlap each other, by interposing the antenna elements 200 in a gap between the antenna elements 100 in a projected view on the conductor reflection plate 101. However, when beamforming is performed on a plane ($y^-$-$z^-$ plane in FIG. 46) including an expanding direction of an inter-element distance, it is desirable to observe, that a side lobe may be increased depending on a way of forming a beam, and the like.

Figure 47:
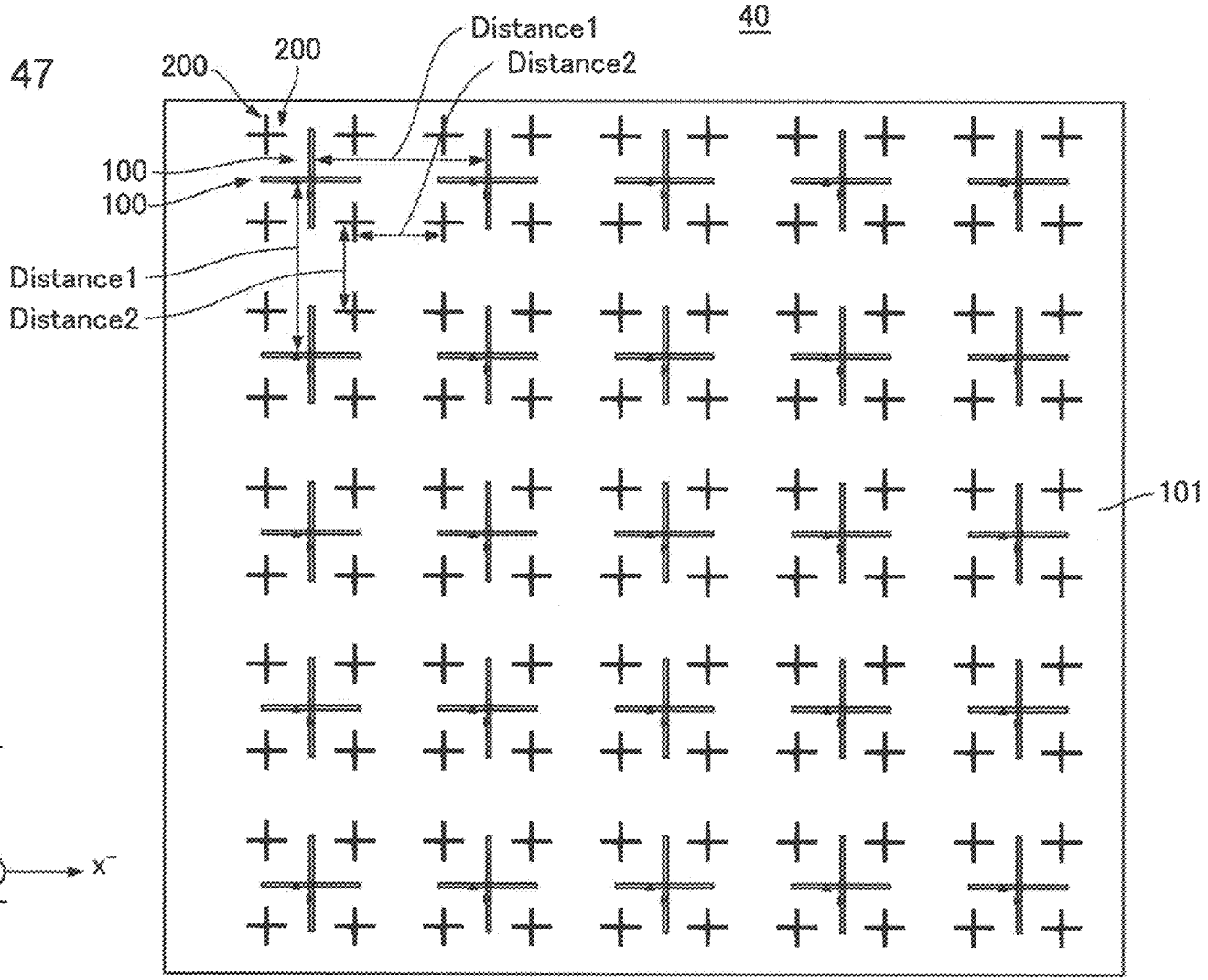
FIG. 47 is a top view illustrating a modification example of the antenna according to the fourth example embodiment of the present invention.

In addition, a method and an orientation of dual polarization of the antenna elements 100 and 200, and an arrangement direction of an array in the antenna 40, described in the third example embodiment may not necessarily be combined as illustrated in FIG. 44. For example, as illustrated in FIG. 47, the antenna elements 100 and 200 may be respectively dual-polarized with the cross-shaped arrangement described in FIGS. 40, 41, and 42, and the arrangement may be such that an arrangement direction of an array is identical to an orientation of a cross shape.

Figure 48:
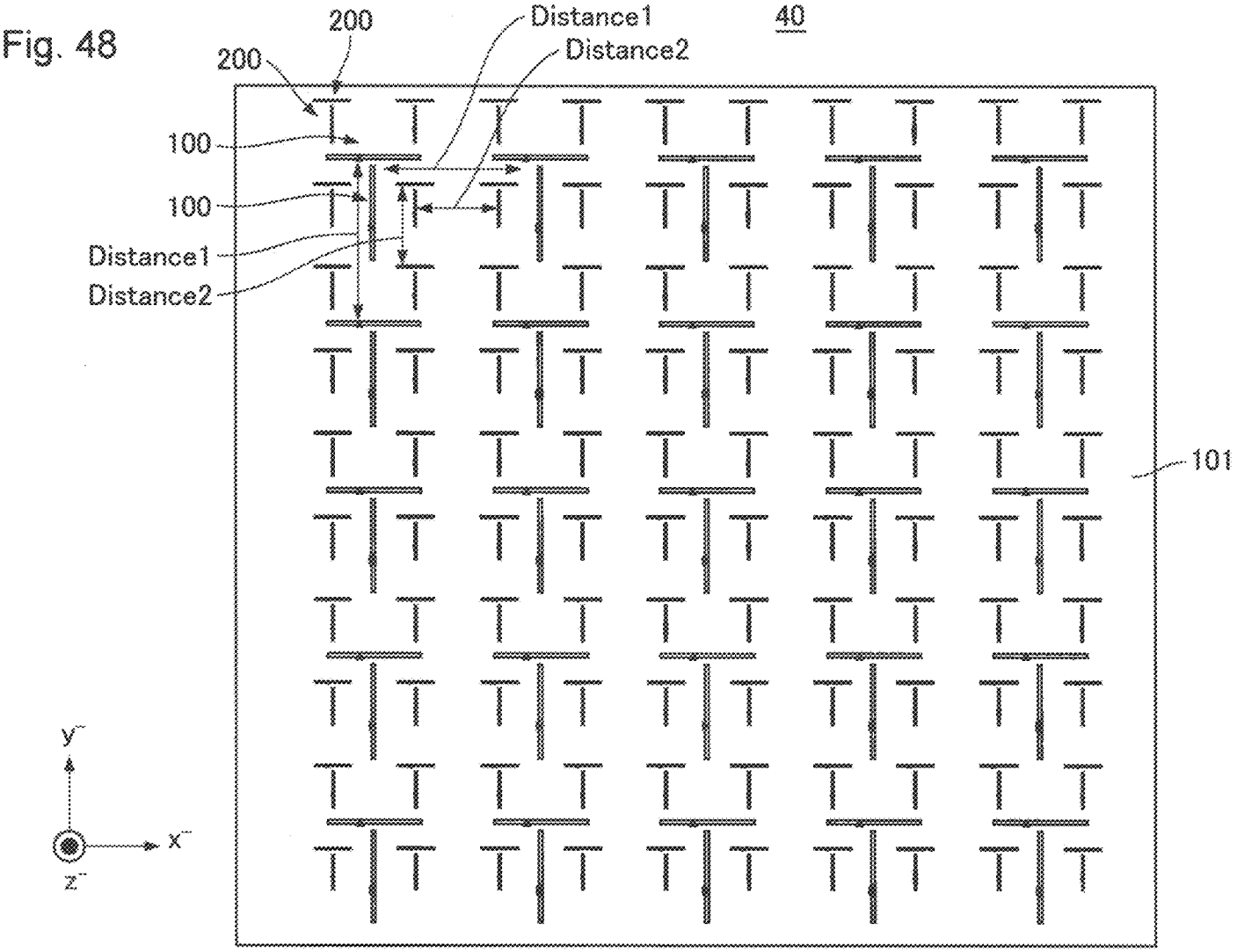
FIG. 48 is a top view illustrating a modification example of the antenna according to the fourth example embodiment of the present invention.
Figure 49:
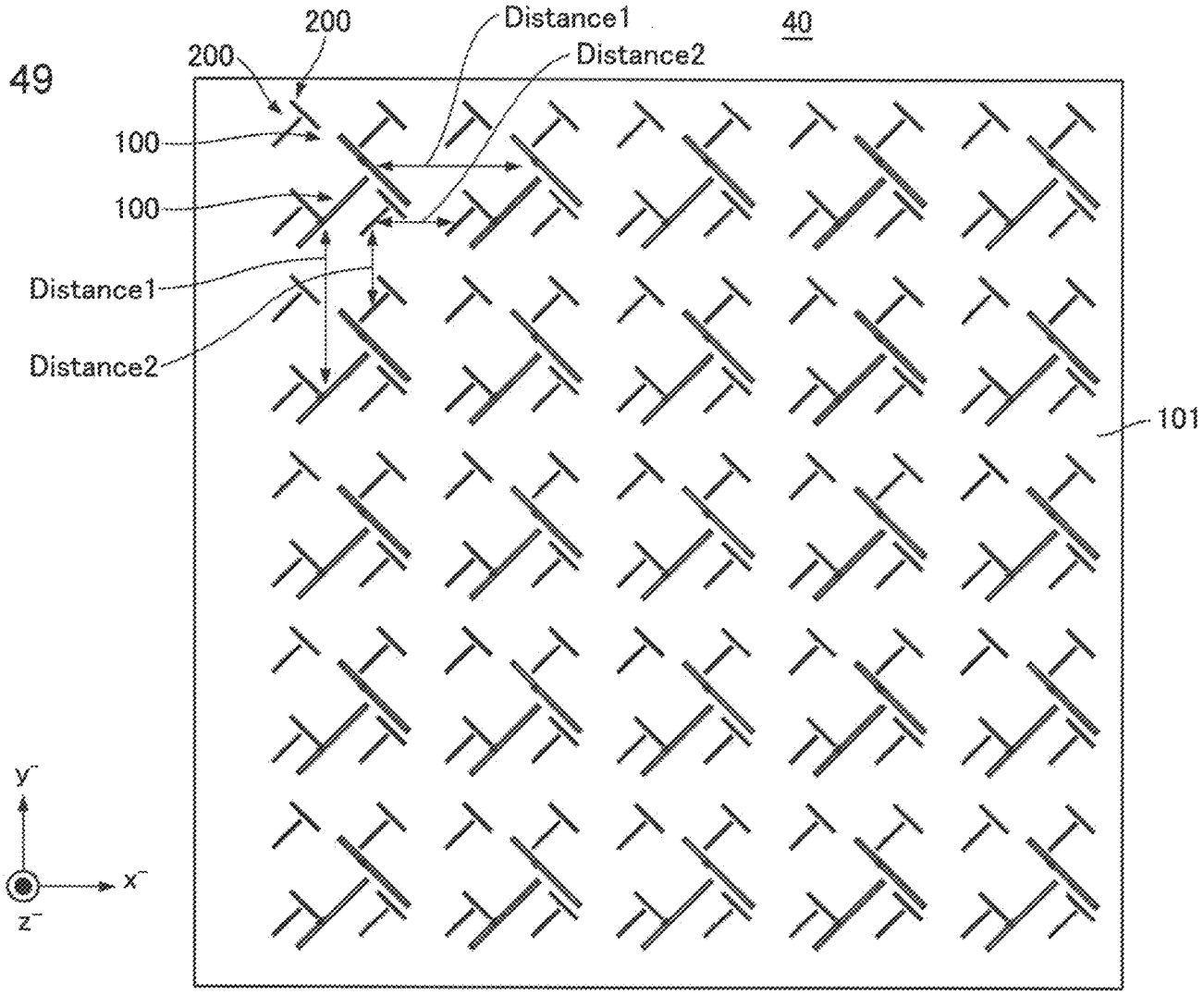
FIG. 49 is a top view illustrating a modification example of the antenna according to the fourth example embodiment of the present invention.
Figure 50:
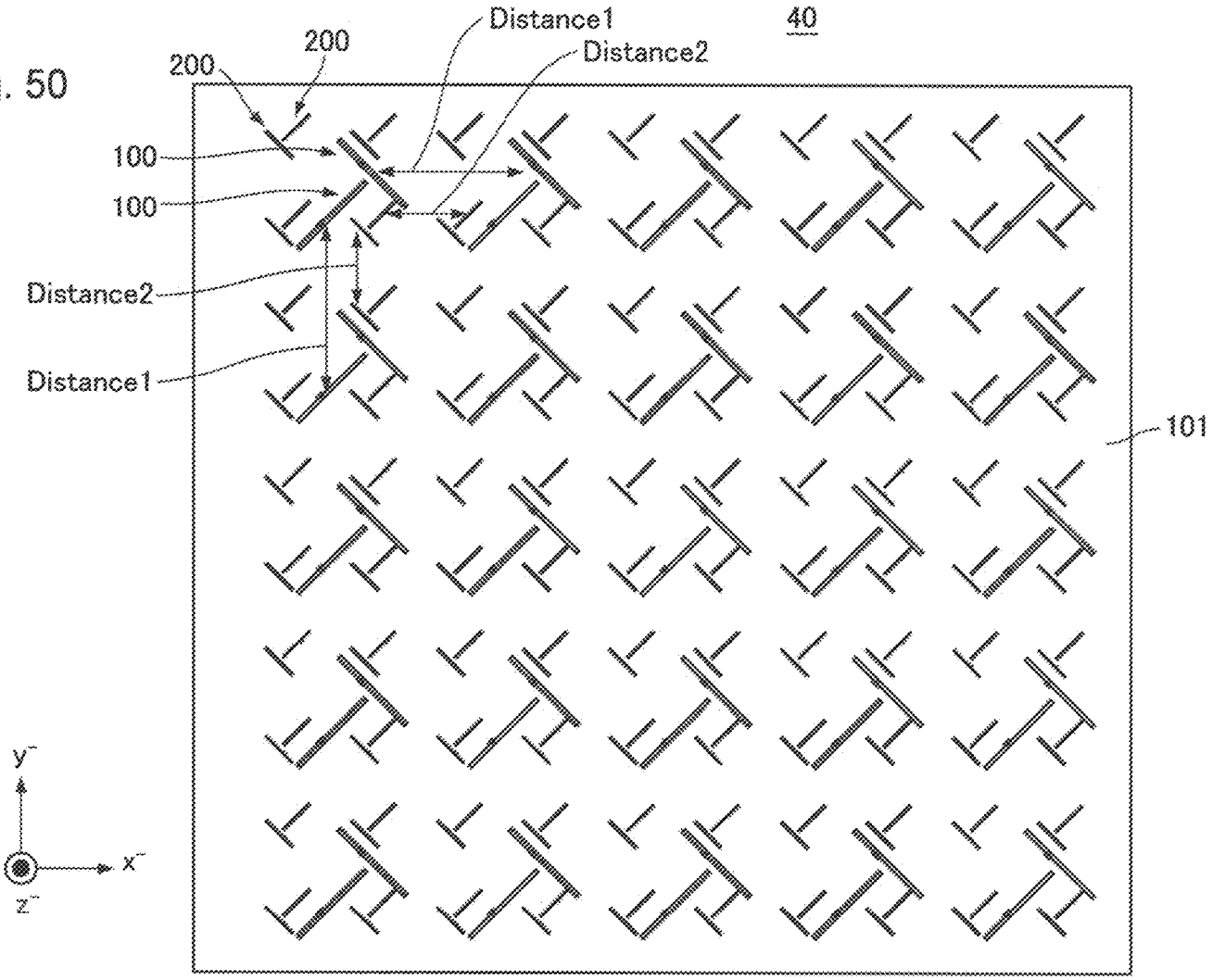
FIG. 50 is a top view illustrating a modification example of the antenna according to the fourth example embodiment of the present invention.

In addition, as in FIG. 48, the antenna elements 100 and 200 may be respectively dual-polarized with the T-shaped arrangement described in FIGS. 35, 36, and 37, and the arrangement may be such that an arrangement direction of an array is identical to an orientation of a T-shape. In addition, as in FIGS. 49 and 50, the antenna elements 100 and 200 may be respectively dual-polarized with the T-shaped arrangement described in FIGS. 35, 36, and 37, and the arrangement may be an inclined T-shaped arrangement such that an orientation of a T-shape is tilted by substantially 45° from an arrangement direction of an array.

Figure 51:
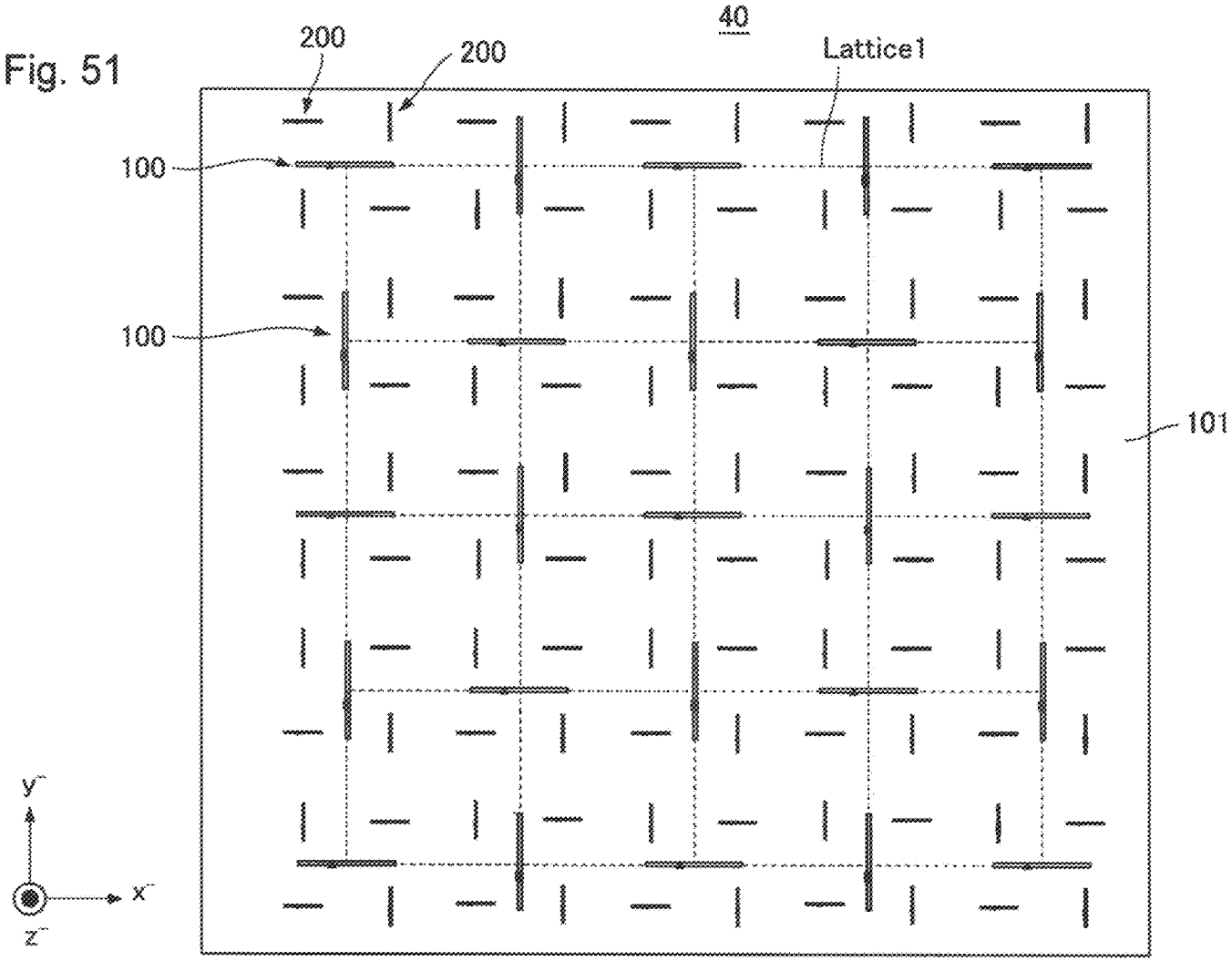
FIG. 51 is a top view illustrating a modification example of the antenna according to the fourth example embodiment of the present invention.

In addition, as illustrated in FIG. 51, the antenna elements 100 may be positioned in such a way that a substantial central section of an element matches with each of lattice points of a square lattice Lattice1 that is parallel with the conductor reflection plate 101, and the arrangement may be such that antenna elements on adjacent vertexes are all oriented in such a way that lengthwise directions thereof are perpendicular to each other. In other words, the antenna elements 100 on adjacent lattice points are in a substantial perpendicular relationship, in which a lengthwise direction of one antenna element 100 is oriented to a vicinity of a central in a lengthwise direction of another antenna element 100. With such an arrangement, the antenna elements 100 can be prevented from electromagnetically coupling with four surrounding antenna elements that are in a perpendicular relationship, owing to the advantageous effect described in the second example embodiment. Then, the antenna elements 200 can also take the similar arrangement, and by doing so, the antenna elements 100 and 200 can be also arranged so as not to overlap each other in a projected view on the conductor reflection plate 101, as in FIG. 51. Note that the square lattice Lattice1 may not necessarily be a square, and even a rectangular lattice can prevent coupling among four different polarization waves surrounding an antenna element.

Further, a plurality of antenna elements may not be arranged on lattice points having periodicity. As long as being arranged with spacing on a plane that is parallel with the conductor reflection plate 101 in two directions perpendicular to each other, each of the plurality of antenna elements can be oriented similarly to the above, and at this time, the above-described advantageous effect can be obtained.

In addition, not all of antenna elements may necessarily be in the above-described orientation and arrangement, but it is sufficient that a part of all the antenna elements satisfy performance requested by the antenna 40, even when being not in the above-described orientation and arrangement.

Figure 52:
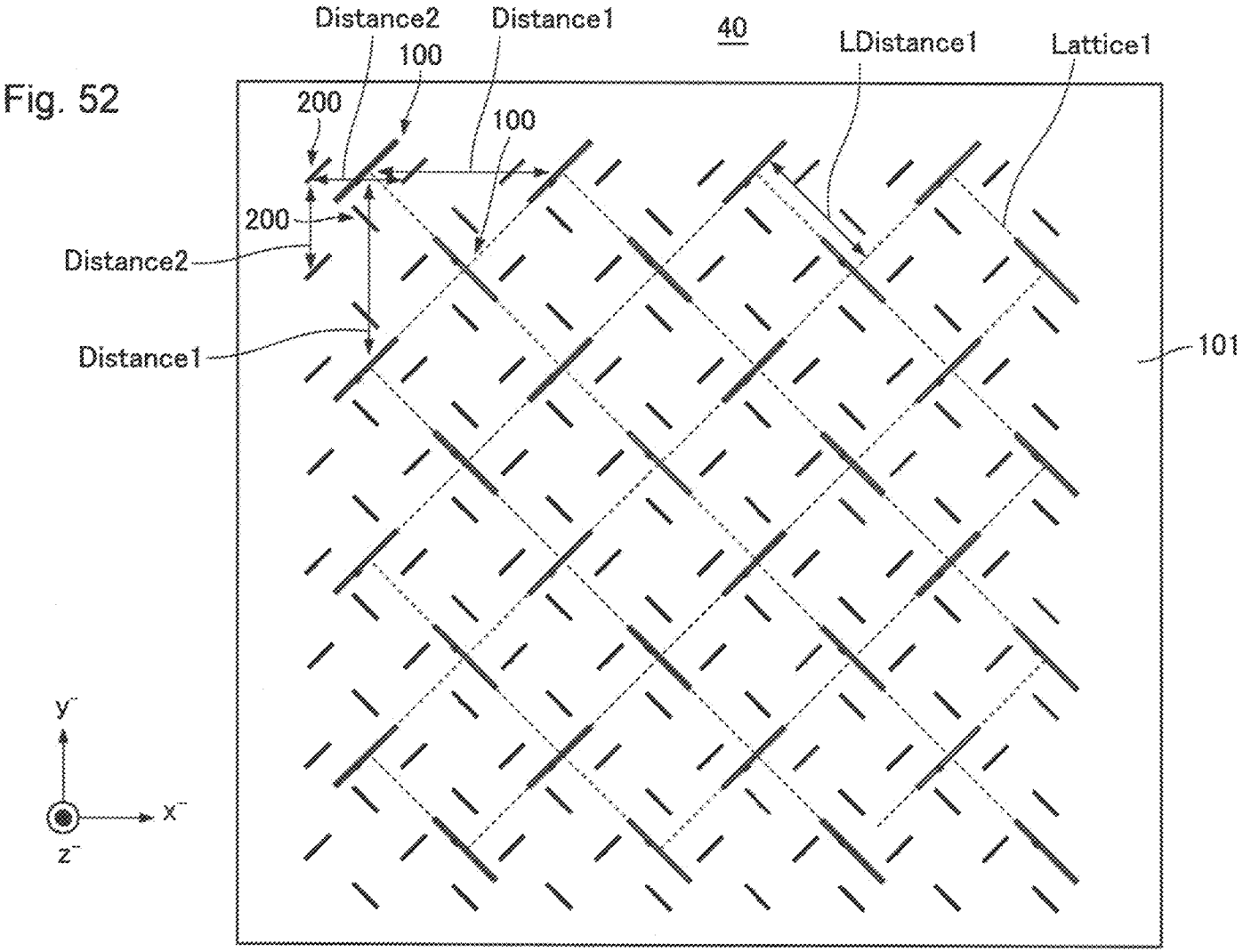
FIG. 52 is a top view illustrating a modification example of the antenna according to the fourth example embodiment of the present invention.

Further, as illustrated in FIG. 52, the antenna elements 100 and 200 can be also arranged in a square array having inter-element distances of Distance1 and Distance2 for respective polarization waves, while holding an arrangement relationship in FIG. 51. At this time, an inter-lattice-point distance LDistance1 of Lattice1 is $(1/2)\sqrt{2}\times$Distance1, and the antenna elements 200 are also arranged in the same way by changing scaling.

Figure 53:
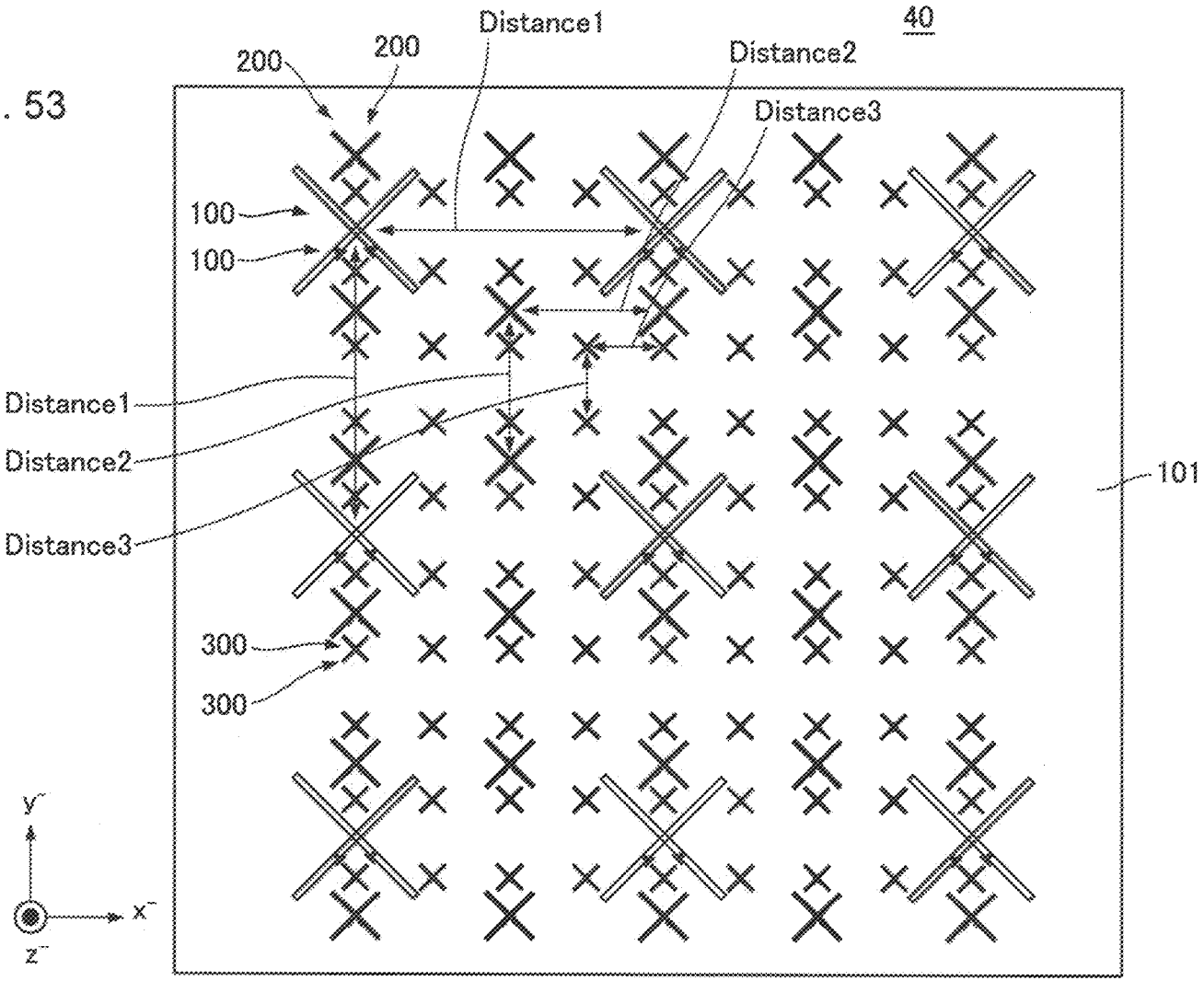
FIG. 53 is a top view illustrating a modification example of the antenna according to the fourth example embodiment of the present invention.
Figure 54:
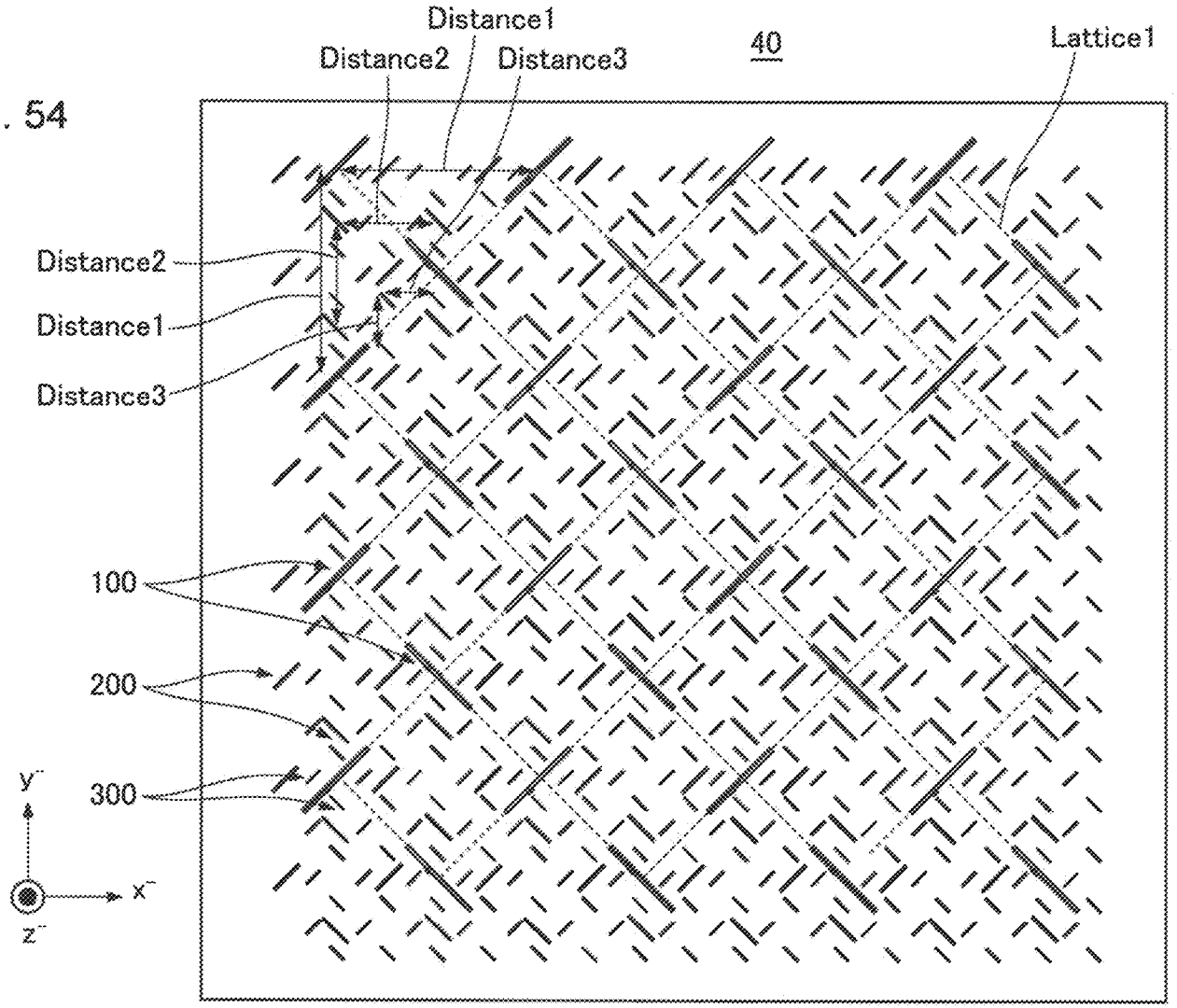
FIG. 54 is a top view illustrating a modification example of the antenna according to the fourth example embodiment of the present invention.

In addition, the antenna 40 may support not only two frequencies, but also three frequencies or more frequency bands, and a dual-polarized array antenna may be configured on an identical plane by three or more types of antenna elements. As in FIG. 53, for example, in addition to the configuration in FIG. 44, antenna elements 300 each having a resonance frequency in a third frequency band that is a frequency band higher than a second frequency band may be further arranged in a square array. The antenna elements 300 have the same configuration as the antenna elements 100 and 200, are dual-polarized in the same way as the antenna elements 100 and 200, and are arranged at an inter-element distance Distance3. Herein, for example, the antenna element 300 has a lengthwise size of approximately ¼ of λ3. In addition, in FIG. 53, Distance3=λ3/2, approximately. Note that λ3 indicates a wavelength of an electromagnetic wave whose frequency is a resonance frequency of a third antenna element when traveling through a substance filling a region. Also in this case, as illustrated in FIG. 53, the antenna elements 100, 200, and 300 can be also arranged so as not to overlap one another in a projected view on the conductor reflection plate 101. In FIG. 53, Distance1=2×Distance2=4×Distance3, approximately. Further, as illustrated in FIG. 54, a three-frequency-supporting dual-polarized array antenna may be configured with the same arrangement as in FIG. 52.

The dual polarization-supporting multiband antenna array in the antenna 40 described above is obtained by aligning a plurality of antenna elements 200 and 300 having different resonance frequencies in an array by using the same configuration as the antenna element 100. Then, as described above, the antenna element 100 has a size of approximately ¼ of λ1, which is compact while maintaining radiation efficiency. Owing to the compactness, a gap between elements of an array antenna in one frequency can be increased, and interaction between antenna elements corresponding to different frequencies can be prevented. When a wireless communications device is configured by using the antenna 40, a wireless communications device that is capable of multiband and dual polarization-supporting beamforming and, moreover, that has reduced interaction between antenna elements in different frequencies can be provided.

Herein, when deterioration in antenna performance such as radiation efficiency is ignored, it is possible to make an existing dipole antenna, patch antenna, or the like compact by means of meandering or by use of a high-dielectric constant material. The meandering can be mainly applied to a dipole antenna and a patch antenna, and the use of a high-dielectric constant material can be mainly applied to a patch antenna. Thus, even an existing antenna element that is made compact by such a technique makes it possible to configure a dual polarization-supporting multiband antenna array having an increased gap between elements of an array antenna in one frequency and having reduced interaction between antenna elements corresponding to different frequencies with the above-described arrangement.

Figure 55:
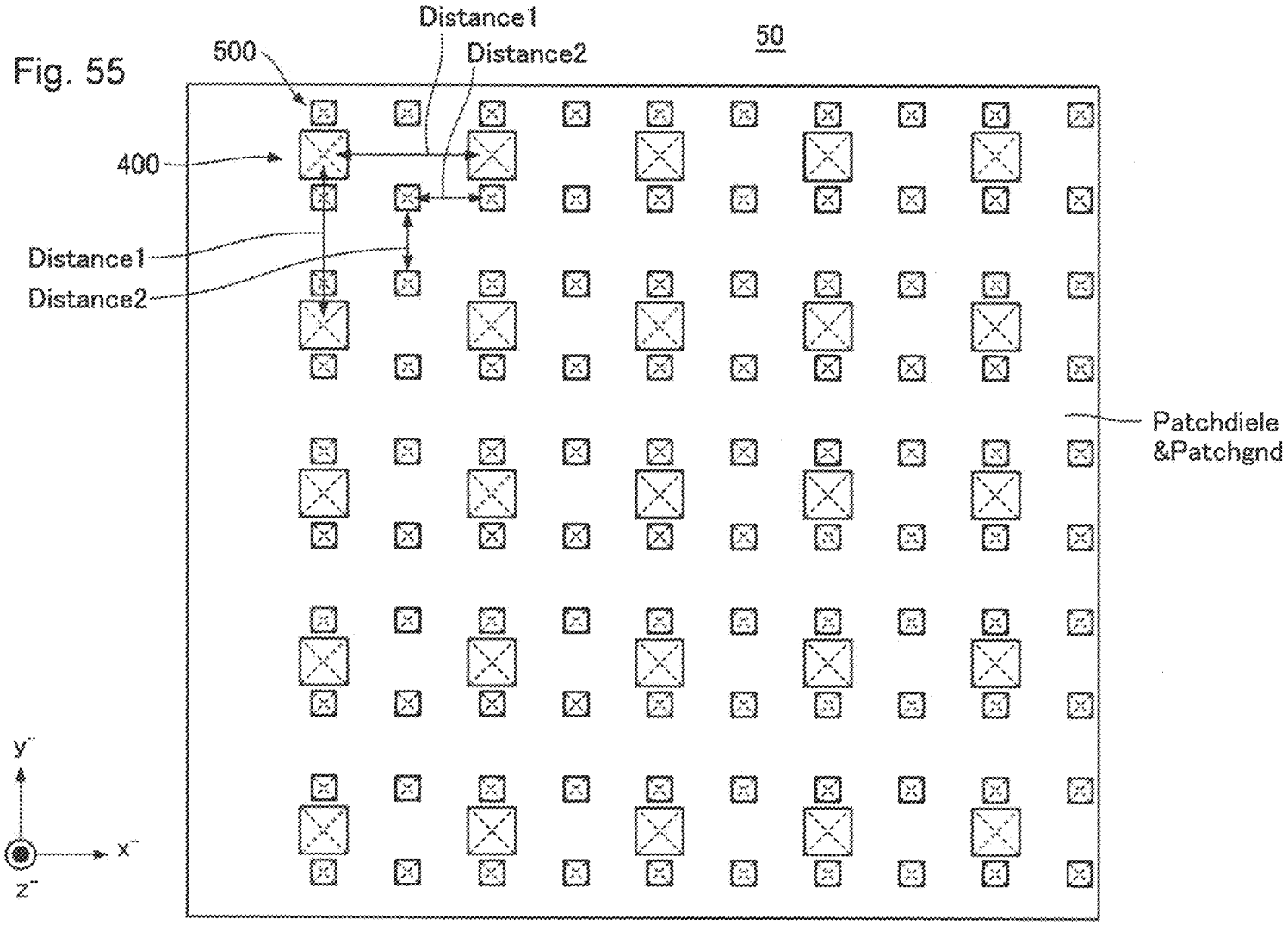
FIG. 55 is a top view illustrating a modification example of the antenna according to the fourth example embodiment of the present invention.
Figure 56:
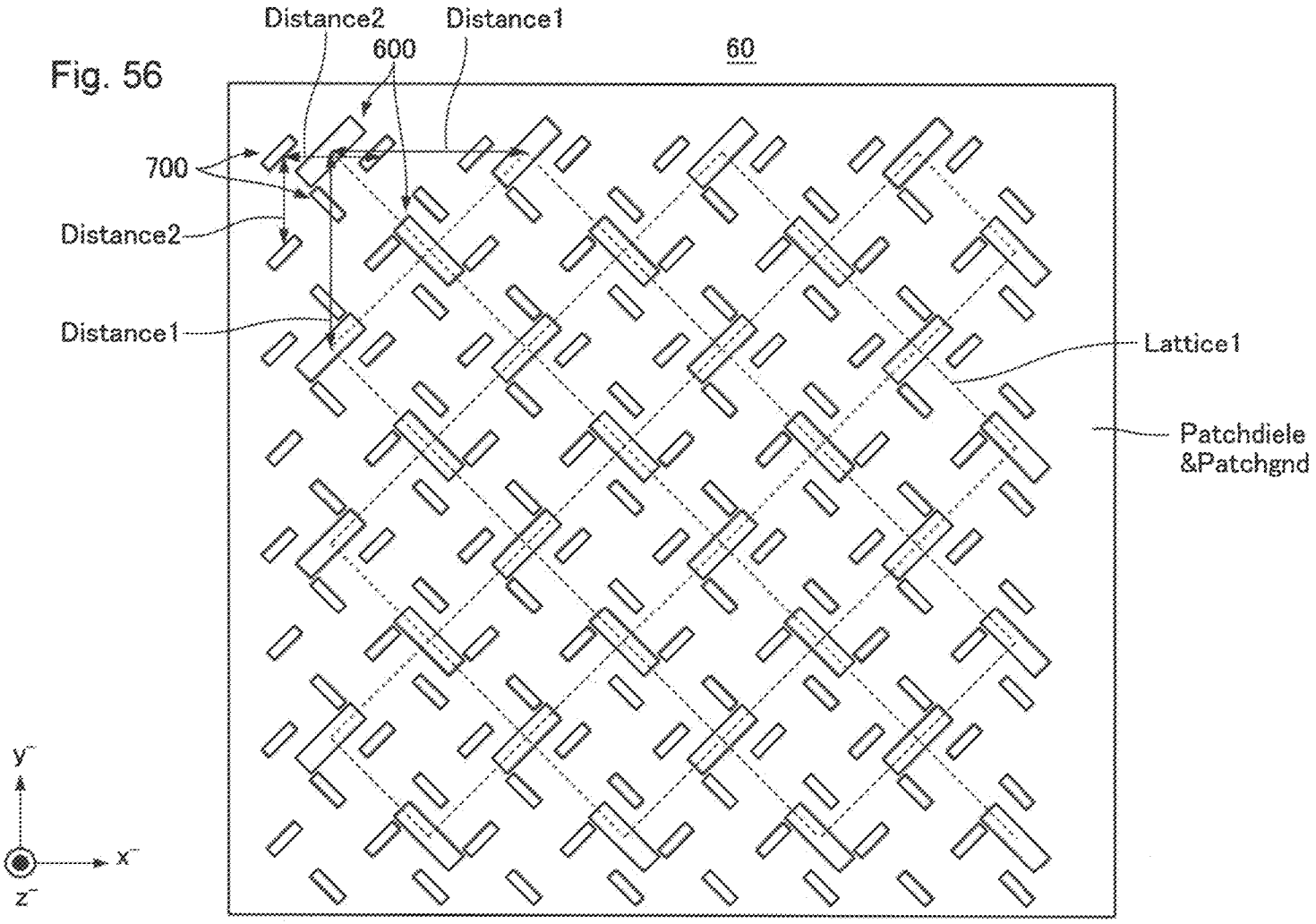
FIG. 56 is a top view illustrating a modification example of the antenna according to the fourth example embodiment of the present invention.

As an example, dual polarization-supporting multiband antenna arrays using patch antennas that correspond to the arrangements in FIGS. 44 and 52 are illustrated in FIGS. 55 and 56. Patch antennas 400 and 500 have resonance frequencies in a first frequency band and a second frequency band, respectively, are made compact by using a high-dielectric constant material Patchdiele, and are dual-polarized by having excitation points at two locations within a square patch. Then, similarly to 400 and 500, patch antennas 600 and 700 have resonance frequencies in a first frequency band and a second frequency band, respectively, are made compact by using a high-dielectric constant material Patchdiele, and are dual-polarized with the same arrangement as the arrangement described in the third example embodiment. As the high-dielectric constant material Patchdiele, for example, a ceramics substrate such as an alumina substrate, and an aluminum nitride substrate is used.

The antenna array in aforementioned PTL 1 (International Publication WO 2014/059946) forms an array by alternately aligning high-band and low-band crossed-dipole antenna elements on an antenna reflector. Further, central conductive fences 1340 are provided between the alignments to reduce mutual coupling. However, this publication describes nothing about spacing between antenna elements and orientation of adjacent antenna elements, which are described in the present example embodiment.

In addition, likewise, in aforementioned PTL 2 (U.S. Pat. No. 6,025,812), in FIGS. 2a, 2b, and 2c, a decoupling element (decoupling structural element 17) is arranged between individual antenna elements (radiation element module 1) of a single-frequency antenna array. However, this decoupling element is not used as an antenna, and the array in PTL 2 is not multiband.

Figure 57:
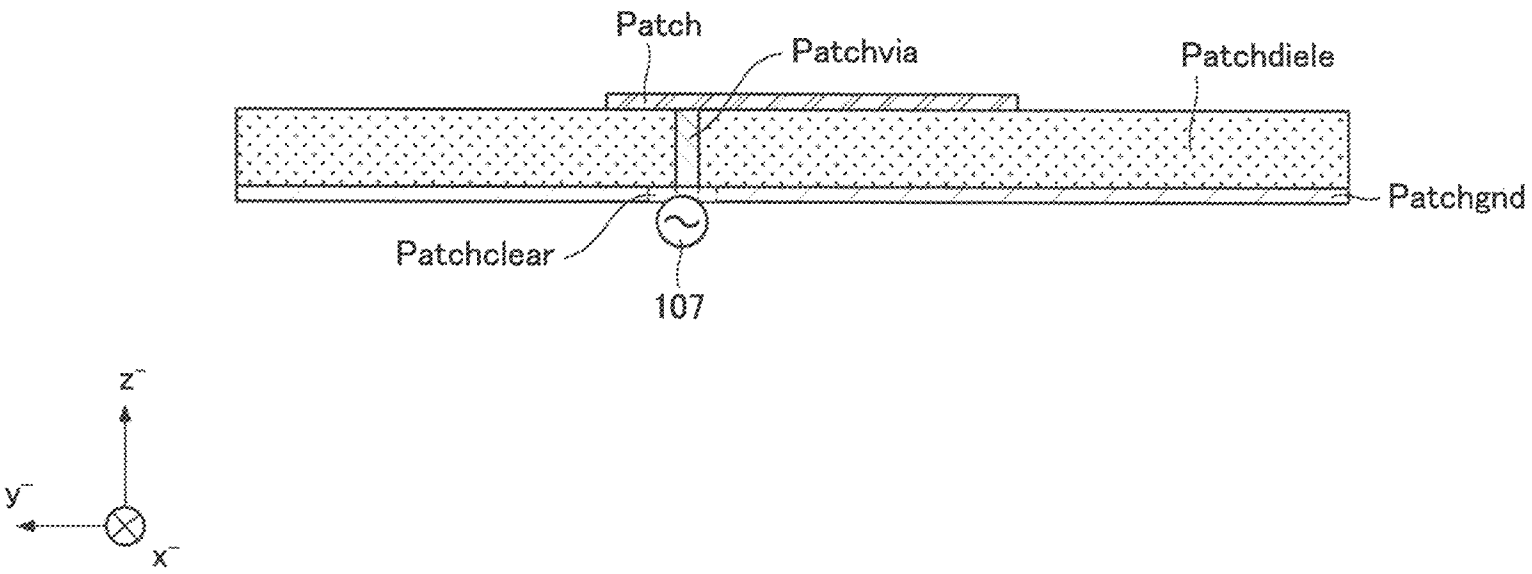
FIG. 57 is a side view illustrating a modification example of the antenna according to the fourth example embodiment of the present invention.

FIG. 57 illustrates a representative sectional view of a patch antenna. For example, as illustrated in FIG. 57, each of the patch antennas 400, 500, 600, and 700 includes a GND conductor plate Patchgnd, a dielectric plate Patchdiele, a patch conductor Patch, a conductor via Patchvia, and a feed point 107. The dielectric plate Patchdiele is coupled on the GND conductor plate Patchgnd. The patch conductor Patch is coupled to a face of the dielectric plate Patchdiele on an opposite side from the GND conductor plate Patchgnd. The conductor via Patchvia penetrates through the dielectric plate Patchdiele, and has one end electrically connected with the patch conductor Patch and another end reaching a face of the GND conductor plate Patchgnd on an opposite side from the dielectric plate patchdiele by passing through a clearance section Patchclear opened inside the GND conductor plate Patchgnd. The feed point 107 electrically excites between the conductor via Patchvia and the GND conductor plate Patchgnd.

For example, a part or all of the above-described example embodiments can be described as the following Supplementary notes, but are not limited to the following.

(Supplementary Note 1)

A multiband antenna including: a conductor reflection plate; a first antenna that includes a first antenna element and is provided on the conductor reflection plate; and a second antenna that includes a second antenna element having an electromagnetic resonance frequency that is a frequency different from an electromagnetic resonance frequency of the first antenna element included in the first antenna, and that is provided on the conductor reflection plate, wherein each of the first antenna element and the second antenna element includes: a C-shaped conductor that is a substantially C-shaped conductor having a split section formed in such a way that an annular conductor becomes partially discontinuous; and a conductor feed line that is electrically connected with one part out of both parts of the C-shaped conductor facing each other across the split section, and that constitutes an electric circuit for feeding power to the C-shaped conductor.

(Supplementary Note 2)

The multiband antenna according to Supplementary note 1, wherein each of the first antenna element and the second antenna element further includes a conductor feed section that constitutes another electric circuit for feeding power to the C-shaped conductor, and the conductor feed section has one end coupled to an outer edge portion of the C-shaped conductor and another end coupled to the conductor reflection plate, and is arranged by being aligned with the conductor feed line.

(Supplementary Note 3)

The multiband antenna according to Supplementary note 2, wherein each of the first antenna element and the second antenna element has one end of the conductor feed section coupled to a part of an outer edge portion of the C-shaped conductor, facing the split section.

(Supplementary Note 4)

The multiband antenna according to any one of Supplementary notes 1 to 3, wherein each of the first antenna element and the second antenna element further includes at least one auxiliary conductor that is electrically connected with one part out of both parts of the C-shaped conductor facing each other across the split section, and faces another part.

(Supplementary Note 5)

The multiband antenna according to any one of Supplementary notes 1 to 4, wherein each of the first antenna element and the second antenna element further includes at least one conductor radiation section that is electrically connected with an outer edge at an end of the C-shaped conductor in a facing direction of both parts of the C-shaped conductor facing each other across the split section.

(Supplementary Note 6)

The multiband antenna according to any one of Supplementary notes 1 to 5, wherein each of the first antenna and the second antenna includes two of the first antenna elements and two of the second antenna elements, and the two first antenna elements and the two second antenna elements are respectively in a substantial perpendicular relationship with respect to each other, in a projected view on the conductor reflection plate.

(Supplementary Note 7)

The multiband antenna according to any one of Supplementary notes 1 to 6, wherein each of the first antenna element and the second antenna element is provided at a predetermined distance from the conductor reflection plate.

(Supplementary Note 8)

The multiband antenna according to Supplementary note 7, wherein the predetermined distance is substantially ¼ of a wavelength of an electromagnetic wave at a resonance frequency of each of the first antenna and the second antenna.

(Supplementary Note 9)

The multiband antenna according to any one of Supplementary notes 1 to 8, wherein each of the first antenna element and the second antenna element is provided perpendicularly or in parallel with the conductor reflection plate.

(Supplementary Note 10)

The multiband antenna according to any one of Supplementary notes 1 to 9, wherein the first antenna and the second antenna are provided on a common dielectric substrate.

(Supplementary Note 11)

The multiband antenna according to any one of Supplementary notes 1 to 10, wherein the C-shaped conductor includes a cutout at a part on an opposite side from the split section, and the conductor feed line passes through the cutout.

(Supplementary Note 12)

The multiband antenna according to any one of Supplementary notes 1 to 11, wherein a bridging conductor for conducting the cutout without making contact with the conductor feed line is included.

(Supplementary Note 13)

The multiband antenna according to any one of Supplementary notes 1 to 12, wherein leading end sections of the C-shaped conductor facing each other across the split section are bent.

(Supplementary Note 14)

The multiband antenna according to any one of Supplementary notes 1 to 13, wherein a plurality of the C-shaped conductors are provided in an overlapping manner, and the plurality of C-shaped conductors are electrically connected with each other.

(Supplementary Note 15)

The multiband antenna according to any one of Supplementary notes 5 to 14, wherein a side of the conductor radiation section is longer than a side of the C-shaped conductor in contact therewith.

(Supplementary Note 16)

The multiband antenna according to any one of Supplementary notes 2 to 15, wherein a size of the conductor feed section when viewed in a lengthwise direction of each of the first antenna element and the second antenna element is equal to or less than ½ of a size of each of the first antenna element and the second antenna element in the lengthwise direction.

(Supplementary Note 17)

The multiband antenna according to any one of Supplementary notes 2 to 16, wherein the conductor feed section is positioned at around a central of each of the first antenna element and the second antenna element, within ½ of a lengthwise size of each of the first antenna element and the second antenna element.

(Supplementary Note 18)

The multiband antenna according to any one of Supplementary notes 2 to 17, wherein the conductor feed line and the conductor feed section constitute a coplanar line or a coaxial line.

(Supplementary Note 19)

The multiband antenna according to any one of Supplementary notes 1 to 18, wherein the conductor feed line is constituted of a coaxial cable.

(Supplementary Note 20)

The multiband antenna according to any one of Supplementary notes 6 to 19, wherein the first antenna element included in the first antenna and the second antenna element included in the second antenna are in substantial perpendicular relationship with respect to each other, in a projected view on the conductor reflection plate.

(Supplementary Note 21)

The multiband antenna according to any one of Supplementary notes 6 to 20, wherein the plurality of first antenna elements included in the first antenna, and the plurality of second antenna elements included in the second antenna respectively intersect each other in a vicinity of the split section, in a projected view on the conductor reflection plate.

(Supplementary Note 21-1)

The multiband antenna according to any one of Supplementary notes 14 to 21, wherein a conductor of at least one of the plurality of C-shaped conductors provided in an overlapping manner, at a part facing the split section across an opening, is removed.

(Supplementary Note 21-2)

The multiband antenna according to any one of Supplementary notes 14 to 21-1, wherein a C-shaped conductor from which a conductor at a part facing the split section across an opening is removed is sandwiched between C-shaped conductors from each of which the conductor is not removed.

(Supplementary Note 21-3)

The multiband antenna according to any one of Supplementary notes 1 to 21, and 21-1 to 21-2, wherein a metamaterial reflection plate is used as the conductor reflection plate.

(Supplementary Note 21-4)

The multiband antenna according to Supplementary note 21-2, wherein a conductor feed section is provided for each of C-shaped conductors from each of which a conductor at a part facing the split section across an opening is not removed, the C-shaped conductors sandwiching a C-shaped conductor from which the conductor is removed.

(Supplementary Note 22)

A multiband antenna array including a plurality of the first antennas and a plurality of the second antennas according to any of Supplementary notes 1 to 21, and Supplementary notes (21-1) to (21-4).

(Supplementary Note 23)

The multiband antenna array according to Supplementary note 22, wherein a plurality of the first antennas are arranged in a shape of a lattice along a plane that is substantially parallel with the conductor reflection plate, at a substantially equal interval of substantially ½ of a wavelength of an electromagnetic wave at a resonance frequency of the first antenna element included in the first antenna, and a plurality of the second antennas are arranged in a shape of a lattice along a plane that is substantially parallel with the conductor reflection plate, at a substantially equal interval of substantially ½ of a wavelength of an electromagnetic wave at a resonance frequency of the second antenna element included in the second antenna.

(Supplementary Note 24)

The multiband antenna array according to Supplementary note 22 or 23, wherein the plurality of first antenna elements included in the plurality of first antennas are arranged so as to be aligned with spacing in both a longitudinal direction and a lateral direction in a projected view on a plane that is parallel with the conductor reflection plate, the adjacent first antenna elements are in a substantial perpendicular relationship, and a lengthwise direction of either one is oriented to a vicinity of a central in a lengthwise direction of another, and the plurality of second antenna elements included in the plurality of second antennas are arranged so as to be aligned with spacing in both a longitudinal direction and a lateral direction in a projected view on a plane that is parallel with the conductor reflection plate, the adjacent second antenna elements are in a substantial perpendicular relationship, and a lengthwise direction of either one is oriented to a vicinity of a central in a lengthwise direction of another.

(Supplementary Note 25)

The multiband antenna array according to any one of Supplementary notes 22 to 24, wherein the lattice is a square or rectangular shape.

(Supplementary Note 26)

The multiband antenna array according to any one of Supplementary notes 22 to 25, wherein the first antenna element of the plurality of first antennas, and the second antenna element of the plurality of second antennas are arranged in a cross shape or obliquely.

(Supplementary Note 27)

The multiband antenna array according to any one of Supplementary notes 22 to 26, wherein the first antenna element of the plurality of first antennas is arranged in a T-shape or in an inclined T-shape with respect to the second antenna element of the plurality of second antennas.

(Supplementary Note 28)

The multiband antenna array according to any one of Supplementary notes 22 to 27, wherein a dipole antenna or a patch antenna is used as the first antenna and the second antenna, instead of the first antenna element and the second antenna element each including the C-shaped conductor.

(Supplementary Note 29)

The multiband antenna array according to any one of Supplementary notes 22 to 28, wherein the dipole antenna or patch antenna has a meander shape or uses a high-dielectric constant material.

(Supplementary Note 30)

A wireless communications device equipped with the multiband antenna according to any of Supplementary notes 1 to 21 or the multiband antenna array according to any of Supplementary notes 22 to 29.

In the above, the present invention has been described using the example embodiments described above as exemplary examples. However, the present invention is not limited to the above-described example embodiments. In other words, various modes that a person skilled in the art can understand can be applied to the present invention within the scope of the present invention.

This application is based upon and claims the benefit of priority from Japanese Patent Application No. 2015-027372, filed on Feb. 16, 2015, the disclosure of which is incorporated herein in its entirety.

REFERENCE SIGNS LIST

10 Antenna
11 Wireless communications device
20 Antenna
100, 200 Antenna element
101 Conductor reflection plate
104 C-shaped conductor
105 Conductor feed line
106 Conductor via
107 Feed point
108 Dielectric layer
109 Split section
110, 111 Conductor part
112 Dielectric radome
113 Transmission line
114 Radio communication circuit section
116 Bridging conductor
117 Conductor radiation section
118 Auxiliary conductor pattern
119 Conductor via
120 C-shaped conductor
121 Conductor via
122 Split section
123 Conductor feed section
124 Conductor feed section
125 Conductor via
126 Clearance
127 Connector
128 Core wire
129 Outer conductor
151 Conductor feed line
152 Conductor feed line
154 Conductor feed line
160 Coaxial cable
161 Core wire
162 Outer conductor
165 Slit section
170 Baseband processing section

The invention claimed is:

1. An antenna comprising:

a conductor reflection plate;

a first antenna element; and a second antenna element, wherein the first antenna element and the second antenna element are disposed above the conductor reflection plate; and an electromagnetic resonance frequency of the first antenna element and an electromagnetic resonance frequency of the second antenna element are different from each other, and each of the first antenna element and the second antenna element comprises:

a substantially C-shaped conductor of a shape in which a part of a closed shape is discontinuous by a split;

a conductor feed line; and a conductor feed section, wherein:

a first of the conductor feed line is electrically connected to one part out of both parts of the substantially C-shaped conductor opposing each other across the split, a second end of the conductor feed line is extended toward the conductor reflection plate, a first end of the conductor feed section is continuously connected to an outer edge of the substantially C-shape conductor, a second end of the conductor feed section is extended toward the conductor reflection plate, and the conductor feed line and the conductor feed section are opposed to each other and constitute an electric path for feeding power to the substantially C-shaped conductor.

2. The antenna according to claim 1, further comprising:

a plurality of the first antenna elements, and a plurality of the second antenna elements, wherein the plurality of first antenna elements are arranged so as to be aligned with spacing in both a longitudinal direction and a lateral direction in a projected view on a plane that is parallel with the conductor reflection plate, and adjacent ones of the first antenna elements are in a substantial perpendicular relationship, and a lengthwise direction of either one of the adjacent ones of the first antenna elements is oriented to a vicinity of a center in a lengthwise direction of another, and the plurality of second antenna elements are arranged so as to be aligned with spacing in both a longitudinal direction and a lateral direction in a projected view on a plane that is parallel with the conductor reflection plate, and adjacent ones of the second antenna elements are in a substantial perpendicular relationship, and a lengthwise direction of either one of the adjacent ones of the second antenna elements is oriented to a vicinity of a center in a lengthwise direction of another.

3. A wireless communications device equipped with the antenna according to claim 1.

4. The antenna according to the claim 1, wherein a connection point of at least one of the first antenna element and the second antenna element that connects the substantially C-shaped conductor with the conductor feed section is positioned at around a center of the substantially C-shaped conductor.

5. The antenna according to the claim 1, wherein a connection point of at least one of the first antenna element and the second antenna element is positioned, on each side thereof, within ¼ of a lengthwise size in a view from around a center of the C-shaped conductor.

6. The antenna according to the claim 1, wherein at least one of the first antenna element and the second antenna element comprises:

a connection point , wherein the conductor feed line, and the conductor feed section are positioned in a same layer, wherein the second end of the conductor feed line of at least one of the first antenna element and the second antenna element is extended through an inner part of a slit of a conductor that is shaped by connecting the C-shaped conductor with the conductor feed section.

7. The antenna according to the claim 1, wherein the whole or parts of the conductor feed line of at least one of the first antenna element and the second antenna element is a core wire of a coaxial cable; and the whole or parts of the conductor feed section of the at least one of the first antenna element and the second antenna element is an external conductor of a coaxial cable.

8. The antenna according to the claim 1, wherein the second end of the conductor feed line, and the second end of the conductor feed section of at least one of the first antenna element and the second antenna element are extended toward a back side of the conductor reflection plate through a hole of the conductor reflection plate.

9. The antenna according to the claim 1, further comprising:

two of the first antenna elements, and two of the second antenna elements, wherein the two of the first antenna elements are respectively in a substantially perpendicular relationship with each other in a projected view on the conductor reflection plate, and wherein the two of the second antenna elements are respectively in a substantially perpendicular relationship with each other in a projected view on the conductor reflection plate.

10. The antenna according to the claim 9, wherein pairs of the two first antenna elements are arranged in a shape of a lattice along a plane that is substantially parallel with the conductor reflection plate, at a substantially equal interval of substantially ½ of a wavelength of an electro-magnetic wave at a resonance frequency of the first antenna element, and wherein pairs of the two of the second antenna elements are arranged in a shape of a lattice along a plane that is substantially parallel with the conductor reflection plate, at a substantially equal interval of substantially ½ of a wavelength of an electro-magnetic wave at a resonance frequency of the second antenna element.

* * * * *